US008061819B2

(12) United States Patent
Suzuki

(10) Patent No.: US 8,061,819 B2
(45) Date of Patent: Nov. 22, 2011

(54) LIQUID EJECTING METHOD, LIQUID EJECTING HEAD, AND LIQUID EJECTING APPARATUS

(75) Inventor: Yoshiyuki Suzuki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 446 days.

(21) Appl. No.: 12/398,623

(22) Filed: Mar. 5, 2009

(65) Prior Publication Data

US 2009/0225135 A1 Sep. 10, 2009

(30) Foreign Application Priority Data

Mar. 7, 2008 (JP) ..... 2008-058455
Nov. 28, 2008 (JP) ..... 2008-305334

(51) Int. Cl.
*B41J 2/05* (2006.01)

(52) U.S. Cl. ..... 347/65; 347/68

(58) Field of Classification Search ..... 347/47, 347/64–68
See application file for complete search history.

(56) References Cited

U.S. PATENT DOCUMENTS 7,661,802 B2 * 2/2010 Hara et al. ..... 347/68
7,722,165 B2 * 5/2010 Iriguchi ..... 347/71
2006/0023029 A1 2/2006 Mataki
2006/0050111 A1 3/2006 Mataki

FOREIGN PATENT DOCUMENTS

EP 0 622 210 A1 11/1994
EP 1 518 679 A2 3/2005
JP 2005-034998 2/2005

* cited by examiner

*Primary Examiner* — Lamson Nguyen
(74) *Attorney, Agent, or Firm* — Workman Nydegger

(57) ABSTRACT

Provided is a liquid ejecting method, comprising ejecting a liquid from a liquid ejecting head, wherein: the viscosity of the liquid is in a range from 6 mPa·s to 15 mPa·s, the liquid ejecting head includes: nozzles which eject the liquid; a pressure chamber which applies a pressure variation to the liquid in order to eject the liquid from the nozzles; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit.

9 Claims, 51 Drawing Sheets

LIQUID EJECTING METHOD, LIQUID EJECTING HEAD, AND LIQUID EJECTING APPARATUS

BACKGROUND

1. Technical Field

The present invention relates to a liquid ejecting method, a liquid ejecting head, and a liquid ejecting apparatus.

2. Related Art

A liquid ejecting apparatus such as an ink jet printer includes a liquid ejecting head including nozzles for ejecting a liquid, a pressure chamber for providing a pressure variation to the liquid such that the liquid is ejected from the nozzles, and a supply unit for supplying the liquid stored in a reservoir to the pressure chamber. In this liquid ejecting head, the size of a liquid channel in the head is determined on the basis of a liquid having viscosity close to that of water (See JP-A-2005-34998).

Recently, a liquid having viscosity higher than that of a general ink attempts to be ejected using an ink jet technology. In addition, if the liquid having the high viscosity is ejected by a head having the existing shape, the ejection of the liquid becomes unstable. For example, flight deflection of the liquid occurs or shortage of the ejection amount of the liquid occurs.

SUMMARY

An advantage of some aspects of the invention is that the ejection of a liquid having viscosity higher than that of a general ink becomes stable.

According to an aspect of the invention, there is provided a liquid ejecting method, including ejecting a liquid from a liquid ejecting head, wherein: the viscosity of the liquid is in a range from 6 mPa·s to 15 mPa·s, the liquid ejecting head includes: nozzles which eject the liquid; a pressure chamber which applies a pressure variation to the liquid in order to eject the liquid from the nozzles; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit.

The other features of the invention will become apparent from the description of the present specification and the accompanying drawings.

BRIEF DESCRIPTION OF THE DRAWINGS

The invention will be described with reference to the accompanying drawings, wherein like numbers reference like elements.

FIG. 3 is a block diagram explaining the configuration of a driving signal generation circuit and the like.

DESCRIPTION OF EXEMPLARY EMBODIMENTS

Figure 1:
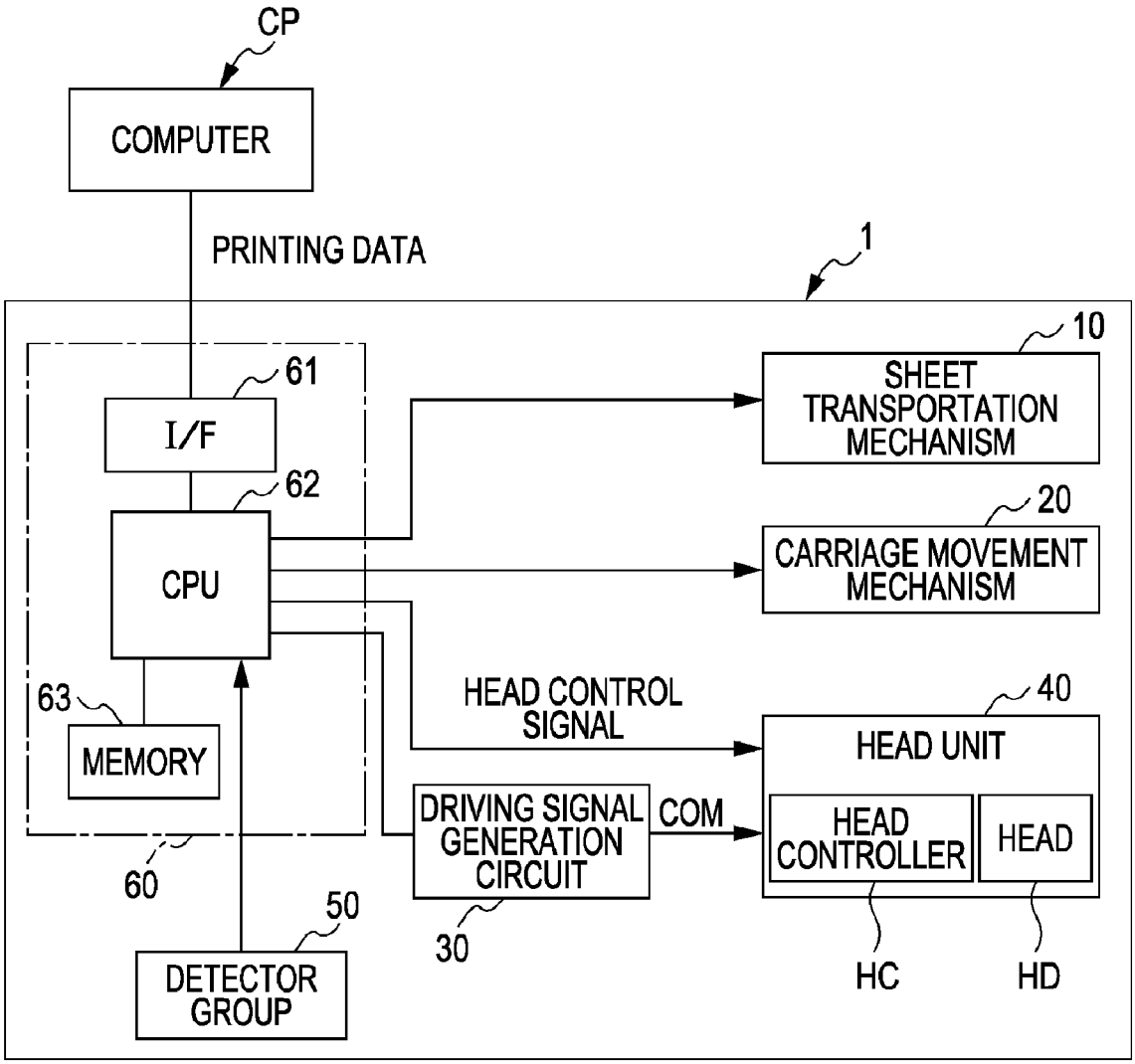
FIG. 1 is a block diagram explaining the configuration of a printing system.

At least the following will become apparent from the description of the specification and the accompanying drawings.

That is, it will become apparent that a liquid ejecting method, including ejecting a liquid from a liquid ejecting head, wherein: the viscosity of the liquid is in a range from 6 mPa·s to 15 mPa·s, the liquid ejecting head includes: nozzles which eject the liquid; a pressure chamber which applies a pressure variation to the liquid in order to eject the liquid from the nozzles; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit, can be realized.

According to this liquid ejecting method, it is possible to properly adjust the amount of liquid flowing in the supply unit. As a result, it is possible to stabilize the ejection of the liquid having high viscosity.

In the liquid ejecting method, the channel resistance of the supply unit may be higher than that of the pressure chamber.

According to the liquid ejecting method, it is possible to suppress the residual vibration after the ejection of the liquid at an early stage.

In the liquid ejecting method, the channel resistance of the nozzles may be higher than that of the supply unit.

According to the liquid ejecting method, it is possible to suppress the shortage of the supply of the liquid to the pressure chamber with certainty.

In the liquid ejecting method, the cross-sectional area of the supply unit may be in a range from $3.3\times10^{-15}$ $m^2$ to $10\times10^{-15}$ $m^2$.

According to this liquid ejecting method, it is possible to eject the liquid by the amount of about 10 ng from the nozzles.

In the liquid ejecting method, the channel length of the pressure chamber may be in a range from 500 μm to 1000 μm.

According to this liquid ejecting method, it is possible to eject the liquid by the amount of about 10 ng from the nozzles.

In the liquid ejecting method, the pressure chamber may have a partitioning portion which partitions a portion of the pressure chamber and applies the pressure variation to the liquid by deformation.

According to this liquid ejecting method, it is possible to efficiently apply the pressure variation to the liquid contained in the pressure chamber.

In the liquid ejecting method, the liquid ejecting head may include an element which deforms the partitioning portion by the degree according to a potential variation pattern of an applied ejection pulse.

According to this liquid ejecting method, it is possible to control the pressure of the liquid contained in the pressure chamber with high accuracy.

In addition, it will become apparent that the following liquid ejecting head can be realized.

That is, it will become apparent that a liquid ejecting head including: nozzles which eject the liquid; a pressure chamber which applies a pressure variation to the liquid in order to eject the liquid from the nozzles; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit can be realized.

In addition, it will become apparent that the following liquid ejecting apparatus can be realized.

That is, it will become apparent that a liquid ejecting apparatus including: an ejection pulse generation unit which generates an ejection pulse; and a liquid ejection head which ejects a liquid from nozzles and includes: a pressure chamber which deforms a partitioning portion and applies a pressure variation to the liquid in order to eject the liquid from the nozzles; an element which deforms the partitioning portion by the degree according to a potential variation pattern of an applied ejection pulse; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit can be realized.

Printing System

The printing system shown in FIG. 1 includes a printer 1 and a computer CP. The printer 1 corresponds to a liquid ejecting apparatus, which ejects an ink, which is a liquid, onto a medium such as paper, cloth, or a film. The medium is an object onto which the liquid is ejected. The computer CP is connected to and is communicated with the printer 1. In order to print an image by the printer 1, the computer CP transmits printing data according to the image to the printer 1.

Outline of Printer 1

The printer 1 includes a sheet transportation mechanism 10, a carriage movement mechanism 20, a driving signal generation circuit 30, a head unit 40, a detector group 50 and a printer controller 60.

The sheet transportation mechanism 10 transports a sheet in a transportation direction. The carriage movement mechanism 20 moves a carriage, in which the head unit 40 is mounted, in a predetermined movement direction (for example, a paper width direction). The driving signal generation circuit 30 generates a driving signal COM. This driving signal COM is applied to a head HD (piezo-element 433, see FIG. 2A) at the time of printing of the sheet, and is a series of signals including ejection pulses PS like an example of FIG. 4. The ejection pulses PS are potential variation patterns for allowing the piezo-element 433 to perform a predetermined operation in order to eject a droplet-shaped ink from the head HD. Since the driving signal COM includes the ejection pulses PS, the driving signal generation circuit 30 corresponds to an ejection pulse generation unit In addition, the configuration of the driving signal generation circuit 30 or the ejection pulses PS will be described later. The head unit 40 includes the head HD and a head controller HC. The head HD is a liquid ejection head, which ejects an ink onto a sheet. The head controller HC controls the head HD on the basis of a head control signal from the printer controller 60. In addition, the head HD will be described later. The detector group 50 includes a plurality of detectors for monitoring the status of the printer 1. The detected result of the detectors is output to the printer controller 60. The printer controller 60 performs the whole control of the printer 1. This printer controller 60 will be described later.

Head HD

Figure 2A:
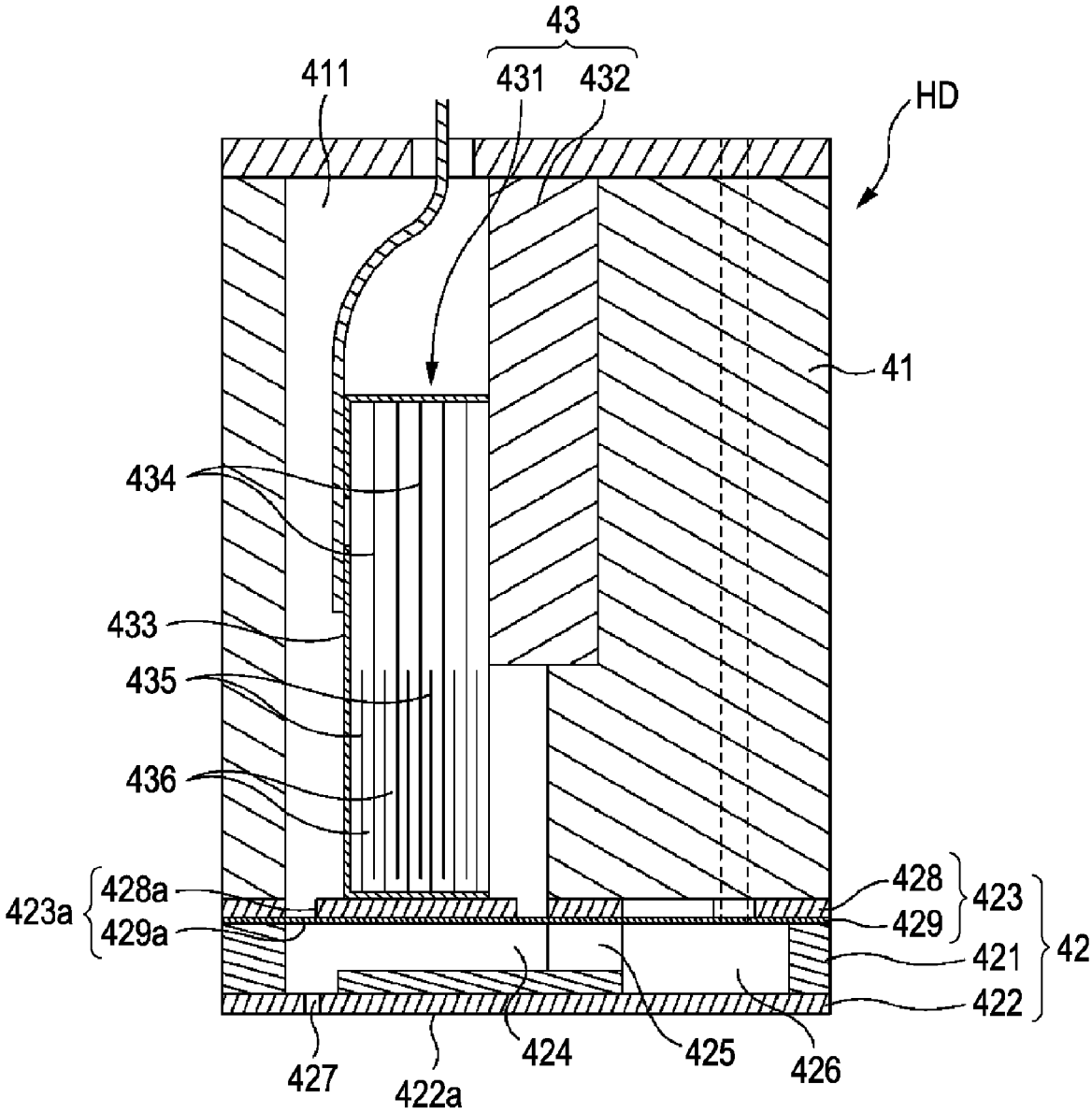
FIG. 2A is a cross-sectional view of a head.

As shown in FIG. 2A, the head HD includes a case 41, a channel unit 42, and a piezo-element unit 43. The case 41 is a member in which a storage space 411 for storing and fixing the piezo-element unit 43 is provided. The case 41 is formed of, for example, resin. In addition, the channel unit 42 is adhered to a front end surface of the case 41.

The channel unit 42 includes a channel forming substrate 421, a nozzle plate 422 and a vibration plate 423. In addition, the nozzle plate 422 is adhered to one surface of the channel forming substrate 421 and the vibration plate 423 is adhered to the other surface of the channel forming substrate. A groove which becomes a pressure chamber 424, a groove which becomes an ink supply path 425 and an opening which becomes a common ink chamber 426 are formed in the channel forming substrate 421. This channel forming substrate 421 is formed of, for example, a silicon substrate. The pressure chamber 424 is formed as a chamber which is elongated in a direction perpendicular to the arrangement direction of nozzles 427. The ink supply path 425 allows the pressure chamber 424 to communicate with the common ink chamber 426. This ink supply path 425 supplies an ink (a liquid) stored in the common ink chamber 426 to the pressure chamber 424. Accordingly, the ink supply path 425 is a supply unit for supplying the liquid to the pressure chamber 424. The common ink chamber 426 is a portion for temporarily storing the ink supplied from an ink cartridge (not shown) and corresponds to a common liquid storage chamber.

In the nozzle plate 422, the plurality of nozzles 427 is provided at a predetermined interval in the predetermined arrangement direction. The ink is ejected from the head HD via the nozzles 427. This nozzle plate 422 is formed of, for example, a stainless plate or a silicon substrate.

The vibration plate 423 has, for example, a double structure in which an elastic film 429 made of resin is laminated on a support plate 428 made of stainless. In the portion of the vibration plate 423 corresponding to the pressure chamber 424, the support plate 428 is etched in an annular shape. An island portion 428*a* is formed in the annular portion. The island portion 428*a* and the elastic film 429*a* located around the island portion configure a diaphragm portion 423*a*. This diaphragm portion 423*a* is deformed by the piezo-element 433 of the piezo-element unit 43 and varies the volume of the pressure chamber 424. That is, the diaphragm portion 423*a* partitions a portion of the pressure chamber 424 and corresponds to a partitioning portion for applying a pressure variation to the ink (liquid) in the pressure chamber 424 by the deformation.

The piezo-element unit 43 includes a piezo-element group 431 and a fixed plate 432. The piezo-element group 431 has a comb tooth-like shape. One comb tooth is the piezo-element 433. The front end surface of the piezo-element 433 is adhered to the island portion 428*a* corresponding thereto. The fixed plate 432 supports the piezo-element group 431 and becomes a mounting unit of the case 41. This fixed plate 432 is formed of, for example, a stainless plate and is adhered to the inner wall of the storage space 411.

The piezo-element 433 is an electromechanical conversion element and corresponds to an element which performs an operation (deformation operation) for applying a pressure variation to the liquid in the pressure chamber 424. The piezo-element 433 shown in FIG. 2A expands and contracts in an element's longitudinal direction perpendicular to a lamination direction by applying a potential difference between neighboring electrodes. That is, the electrodes include a common electrode 434 having a predetermined potential and a driving electrode 435 having a potential according to the driving signal COM (ejection pulses PS). In addition, a piezoelectric body 436 sandwiched between the electrodes 434 and 435 is deformed by the degree according to the potential difference between the common electrode 434 and the driving electrode 435. The piezo-element 433 expands and contracts in the element's longitudinal direction by the deformation of the piezoelectric body 436. In the present embodiment, the common electrode 434 has a ground potential or a bias potential higher than the ground potential by a predetermined potential. The piezo-element 433 contracts as the potential of the driving electrode 435 becomes higher than that of the common electrode 434. In contrast, the piezo-element expands as the potential of the driving electrode 435 becomes close to that of the common electrode 434 or becomes lower than that of the common electrode 434.

As described above, the piezo-element unit 43 is mounted in the case 41 via the fixed plate 432. If the piezo-element 433 contracts, the diaphragm portion 423*a* is pulled to be separated from the pressure chamber 424. Accordingly, the pressure chamber 424 expands. In contrast, if the piezo-element 433 expands, the diaphragm portion 423*a* is pulled to the side of the pressure chamber 424. Accordingly, the pressure chamber 424 contracts. The pressure variation occurs in the ink contained in the pressure chamber 424 due to the expansion or the contraction of the pressure chamber 424. That is, the ink contained in the pressure chamber 424 is pressurized by the contraction of the pressure chamber 424 and the ink contained in the pressure chamber 424 is depressurized by the expansion of the pressure chamber 424. Since the expansion and the contraction of the piezo-element 433 are determined by the potential of the driving electrode 435, the volume of the pressure chamber 424 is also determined by the potential of the driving electrode 435. Accordingly, the piezo-element 433 is an element for deforming the diaphragm portion 423*a* (partitioning portion) by the degree according to the potential variation pattern of the applied ejection pulses PS. In addition, the pressurized degree or the depressurized degree of the ink contained in the pressure chamber 424 may be determined by a potential variation of the driving electrode 435 per unit time.

Ink Channel

Figure 2B:
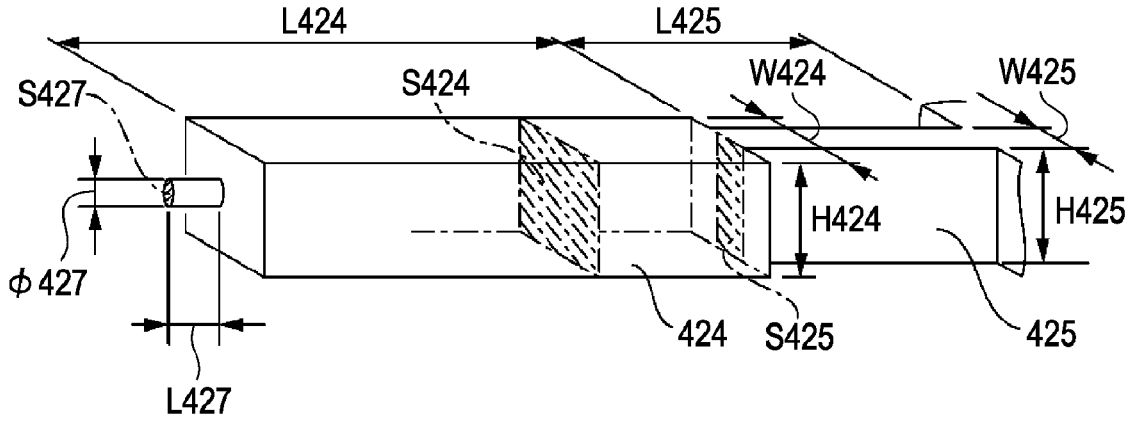
FIG. 2B is a schematic view explaining the structure of the head.

In the head HD, a plurality of ink channels (corresponding to a liquid channel in which the liquid is filled) which extends from the common ink chamber 426 to the nozzles 427 is formed according to the number of nozzles 427. In the ink channels, the nozzles 427 and the ink supply path 425 communicate with the pressure chamber 424. Accordingly, if the characteristic of the ink, such as the flow of the ink, is analyzed, the viewpoint of a Helmholtz resonator is applied. FIG. 2B is a schematic view explaining the structure of the head HD based on this viewpoint.

In the general head HD, the length L424 of the pressure chamber 424 is determined in a range from 200 μm to 2000 μm. The width W424 of the pressure chamber 424 is determined in a range from 20 μm to 300 μm, and the height H424 of the pressure chamber 424 is determined in a range from 30 μm to 500 μm. In addition, the length L425 of the ink supply path 425 is determined in a range from 50 μm to 2000 μm. The width W425 of the ink supply path 425 is determined in a range from 20 μm to 300 μm, and the height H425 of the ink supply path 425 is determined in a range from 30 μm to 500 μm. In addition, the diameter ϕ427 of the nozzles 427 is determined in a range from 10 μm to 40 μm and the length L427 of the nozzles 427 is determined in a range from 40 μm to 100 μm.

FIG. 2B is a schematic view explaining the ink channel. Accordingly, the ink channel has a shape different from an actual shape In such an ink channel, the ink is ejected from the nozzles 427 by applying the pressure variation to the ink contained in the pressure chamber 424. At this time, the pressure chamber 424, the ink supply path 425 and the nozzles 427 function like the Helmholtz resonator. Accordingly, if the pressure is applied to the ink contained in the pressure chamber 424, the level of this pressure varies in an inherent period called a Helmholtz period. That is, a pressure vibration occurs in the ink.

The Helmholtz period (inherent vibration period of the ink) Tc may be expressed by following Equation (1).

$$Tc=1/f$$

$$f=\tfrac{1}{2}\pi\sqrt{[(Mn+Ms)/(Mn\times Ms\times(Cc+ci))]} \quad (1)$$

In Equation (1), Mn denotes the inertance of the nozzles 427 (the mass of the ink per unit cross-sectional area, which will be described later), Ms denotes the inertance of the ink supply path 425, the Cc denotes the compliance (a volume variation per unit pressure and a degree of softness) of the pressure chamber 424, and Ci denotes the compliance of the ink (Ci=volume V/[density ρ×sound velocity $c_2$]).

The amplitude of the pressure vibration is gradually decreased as the ink flows in the ink channel. For example, the pressure vibration attenuates due to the loss of the nozzles 427 or the ink supply path 425 and the loss of the wall portion partitioning the pressure chamber 424.

In the general head HD, the Helmholtz period of the pressure chamber 424 is determined in a range from 5 μs to 10 μs. For example, in the ink channel of FIG. 2B, if the width W424 of the pressure chamber 424 is 100 μm, the height H424 thereof is 70 μm, and the length L424 thereof is 1000 μm, the width W425 of the ink supply path 425 is 50 μm, the height H425 thereof is 70 μm, and the length L425 thereof is 500 μm, and the diameter ϕ427 of the nozzles 427 is 30 μm and the length L427 thereof is 100 μm, the Helmholtz period of the pressure chamber 424 becomes about 8 μs. In addition, the Helmholtz period varies according to the thickness of the wall portion partitioning the neighboring pressure chambers 424, the thickness or the compliance of the elastic film 429, or the material of the channel forming substrate 421 or the nozzle plate 422.

Printer Controller 60

The printer controller 60 performs the whole control of the printer 1. For example, the printer controller controls control objects on the basis of the detected result of the detectors or the printing data received from the computer CP and prints the image on the sheet. As shown in FIG. 1, the printer controller 60 includes an interface 61, a CPU 62 and a memory 63. The interface 61 transmits or receives data to or from the computer CP. The CPU 62 performs the whole control of the printer 1. The memory 63 ensures an area for storing a computer program, a working area or the like. The CPU 62 controls the control objects according to the computer program stored in the memory 63. For example, the CPU 62 controls the sheet transportation mechanism 10 or the carriage movement mechanism 20. In addition, the CPU 62 transmits a head control signal for controlling the operation of the head HD to the head controller HC or transmits a control signal for generating the driving signal COM to the driving signal generation circuit 30.

The control signal for generating the driving signal COM is also called DAC data and is, for example, plural-bit digital data. This DAC data decides the variation pattern of the potential of the generated driving signal COM. Accordingly, this DAC data is called data representing the potential of the election pulses PS or the driving signal COM. This DAC data is stored in a predetermined area of the memory 63, is read at the time of the generation of the driving signal COM, and is output to the driving signal generation circuit 30.

Driving Signal Generation Circuit 30

Figure 3:
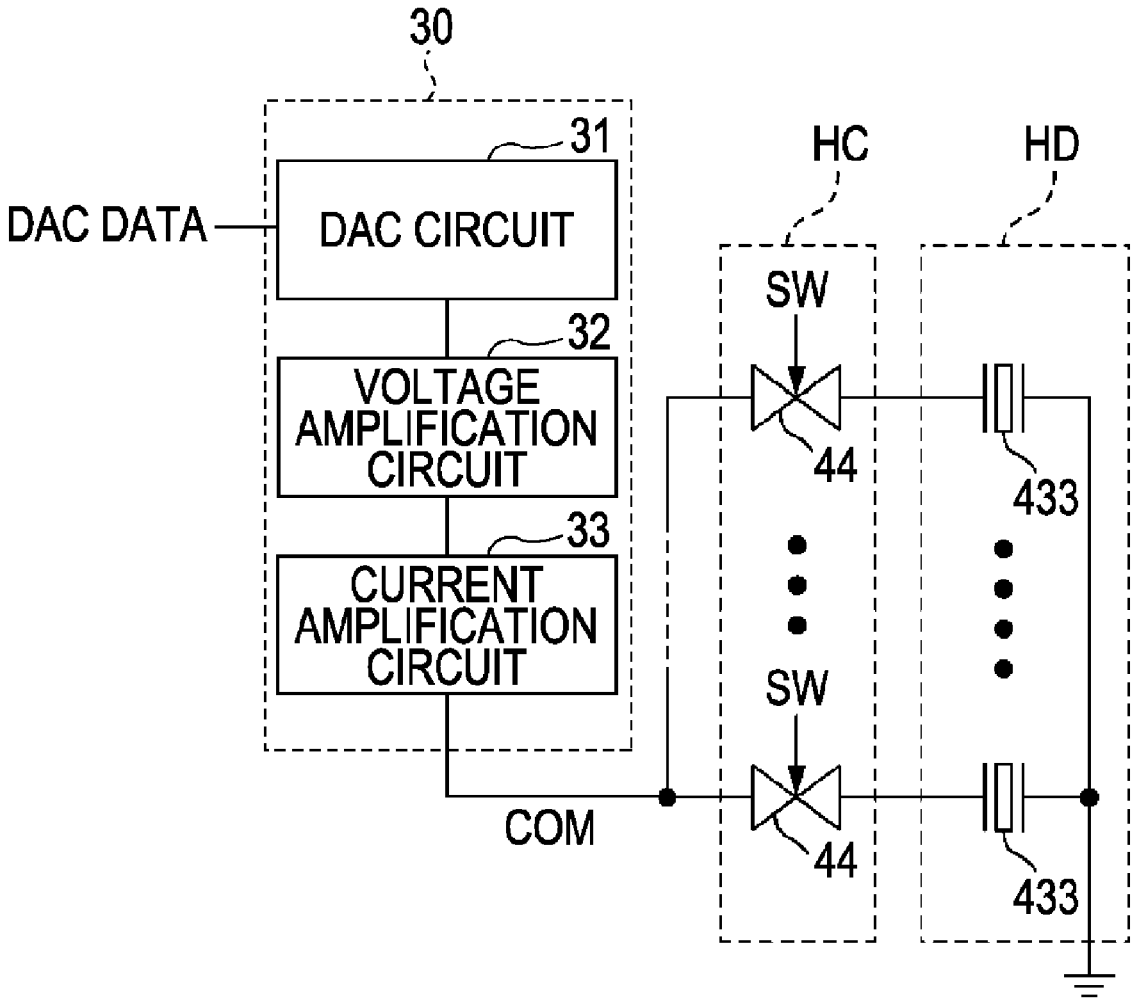

The driving signal generation circuit 30 functions as an ejection pulse generation unit and generates the driving signal COM having the ejection pulses PS on the basis of the DAC data. As shown in FIG. 3, the driving signal generation circuit 30 includes a DAC circuit 31, a voltage amplification circuit 32, and a current amplification circuit 33. The DAC circuit 31 converts digital DAC data into an analog signal. The voltage amplification circuit 32 amplifies the voltage of the analog signal converted by the DAC circuit 31 to a level for driving the piezo-element 433. In this printer 1, while the analog signal output from the DAC circuit 31 has 3.3 V at the maximum, the analog signal (for convenience, also called a waveform signal) after the amplification output from the voltage amplification circuit 32 is 42 V at the maximum. The current amplification circuit 33 amplifies the current with respect to the waveform signal from the voltage amplification circuit 32 and outputs the driving signal COM. This current amplification circuit 33 is, for example, composed of a pair of transistors push-pull connected to each other.

Head Controller HC

The head controller HC selects a necessary portion of the driving signal COM generated by the driving signal generation circuit 30 on the basis of the head control signal and applies the necessary portion to the piezo-element 433. Accordingly, as shown in FIG. 3, the head controller HC includes a plurality of switches 44 respectively provided in the piezo-elements 433 midway the supply line of the driving signal COM. In addition, the head controller HC generates a switch control signal from the head control signal. By controlling the switches 44 by the switch control signal, the necessary portion (for example, the ejection pulses PS) of the driving signal COM is applied to the piezo-element 433. At this time, the ejection of the ink from the nozzles 427 can be controlled by the selection method of the necessary portion.

Driving Signal COM

Figure 4:
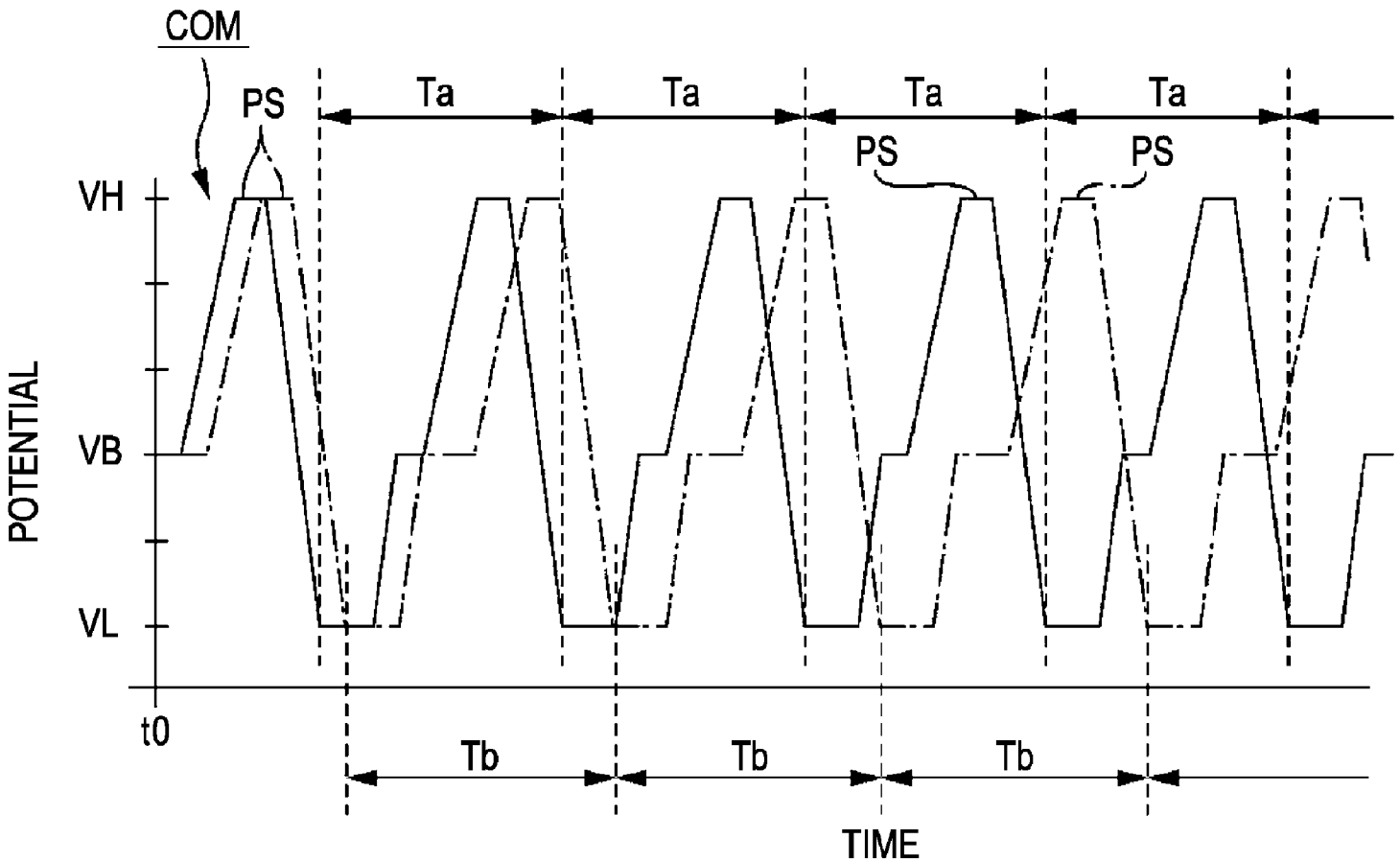
FIG. 4 is a view explaining an example of a driving signal.

Next, the driving signal COM generated by the driving signal generation circuit 30 will be described. As shown in FIG. 4, the plurality of ejection pulses PS which is repeatedly generated is included in the driving signal COM. Such ejection pulses PS have the same waveforms that is, have the same potential variation pattern. As described above, this driving signal COM is applied to the driving electrode 435 of the piezo-element 433. Accordingly, a potential difference according to the potential variation pattern occurs between the driving electrode and the common electrode 434 having a fixed potential. As a result, each of the piezo-element 433 expands and contracts according to the potential variation pattern and the volume of the pressure chamber 424 varies.

The potential of each ejection pulse PS shown rises from a medium potential VB as a reference potential to a highest potential VH and then falls to a lowest potential VL. Then, the potential of each ejection pulse rises to the medium potential VB. As described above, the piezo-element 433 contracts as the potential of the driving electrode 435 is higher than that of the common electrode 434, and the volume of the pressure chamber 424 is increased.

Accordingly, if the ejection pulses PS are applied to the piezo-element 433, the pressure chamber 424 expands from a reference volume corresponding to the medium potential VB to a maximum volume corresponding to a highest potential VH. Thereafter, the pressure chamber 424 contracts to a minimum volume corresponding to the lowest potential VL and expands to the reference volume. When the pressure chamber contracts from the maximum volume to the minimum volume, the ink contained in the pressure chamber 424 is pressurized and ink droplets are ejected from the nozzles 427. Accordingly, the portion of each ejection pulse PS which varies from the highest potential VH to the lowest potential VL corresponds to the ejection portion for ejecting the ink.

The ejection frequency of the ink droplet is determined by the interval between the ejection portions which are generated in tandem. For example, in the example of FIG. 4, the ink droplet is ejected in every period Ta in the driving signal COM denoted by a solid line and the ink droplet is ejected in every period Tb in the driving signal COM denoted by a dashed-dotted line. Accordingly, the ejection frequency according to the driving signal COM denoted by the solid line is higher than the ejection frequency according to the driving signal COM denoted by the dashed-dotted line.

Outline of Embodiments

Figure 5A:
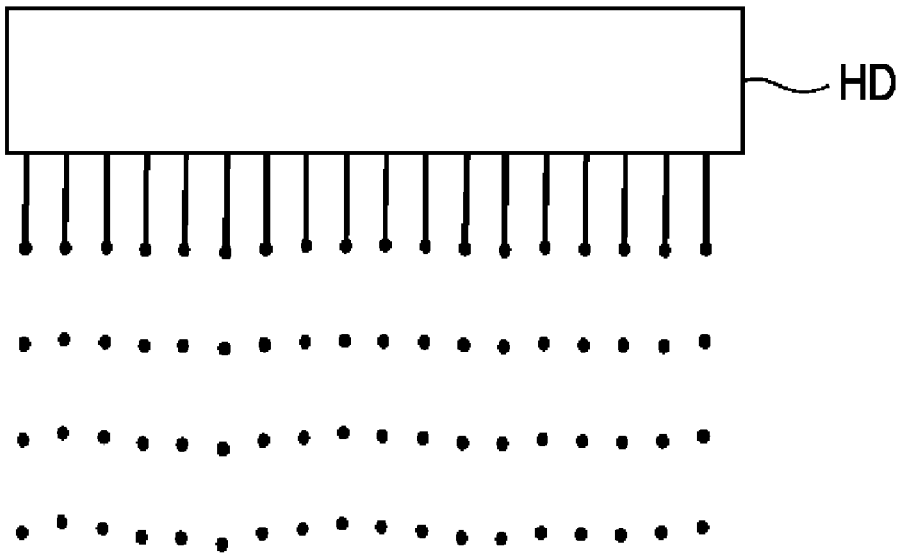
FIG. 5A is a view showing the case where an ink having high viscosity is ejected in a stable state.
Figure 5B:
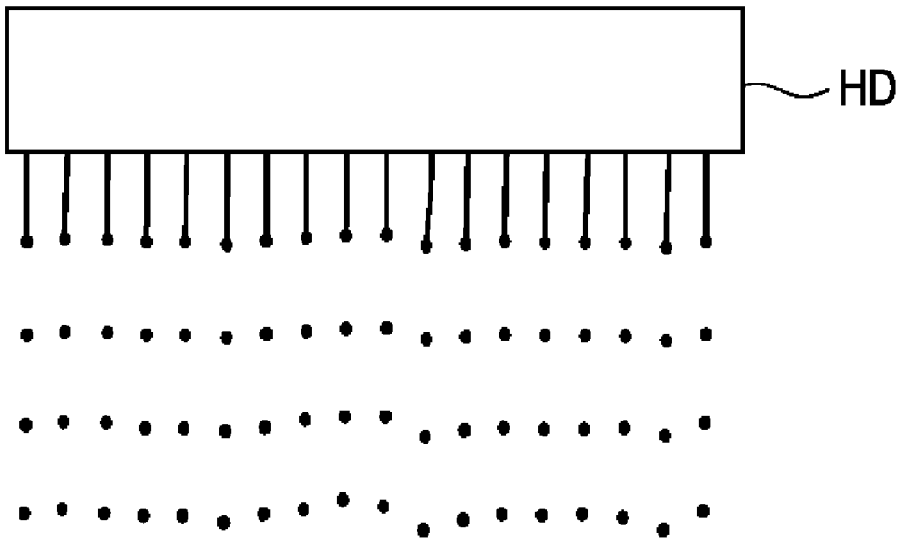
FIG. 5B is a view showing the case where the ink having high viscosity is ejected in an unstable state.

In this type of printer 1, there is a need for stabilizing the ejection of the ink. For example, when the ink droplet is ejected with a low frequency and when the ink droplet is ejected with a high frequency, there is a need for equalizing the amount of ink droplet, a flight direction or a flying speed. However, when an ink having viscosity which is sufficiently higher than the viscosity (about 1 mPa·s) of a general ink and, more particularly, an ink having viscosity of 6 to 20 mPa·s (for convenience, also called a high-viscosity ink) is ejected by the existing head HD, the ejection of the ink becomes unstable. FIG. 5A is a view showing the case where an ink having high viscosity is ejected in a stable state. FIG. 5B is a view showing the case where the ink having high viscosity is ejected in an unstable state. When these drawings are compared, an ink droplet having a low flying speed or an ink droplet in which ejection deflection occurs exists in the unstable state.

Various factors for making the ejection of the ink unstable may be considered, but, among them, deviations in structural balance between the pressure chamber 424 and the ink supply path 425 are considered as the factors. In a detailed example, a deviation in a ratio of the volume of the pressure chamber 424 and the volume of the ink supply path 425, a deviation in a ratio of the cross-sectional area of the pressure chamber 424 and the cross-sectional area of the ink supply path 425, and a deviation in a ratio of the channel length of the pressure chamber 424 and the channel length of the ink supply path 425 are considered as the factors. If the ratio of the volume and the ratio of the channel length are deviated, the movement of the ink in the ink supply path 425 is excessively increased or decreased. In addition, if the ratio of the cross-sectional area and the ratio of the channel length are deviated, the amount of ink flowing in the ink supply path 425 is excessively increased or decreased. Due to these factors, the ejection of the inks becomes unstable.

In consideration of this situation, in the head HD of the first embodiment, the volume of the ink supply path 425 is determined on the basis of the volume of the pressure chamber 424, and the channel length of the pressure chamber 424 is determined on the basis of the channel length of the ink supply path 425. That is, as shown in FIG. 2B, the volume V425 (W425×H425×L425) of the ink supply path 425 is determined in a range more than ⅕ of the volume V424 (W424×H424×L424) of the pressure chamber 424 and less than ½ of the volume V424 of the pressure chamber 424. In addition, the length L424 of the pressure chamber 424 is determined in a range equal to or more than the length L425 of the ink supply path 425 and equal to or less than twice of the length L425. In the head HD which satisfies this condition, the movement of the ink contained in the ink supply path 425 can be properly controlled on the basis of the pressure variation of the ink contained in the pressure chamber 424. As a result, the ejection of the ink having the high viscosity can be stabilized.

In the head HD of the second embodiment, the cross-sectional area of the ink supply path 425 is determined on the basis of the cross-sectional area of the pressure chamber 424 and the channel length of the pressure chamber 424 is determined on the basis of the channel length of the ink supply path 425. That is, as shown in FIG. 2B, the cross-sectional area S425 of the ink supply path 425 is determined in a range equal to or more than ⅓ of the cross-sectional area S424 of the pressure chamber 424 and equal to or less than the cross-sectional area S424 of the pressure chamber 424. In addition, the length L424 of the pressure chamber 424 is determined in a range equal to or more than the length L425 of the ink supply path 425 and equal to or less than twice of the length L425 of the ink supply path 425. In addition, the cross-sectional area S424 of the pressure chamber 424 or the cross-sectional area S425 of the ink supply path 425 is the area of a surface of the modeled ink channel perpendicular to the ink flow direction, as shown in FIG. 2B. In the head HD which satisfies this condition, the amount of ink flowing in the ink supply path 425 is properly adjusted. As a result, the ejection of the ink having the high viscosity can be stabilized.

First Embodiment

Ejection Pulse PS

Figure 6:
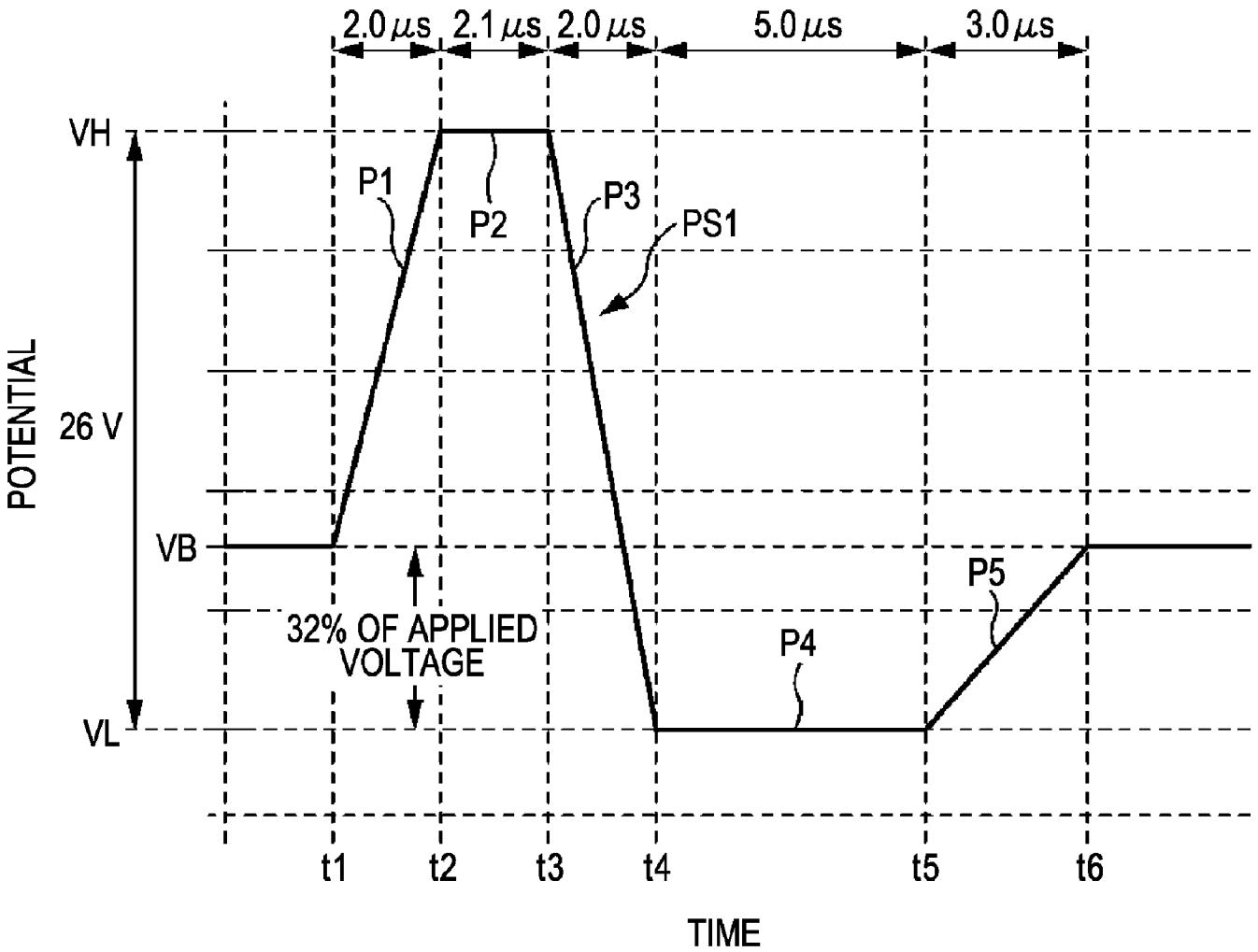
FIG. 6 is a view explaining an ejection pulse used in evaluation.

First, each of the ejection pulses PS used in evaluation will be described. FIG. 6 is a view explaining an ejection pulse PS1. In addition, in FIG. 6, a vertical axis denotes the potential of the driving signal COM (ejection pulse PS1) and a horizontal axis denotes a time.

The ejection pulse PS1 shown in FIG. 6 has a plurality of portions denoted by reference numerals P1 to P5. That is, the ejection pulse PS1 includes a first depressurization portion P1, a first potential holding portion P2, a pressurization portion P3, a second potential holding portion P4, and a second depressurization portion P5.

The first depressurization portion P1 is a portion generated from a timing t1 to a timing t2. In this first depressurization portion P1, the potential of the timing t1 (corresponds to a start potential) is the medium potential VB and the potential of the timing t2 (corresponding to an end potential) is the highest potential VH. Accordingly, if the first depressurization portion P1 is applied to the piezo-element 433, the pressure chamber 424 expands from the reference volume to the maximum volume in the generation period of the first depressurization portion P1.

The medium potential VB of the ejection pulse PS1 is set to a potential higher than the lowest potential VL of the ejection pulse PS1 by 32% of a difference (26 V) between the highest potential VH and the lowest potential VL. In addition, the generation period of the first depressurization portion P1 is 2.0 μs.

The first potential holding portion P2 is a portion generated from the timing t2 to a timing t3. This first potential holding portion P2 is held at the highest potential VH. Accordingly, if the first potential holding portion P2 is applied to the piezo-element 433, the pressure chamber 424 holds the maximum volume in the generation period of the first potential holding portion P2. In this ejection pulse PS1, the generation period of the first potential holding portion P2 is 2.1 μs.

The pressurization portion P3 is a portion generated from the timing t3 to a timing t4. In this pressurization portion P3, a start potential is the highest potential VH and an end potential is the lowest potential VL. Accordingly, if the pressurization portion P3 is applied to the piezo-element 433, the pressure chamber 424 contracts from the maximum volume to the minimum volume in the generation period of the pressurization portion P3. Since the ink is ejected by the contraction of this pressure chamber 424, the pressurization portion P3 corresponds to the ejection portion for ejecting the ink droplet. In this ejection pulse PS1, the generation period of the pressurization portion P3 is 2.0 μs.

The second potential holding portion P4 is a portion generated from the timing t4 to a timing t5. This second potential holding portion P4 is held at the lowest potential VL. Accordingly, if the second potential holding portion P4 is applied to the piezo-element 433, the pressure chamber 424 holds the minimum volume in the generation period of the second potential holding portion P4. In this ejection pulse PS1, the generation period of the second potential holding portion P4 is 5.0 μs.

The second depressurization portion P5 is a portion generated from a timing t5 to a timing t6. In this second depressurization portion P5, a start potential is the lowest potential VL and an end potential is the medium potential VB. At this time, if the second depressurization portion P5 is applied to the piezo-element 433, the pressure chamber 424 expands from the minimum volume to the reference volume in the generation period of the second depressurization portion P5. In this ejection pulse PS1, the generation period of the second depressurization portion P5 is 3.0 μs.

Ink having Viscosity of 15 mPa·s

Figure 7:
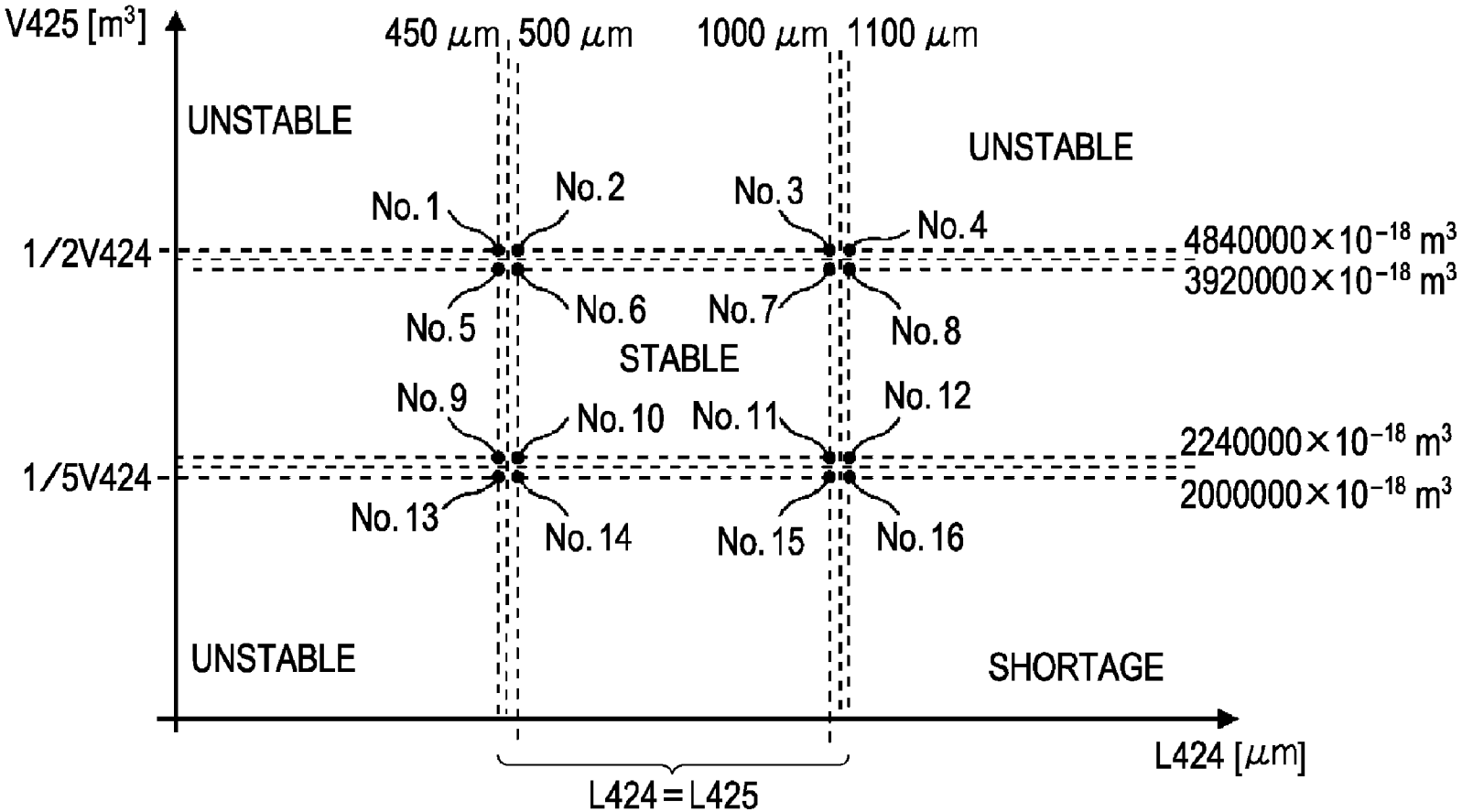
FIG. 7 is a view explaining a parameter in the structure of each head in which the length of a pressure chamber is equal to the length of an ink supply path, according to a first embodiment of the invention.

FIG. 7 is a view explaining a parameter in the structure of each head HD to be evaluated. In FIG. 7, a vertical axis denotes the value of the volume V425 of the ink supply path 425 and a horizontal axis denotes the length (channel length) L424 of the pressure chamber 424. In addition, points No. 1 to No. 16 denote the heads HD which are subjected to simulation for continuously ejecting the ink (a specific gravity is substantially 1) having viscosity 15 mPa·s. For example, the head HD of No. 1 has the volume V425 of the ink supply path 425 of $4840000\times10^{-18}$ $m^3$ and the length L424 of the pressure chamber 424 of 450 μm ($10^{-6}$ m). In addition, the head HD of No. 16 has the volume V425 of the ink supply path 425 of $2000000\times10^{-18}$ $m^3$ and the length L424 of the pressure chamber 424 of 1100 μm.

Other values used in the simulation are as follows. First, in the heads HD (heads HD of No. 1 to No. 16) to be evaluated, the height H424 of the pressure chamber 4254 is 80 μm and the volume V424 thereof is $9680000\times10^{-18}$ $m^3$. In addition, the depth H425 of the ink supply path 425 is 80 μm and the length L425 thereof is equal to the length L424 of the pressure chamber 424. The diameter ϕ427 of the nozzles 427 is 25 μm and the length L427 of the nozzles 427 is 80 μm.

Figure 82:
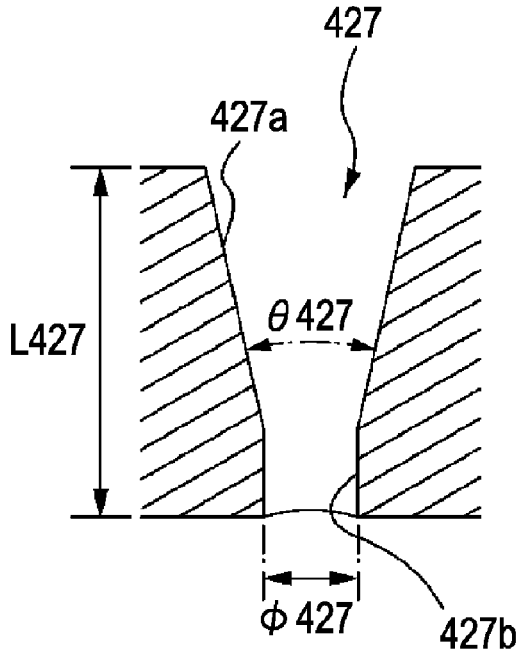
FIG. 82 is an enlarged view of a substantially funnel-shaped nozzle.
Figure 83:
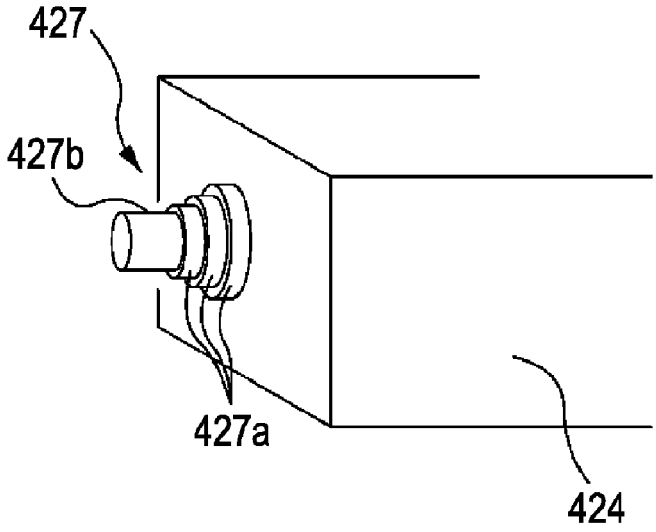
FIG. 83 is a view explaining an analysis model of the substantially funnel-shaped nozzle.

In addition, the simulation is performed on the basis of the nozzles 427 each of which has a substantially funnel shape, that is, has a tapered portion 427*a* and a straight portion 427*b* (see FIG. 82). The tapered portion 427*a* is a portion which partitions a truncated cone-shaped space and of which the opening area is reduced as separated from the pressure chamber 424, that is, is provided in a tapered shape. The straight portion 427*b* is continuously provided at the end of a small-diameter side of the tapered portion 427*a*. This straight portion 427*b* is a portion which partitions a columnar space and of which the cross-sectional area is substantially constant in a surface perpendicular to the nozzle direction. In addition, the diameter ϕ427 of the nozzles 427 indicates the diameter of the straight portion 427*b*. In this simulation, the length of the straight portion 427*b* is 20 μm and a tapered angle ϕ427 is 25 degrees. In addition, the length L427 of the nozzles 427 is obtained by adding the length of the tapered portion 427*a* and the length of the straight portion 427*b*. Accordingly, the length of the tapered portion 427*a* becomes 60 μm. As shown in FIG. 83, the volume V427 or the inertance of the substantially funnel-shaped nozzles 427 can be easily analyzed by the approximation at a plurality of disk-shaped spaces.

Among the heads HD to be evaluated, the heads of the present embodiment are the heads HD of No. 6, 7, 10 and 11. In addition, the other heads HD are the heads of comparative examples. Hereinafter, the simulation result of these heads HD will be described.

Head HD of No. 6

In the head HD of No. 6, the length L424 of the pressure chamber 424 is 500 μm and is equal to the length L425 of the ink supply path 425. In addition, the volume V425 of the ink supply path 425 is $3920000\times10^{-18}$ $m^3$ and is slightly less than a half ($4840000\times10^{-18}$ $m^3$) of the volume V424 of the pressure chamber 424.

Figure 8:
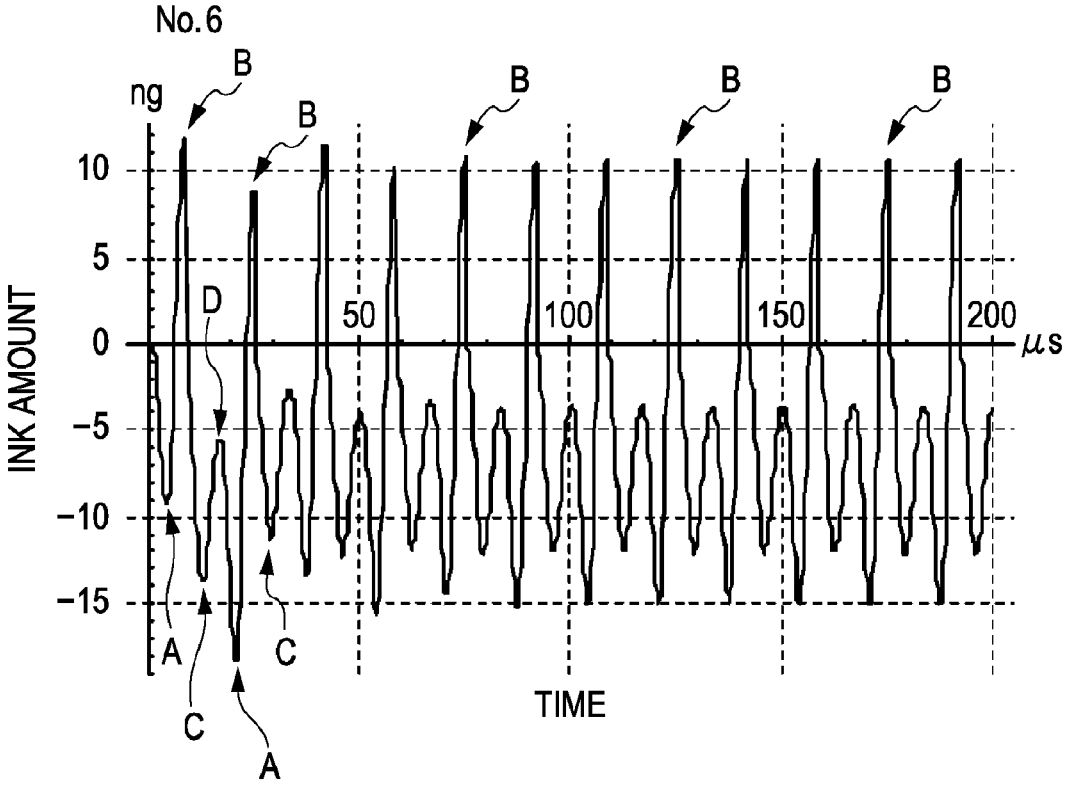
FIG. 8 is a view showing a simulation result at the time of 60-kHz ejection of a head of No. 6.

In the head HD having such an ink channel, if the ejection pulse PS1 of FIG. 6 is applied to the piezo-element 433, the ink droplets are ejected from the nozzles 427. FIG. 8 is a view showing a simulation result when the ink droplets are continuously ejected from the head HD of No. 6 with a frequency of 60 kHz. In FIG. 8, a vertical axis denotes a meniscus (free surface of the ink exposed from the nozzles 427) state by the amount of ink and a horizontal axis denotes a time. In the vertical axis, 0 ng denotes the location of the meniscus in a normal state. As the value is increased to a positive side, the meniscus is pulled in the ejection direction. In contrast, as the value is increased to a negative side, the meniscus is pulled to the side of the pressure chamber 424. The contents of the vertical axis or the horizontal axis are similarly applied to the vertical axes or the horizontal axes of the other drawings (for example, FIGS. 9 to 23). Accordingly, the description of the other drawings will be omitted.

When the first depressurization portion P1 of the ejection pulse PS1 is applied to the piezo-element 433, the pressure chamber 424 expands. By this expansion, a negative pressure is generated in the ink contained in the pressure chamber 424 and the ink flows into the pressure chamber 424 via the ink supply path 425. In addition, as the negative pressure is generated in the ink, the meniscus is introduced from each of the nozzles 427 to the pressure chamber 424.

The movement of the meniscus to the pressure chamber 424 is continued even after the first depressurization portion P1 is applied. That is, by the compliance or the like of the vibration plate 423 or the wall portion partitioning the pressure chamber 424, the meniscus moves to the pressure chamber 424 even while the first potential holding portion P2 is applied. Thereafter, the meniscus is inverted in a direction separated from the pressure chamber 424 (a timing denoted by a reference numeral A). At this time, since the pressure chamber 424 contracts by applying the pressurization portion P3, the movement speed of the meniscus is rapid. The meniscus which moves by applying the pressurization portion P3 has a columnar shape. Until the applying of the second potential holding portion P4 to the piezo-element 433 is completed, a portion of the front end of the meniscus having the columnar shape is cut and is ejected in a droplet shape (a timing denoted by a reference numeral B). In addition, in FIG. 8, the ink amount at the timing B denotes the amount of ink droplets ejected.

By the reaction to the ejection, the meniscus returns to the pressure chamber 424 at a high speed. At this time, the second depressurization portion P5 is applied to the piezo-element 433. By applying the second depressurization portion P5, the pressure chamber 424 expands. By this expansion, the negative pressure is generated in the ink contained in the pressure chamber 424. After the second depressurization portion P5 is applied, the movement direction of the meniscus is changed to the ejection side (a timing denoted by a reference numeral C). Thereafter, at a timing when the movement direction of the meniscus is changed, the applying of a next ejection pulse PS1 to the piezo-element 433 is started (a timing denoted by a reference numeral D). Thereafter, the above-described operation is repeatedly performed.

In addition, the ejection pulse PS1 is applied to the piezo-elements 433 even in the simulations shown in the other drawings (for example, FIGS. 9 to 23). Accordingly, the behavior of the meniscus at the timings A to D is performed as described above.

In the present embodiment, when the ink droplets are repeatedly ejected by the ejection pulse PS1 of FIG. 6 with the frequency of 60 kHz, 10 ng or more can be ensured as the ejection amount and a stable ejection amount is used as an evaluation reference of the head HD. When the ink droplets of 10 ng or more can be stably ejected, although the ink having the high viscosity is used, the image can be printed with the speed or image quality equal to or more than that of the existing printer for ejecting the ink. In the head HD of No. 6, the ink droplets after a fourth ink droplet are stably ejected by the amount of about 10.5 ng. Accordingly, the head HD of No. 6 satisfies the above-described evaluation reference. In other words, although the ink having the high viscosity is continuously ejected with a high frequency, the amount of one droplet is a predetermined amount or more, and the deviation in ejection amount is very small.

However, in the first to third ink droplets, the deviation in ejection amount slightly occurs. This is because the flow of the ink due to inertia is small and is not stabilized. The flow of the ink due to inertia denotes the flow of the ink from the common ink chamber 426 to the nozzles 427, which occurs by sequentially ejecting the ink droplets. The above-described evaluation reference is applied to the continuous ejection of the ink droplets. Accordingly, if the ejection amount or the ejection frequency is stabilized with respect to the ink droplets in the fourth ink droplet and later ink droplets, although the deviation in ejection amount slightly occurs in the first to third ink droplets, it is evaluated that the stable ejection is performed.

Head HD of No. 7

In the head HD of No. 7, the length L424 of the pressure chamber 424 and the length L425 of the ink supply path 425 are 1000 μm. In addition, the volume V425 of the ink supply path 4125 is $3920000\times10^{-18}$ $m^3$. This is similar to the head HD of No. 6 in that the volume V425 of the ink supply path 425 is slightly less than a half of the volume V424 of the pressure chamber 424. In contrast, this is different from the head HD of No. 6 in that the length L424 of the pressure chamber 424 and the length L425 of the ink supply path 425 are 1000 μm, and are twice of the length of the same portion of the head HD of No. 6.

Figure 9:
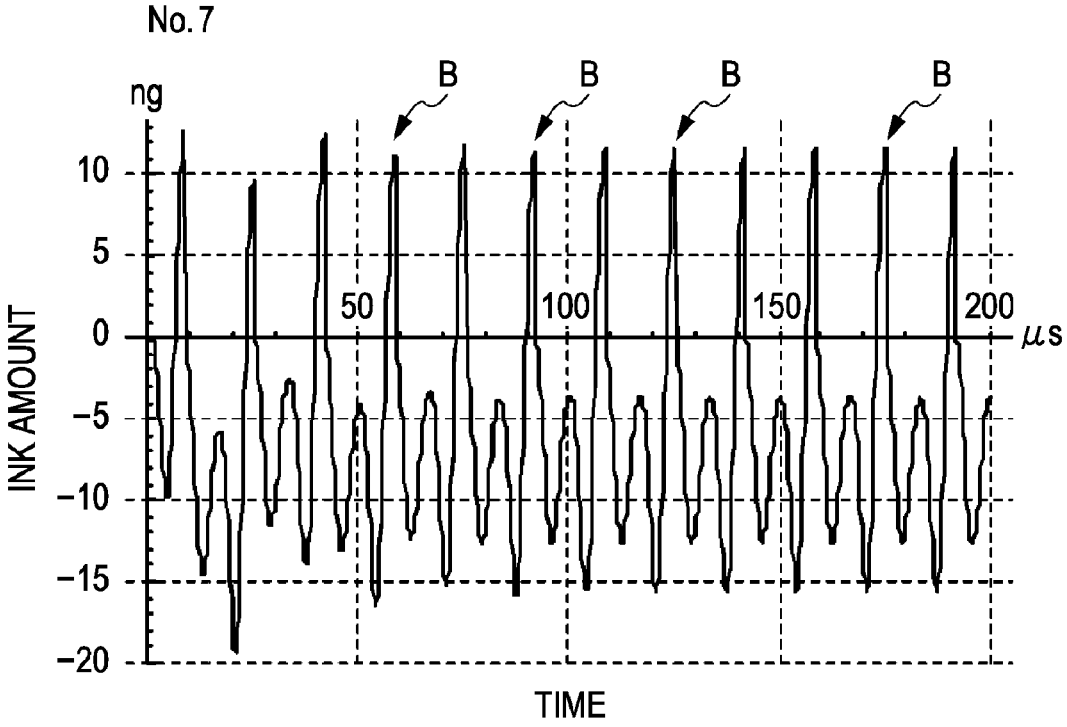
FIG. 9 is a view showing a simulation result at the time of 60-kHz ejection of a head of No. 7.

FIG. 9 is a view showing a simulation result at the time of continuous ejection of the ink droplets by the head HD of No. 7. In the head HD of No. 7, the ink droplets in the fourth ink droplet and later ink droplets are stably ejected by the amount slightly exceeding 11.0 ng. Accordingly, it may be considered that the head HD of No. 7 satisfies the above-described evaluation reference.

Head HD of No. 10

In the head HD of No. 10, the length L424 of the pressure chamber 424 and the length L425 of the ink supply path 425 are 500 μm. In addition, the volume V425 of the ink supply path 425 is $2240000\times10^{-18}$ $m^3$. This is similar to the head HD of No. 6 in that the length L424 of the pressure chamber 424 and the length L425 of the ink supply path 425 are 500 μm. In contrast, this is different from the head HD of No. 6 in that the volume V425 of the ink supply path 425 is $2240000\times10^{-18}$ $m^3$, and is slightly more than ⅕ (about $2000000\times10^{-18}$ $m^3$) of the volume V424 of the pressure chamber 424.

Figure 10:
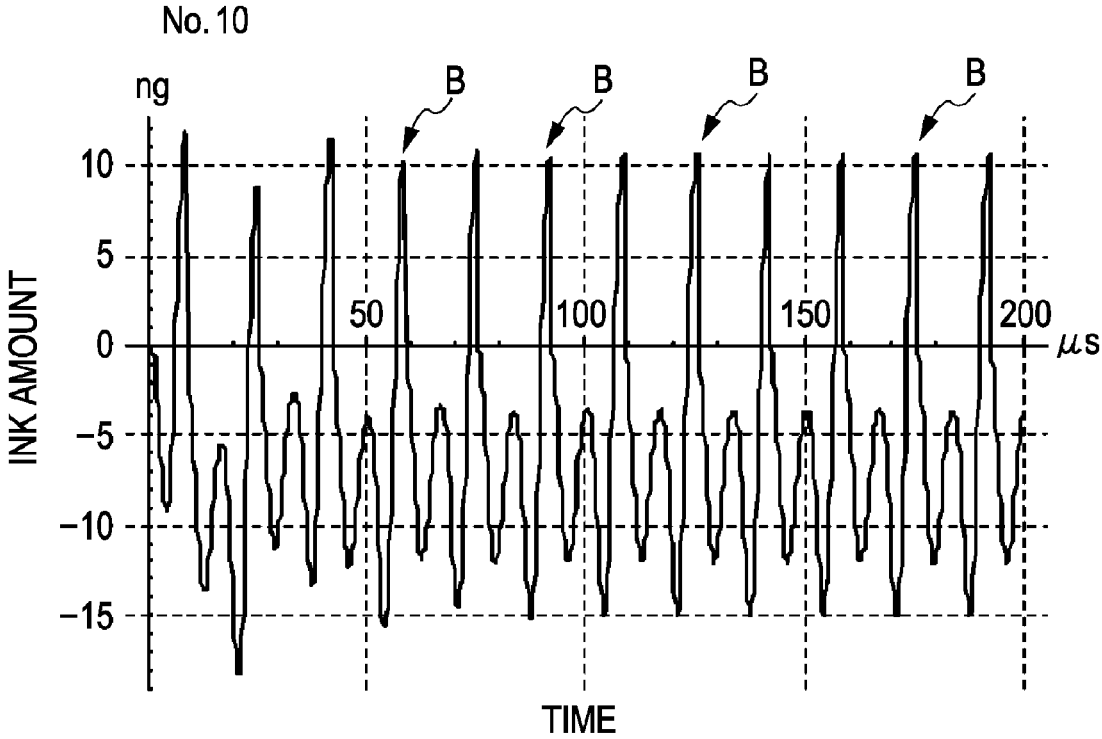
FIG. 10 is a view showing a simulation result at the time of 60-kHz ejection of a head of No. 10.

FIG. 10 is a view showing a simulation result at the time of continuous ejection of the ink droplets by the head HD of No. 10. In the head HD of No. 10, the ink droplets in the fourth ink droplet and later ink droplets are stably ejected by the amount of about 10.5 ng. Accordingly, it may be considered that the head HD of No. 10 satisfies the above-described evaluation reference.

Head HD of No. 11

In the head HD of No. 11, the length L424 of the pressure chamber 424 and the length L425 of the ink supply path 425 are 1000 μm. In addition, the volume V425 of the ink supply path 425 is $2240000\times10^{-18}$ $m^3$. This is different from the head HD of No. 6 in that the length L424 of the pressure chamber 424 and the length L425 of the ink supply path 425 are twice of the length of the same portion of the head HD of No. 6. In addition, this is different from the head HD of No. 6 in that the volume V425 of the ink supply path 425 is slightly more than ⅕ of the volume V424 of the pressure chamber 424.

Figure 11:
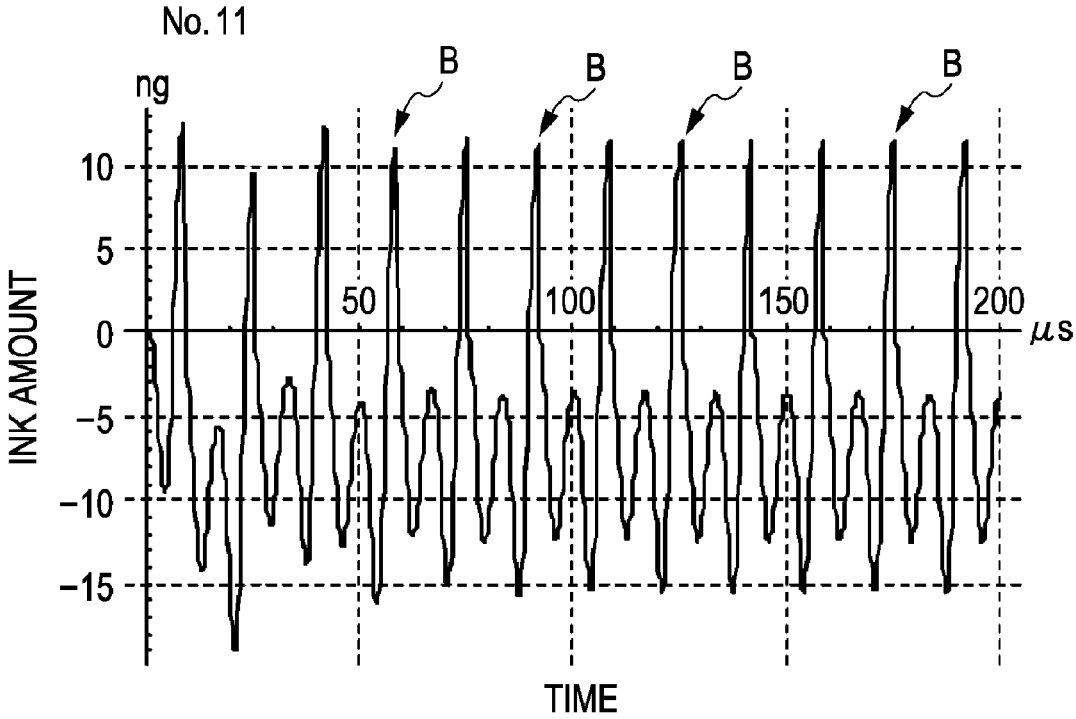
FIG. 11 is a view showing a simulation result at the time of 60-kHz ejection of a head of No. 11.

FIG. 11 is a view showing a simulation result at the time of continuous ejection of the ink droplets by the head HD of No. 11. In the head HD of No. 11, the ink droplets in the fourth ink droplet and later ink droplets are stably ejected by the amount of about 11.5 ng. Accordingly, it may be considered that the head HD of No. 11 satisfies the above-described evaluation reference.

Conclusion

As described above, it can be seen that the heads HD of No. 6, 7, 10 and 11 satisfy the above-described evaluation reference. That is, in the head HD in which the length L424 of the pressure chamber 424 is equal to the length L425 of the ink supply path 425 it can be seen that the evaluation reference is satisfied when the volume V425 of the ink supply path 425 is set in a range more than ⅕ of the volume V424 of the pressure chamber 424 and less than ½ of the volume V424 of the pressure chamber 424. In more detail, when the length L424 of the pressure chamber 424 and the length L425 of the ink supply path 425 are in a range from 500 μm to 1000 μm and the volume V425 of the ink supply path 425 is set in a range from $2240000\times10^{-18}$ $m^3$ to $3920000\times10^{-18}$ $m^3$, it can be seen that the amount of 10 ng or more can be ensured although the ink having the viscosity of 15 mPa·s is ejected with the frequency of 60 kHz.

In these heads HD, the length L425 and the volume V425 of the ink supply path 425 are determined from the relationship with the shape of the pressure chamber 424. The cross-sectional size (cross-sectional area S425) of the ink supply path 425 is determined on the basis of the length L425 and the volume V425. The improvement of the movement of the ink contained in the ink supply path 425 when the pressure variation is given from the pressure chamber 424 is determined by the specific gravity of the ink, the volume V425 of the ink supply path 425 and the cross-sectional area S425 of the ink supply path 425. In brief, it is difficult to move the ink as the mass of the ink contained in the ink supply path 425 increases and it is easy to move the ink as the cross-sectional area S425 of the ink supply path 425 increases.

In the above-described heads HD, the ink in the ink supply path 425 or the ink in the nozzles 427 moves by the pressure variation which can be applied to the ink contained in the pressure chamber 424. There is a limitation in the pressure variation which can be applied to the ink contained in the pressure chamber 424. By setting the relationship between the length L425 and the volume V425 of the ink supply path 425 and the length L424 of the pressure chamber 424 and the volume V424 of the pressure chamber 424 like the above-described heads HD, the movement of the ink contained in the ink supply path 425 can be optimized on the basis of the pressure variation which can be applied to the ink contained in the pressure chamber 424. Accordingly, for example, it is possible to suppress shortage of the supply of the ink to the pressure chamber 424 and to supply a sufficient amount of ink. In addition, at the time of the pressurization of the ink contained in the pressure chamber 424, it is possible to suppress the excessive movement of the ink contained in the ink supply path 425 to the common ink chamber 426. As a result, the ejection can be stabilized at the time of the continuous ejection of the ink droplets.

Relationship with Nozzles 427

In the above-described heads HD, the shape of the nozzles 427 may have an influence on the ejection of the ink droplets. Hereinafter, the relationship with the nozzles 427 will be described.

In the heads HD, the cross-sectional area is determined on the basis of the volume V425 and the length L425 of the ink supply path 425. Accordingly, the channel resistance of the ink supply path 425 is determined. The channel resistance is internal loss of a medium. In the present embodiment, the channel resistance is force which is applied to the ink flowing in the ink channel and is reverse force against the ink flowing direction. In this channel resistance, it is preferable that the channel resistance of the nozzles 427 is higher than that of the ink supply path 425. This is because it is difficult to cause the shortage of the supply of the ink to the pressure chamber 424 by setting the channel resistance of the nozzles 427 to be higher than that of the ink supply path 425. That is, in the flow of the ink from the common ink chamber 426 to the nozzles 427, the ink more easily flows in the ink supply path 425 than in the nozzles 427.

The channel resistance $R_{circular}$ of the channel having a circular cross section may be expressed by Equation (2) and the channel resistance $R_{rectangular}$ of the channel having a rectangular cross section may be expressed by Equation (3). Accordingly, by setting the dimension on the basis of such equations, the channel resistance of the nozzles 427 can be higher than that of the ink supply path 425.

$$\text{Channel resistance } R_{circular} = (8 \times \text{viscosity } \mu \times \text{length } L)/(\pi \text{radius } r^4) \quad (2)$$

$$\text{Channel resistance } R_{rectangular} = (12 \times \text{viscosity } \mu \times \text{length } L)/(\text{width } W \times \text{height } H^3) \quad (3)$$

In such Equations (2) and (3), the viscosity μ denotes the viscosity of the ink, L denotes the length of the channel, W denotes the width of the channel, H denotes the height of the channel, and r denote the radius of the channel having the circular cross section.

As described above, the nozzles 427 have substantially the funnel shape. In this case, in order to apply Equation (2), for example, as shown in FIG. 83, the tapered portion 427*a* is preferably modeled. That is, it is preferable that the tapered portion 427*a* is approximately defined by the plurality of disk-shaped portions of which the radii are stepwise decreased from the pressure chamber 424 to the straight portion 427*b*.

When the ink having the high viscosity is elected by the heads HD, it is preferable that the ink contained in the nozzles 427 is allowed to more easily move than the ink contained in the ink supply path 425 on the basis of the pressure variation of the ink contained in the pressure chamber 424. In other words, it is preferable that the inertance of the nozzles 427 is smaller than that of the ink supply path 425. In addition, the inertance is a value indicating the easiness of the movement of the ink in the channel. This is because the pressure variation applied to the ink contained in the pressure chamber 424 can be efficiently used for the ejection of the ink droplets.

When the density of the ink is ρ, the cross-sectional area of the channel is S, and the length of the channel is L, the inertance M may be approximately expressed by Equation (4). Accordingly, by setting the dimension on the basis of Equation (4), the inertance of the nozzles 427 may be set to be smaller than that of the ink supply path 425.

$$\text{Inertance } M = (\text{density } \rho \times \text{length } L)/\text{cross-sectional area } S \quad (4)$$

From Equation (4), the inertance may be considered as the mass of the ink per unit cross-sectional area. In addition, it is difficult to move the ink according to the ink pressure of the pressure chamber 424 as the inertance is increased and it is easy to move the ink according to the pressure of the pressure chamber 424 as the inertance is decreased.

As shown in FIG. 2B, the length L or the cross-sectional area S of the channel indicates the length or the cross-sectional area of each portion of the modeled ink channel The length L is the length of the ink flowing direction. In addition, the cross-sectional area S is the area of the surface which is substantially perpendicular to the ink flowing direction. For example, with respect to the pressure chamber 424, as denoted by a reference numeral S424, the area of the surface perpendicular to the longitudinal direction of the pressure chamber 424 becomes the cross-sectional area. The same is true in the ink supply path 425 or the nozzles 427. That is, as denoted by the reference numeral S425 or the reference numeral S427, the area of the surface perpendicular to the longitudinal direction of the ink supply path 4125 or the nozzles 427 becomes the cross-sectional area. The tapered portion 427*a* of the nozzles 427 can be, as shown in FIG. 83, approximated by increasing the cross-sectional area S427 stepwise according to the size of the disk-shaped portion.

COMPARATIVE EXAMPLES

Next, the heads of comparative examples will be described. The heads of the comparative examples are heads HD of No. 1 to 5, No. 8 to 9, No. 12 to 16 of FIG. 7. Among these heads HD, in the heads HD of No. 1 to No. 4, the volume V425 of the ink supply path 425 is set to ½ of the volume V424 of the pressure chamber 424 and, more particularly, to $4840000 \times 10^{-18}$ $m^3$. In the heads HD of No. 13 to No. 16, the volume V425 of the ink supply path 425 is substantially set to ⅕ of the volume V424 of the pressure chamber 424 and, more particularly, to $2000000 \times 10^{-18}$ $m^3$. In the heads HD of No. 1, 5, 9 and 13, the length L424 of the pressure chamber 424 is set to be shorter than 500 μm which is a specified length of a lower limit and, more particularly, to 450 μm. In the heads HD of No. 4, 8, 12 and 16, the length L424 of the pressure chamber 424 is set to be longer than 1000 μm which is a specified length of an upper limit and, more particularly, to 1100 μm.

Figure 12:
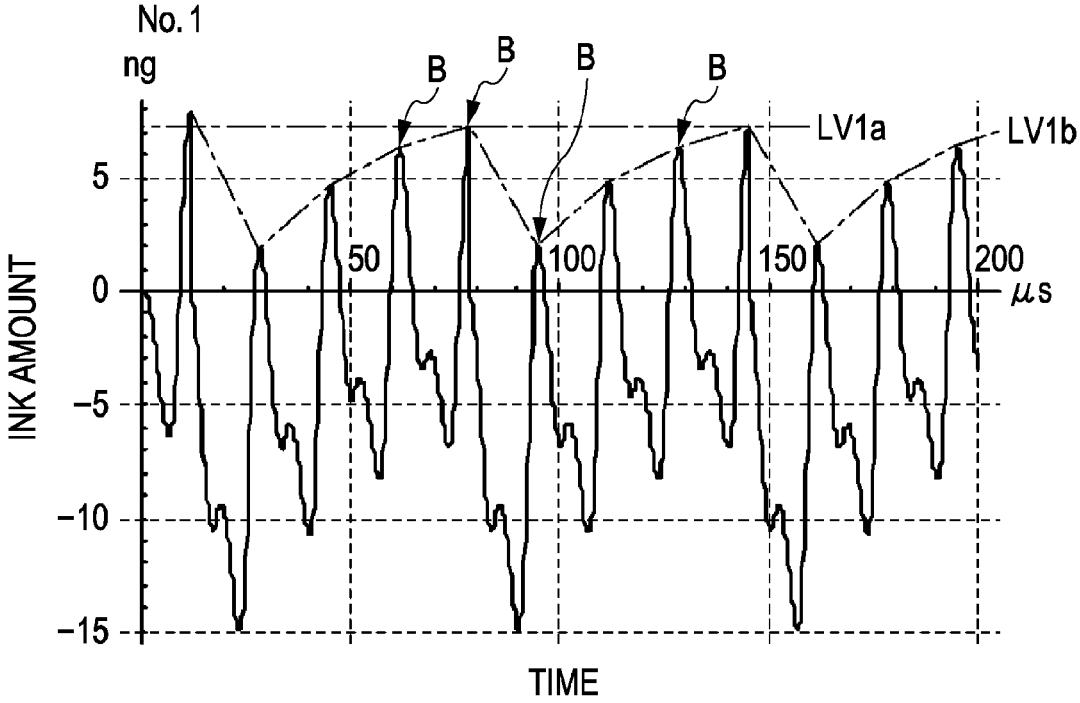
FIG. 12 is a view showing a simulation result at the time of 60-kHz ejection of a head of No. 1.
Figure 13:
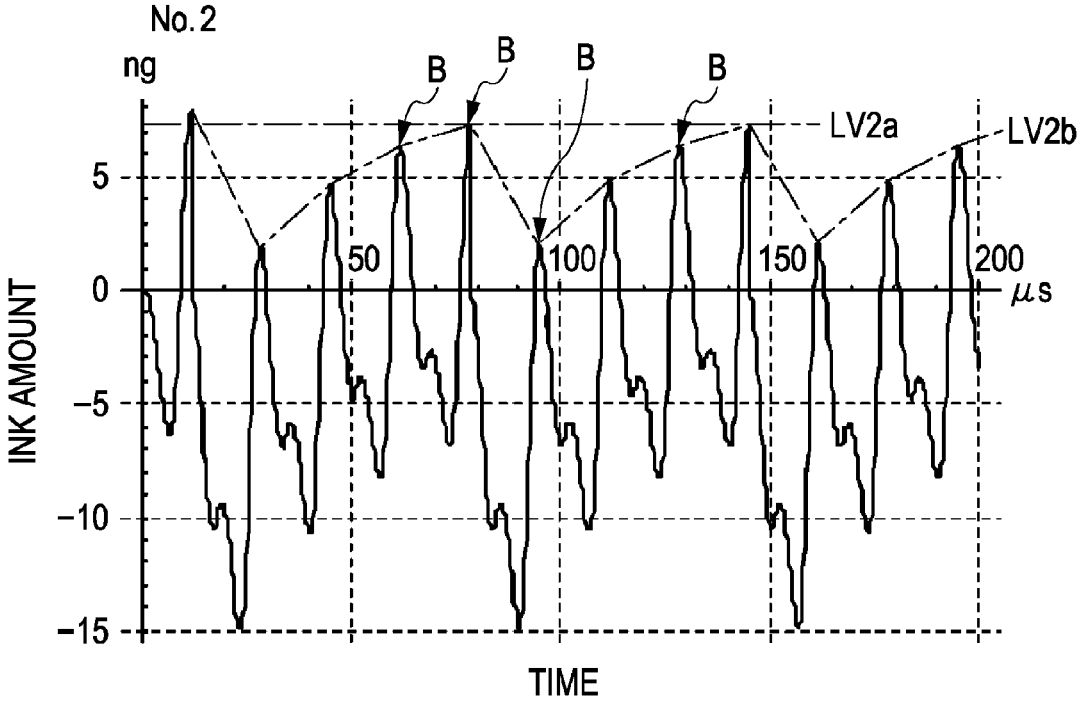
FIG. 13 is a view showing a simulation result at the time of 60-kHz ejection of a head of No. 2.
Figure 14:
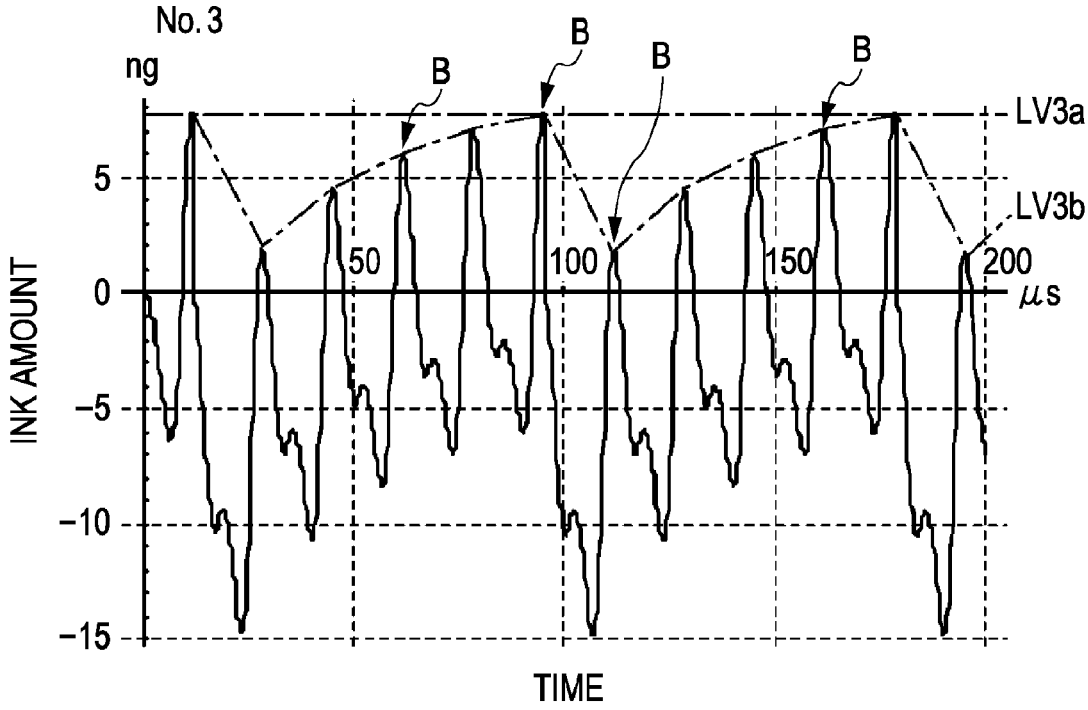
FIG. 14 is a view showing a simulation result at the time of 60-kHz ejection of a head of No. 3.
Figure 23:
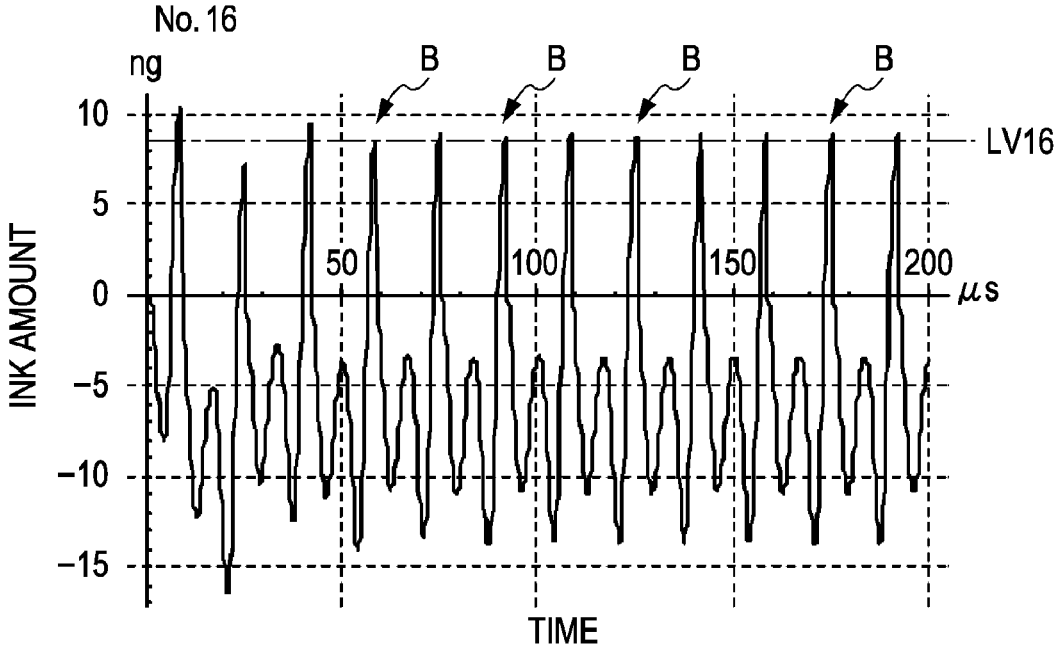
FIG. 23 is a view showing a simulation result at the time of 60-kHz ejection of a head of No. 16.

FIGS. 12 to 23 show the simulation results of the heads HD of the comparative examples. For example, FIG. 12 shows the simulation result of the head HD of No. 1 and FIG. 13 shows the simulation result of the head HD of No. 2 in addition, FIG. 23 shows the simulation result of the head HD of No. 16.

Heads HD of V425=½×V424

Figure 15:
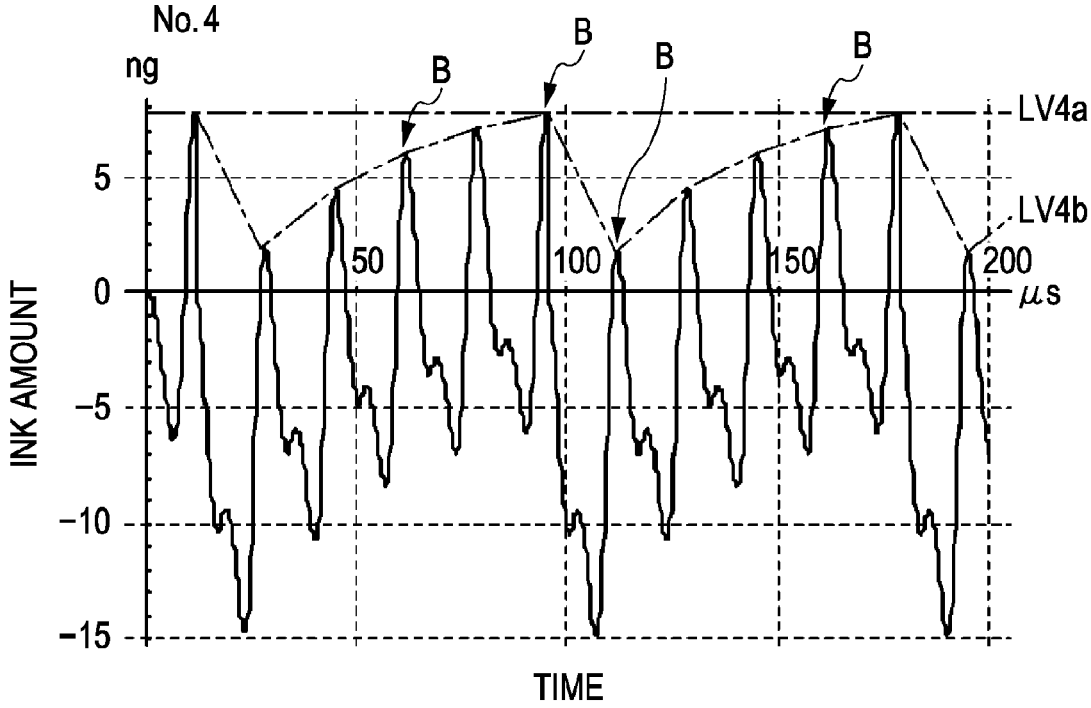
FIG. 15 is a view showing a simulation result at the time of 60-kHz ejection of a head of No. 4.

As shown in FIG. 12 (the head HD of No. 1) to FIG. 15 (the head HD of No. 4), in these heads HD, the amount of ink droplets is smaller than a reference value (10 ng). For example, if a maximum ejection amount is compared with respect to the ink droplets in the fourth ink droplet and later ink droplets, the ejection amount of the heads HD of No. 1 and No. 2 is about 7.2 ng (LV1*a*, LV2*a*). In addition, the ejection amount of the heads HD of No. 3 and No. 4 is about 7.8 ng (LV3*a* and LV4*a*). In the heads HD, the ejection amount is unstable. That is, the periodical variation of the ejection amount occurs. For example, in the heads HD of No. 1 and 2, as denoted bv lines of the reference numerals LV1*b* and LV2*b*, four types of ink droplets are repeatedly ejected from a minimum amount of ink droplets (about 2 ng) to a maximum amount of ink droplets (about 7.2 ng). Similarly, in the heads HD of No. 3 and 4, as denoted by lines of the reference numerals LV3*b* and LV4*b*, five types of ink droplets are repeatedly ejected from a minimum amount of ink droplets to a maximum amount of ink droplets Heads HD of V425≅⅕×V424

Figure 20:
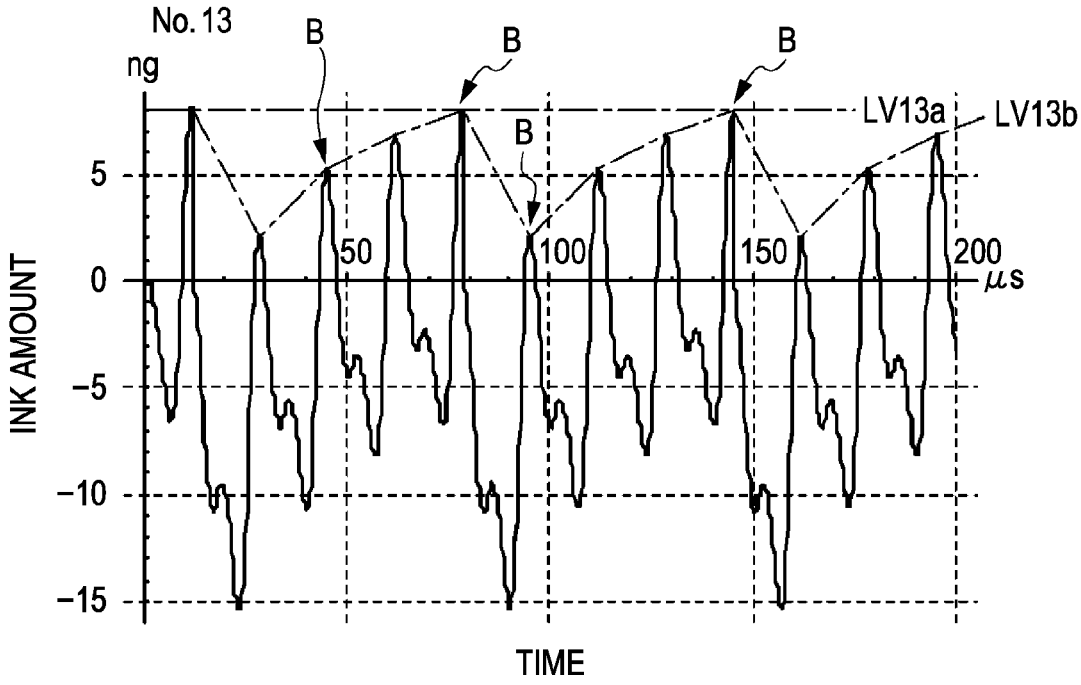
FIG. 20 is a view showing a simulation result at the time of 60-kHz ejection of a head of No. 13.
Figure 21:
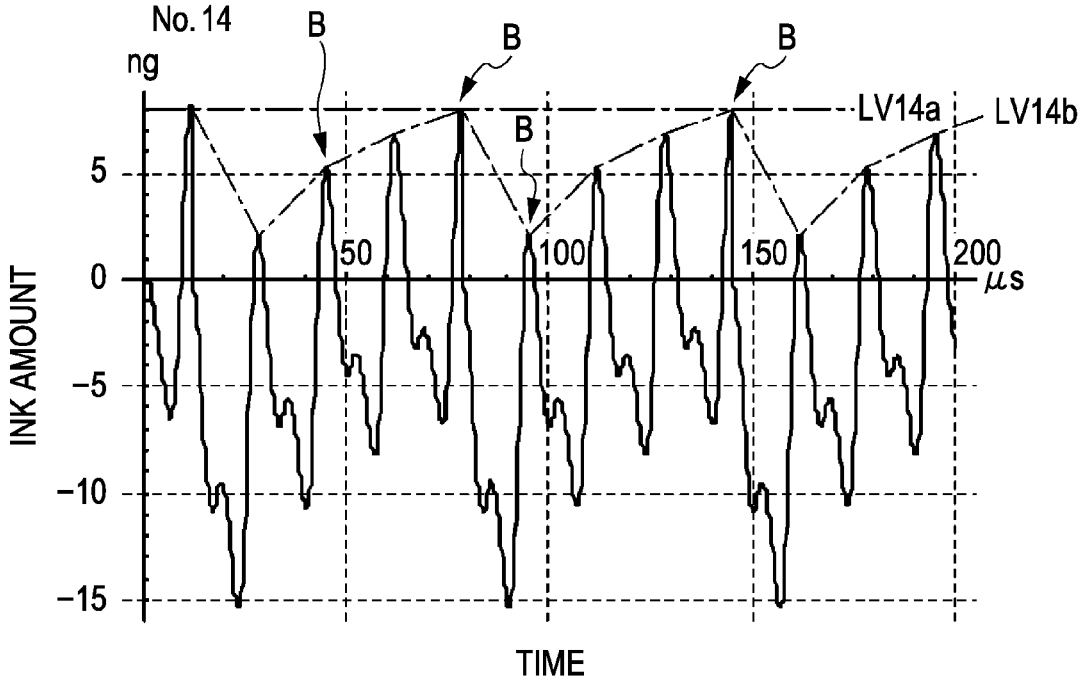
FIG. 21 is a view showing a simulation result at the time of 60-kHz ejection of a head of No. 14.
Figure 22:
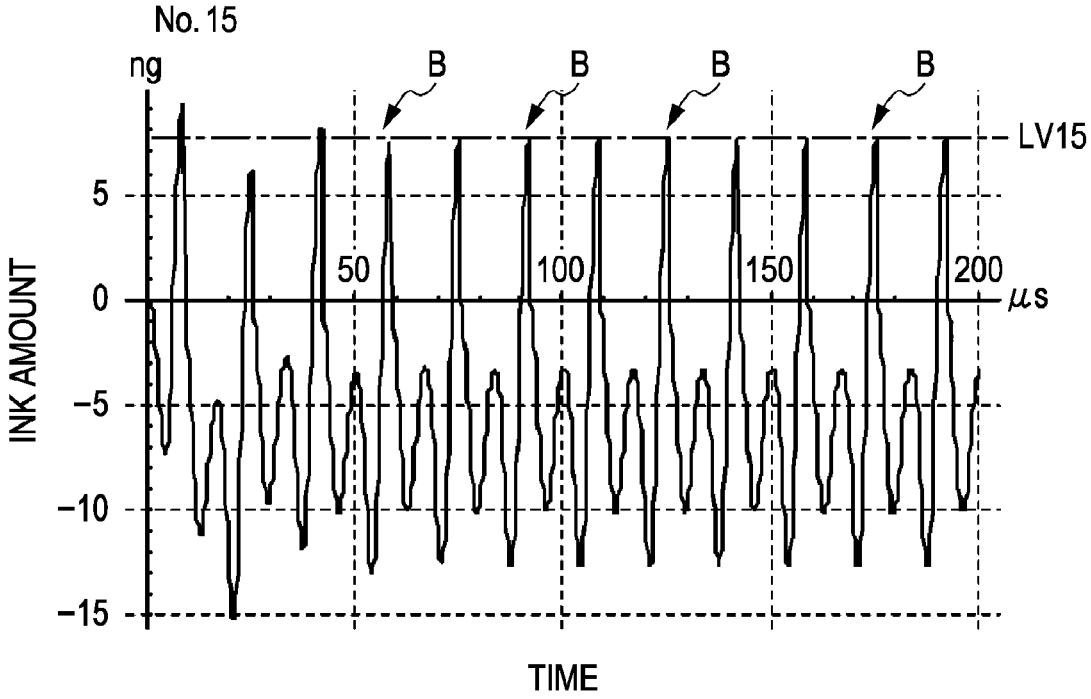
FIG. 22 is a view showing a simulation result at the time of 60-kHz ejection of a head of No. 15.

As shown in FIG. 20 (the head HD of No. 13) to FIG. 23 (the head HD of No. 16), in these heads HD, the amount of ink droplets is smaller than the reference value. For example, if the maximum ejection amount is compared with respect to the ink droplets in the fourth ink droplet and later ink droplets, the ejection amount of the heads HD of No. 13 and No. 14 is about 8 ng (LV13*a* and LV14*a*) in addition, in the head HD of No. 15, the ejection amount is uniform at the ink droplets in the fourth ink droplet and later ink droplets, but the maximum ejection amount is about 7.5 ng (LV15). Similarly, the ejection amount of the head HD of No. 16 is about 8.8 ng (LV16). In the head HD of No. 13 and the head HD of No. 14, the ejection amount is unstable. In these heads HD, as denoted by lines of the reference numerals LV13*b* and LV14*b*, four types of ink droplets are repeatedly ejected from a minimum amount of ink droplets (about 2 ng) to a maximum amount of ink droplets (about 8 ng).

Heads HD of L424=450 μm

Figure 16:
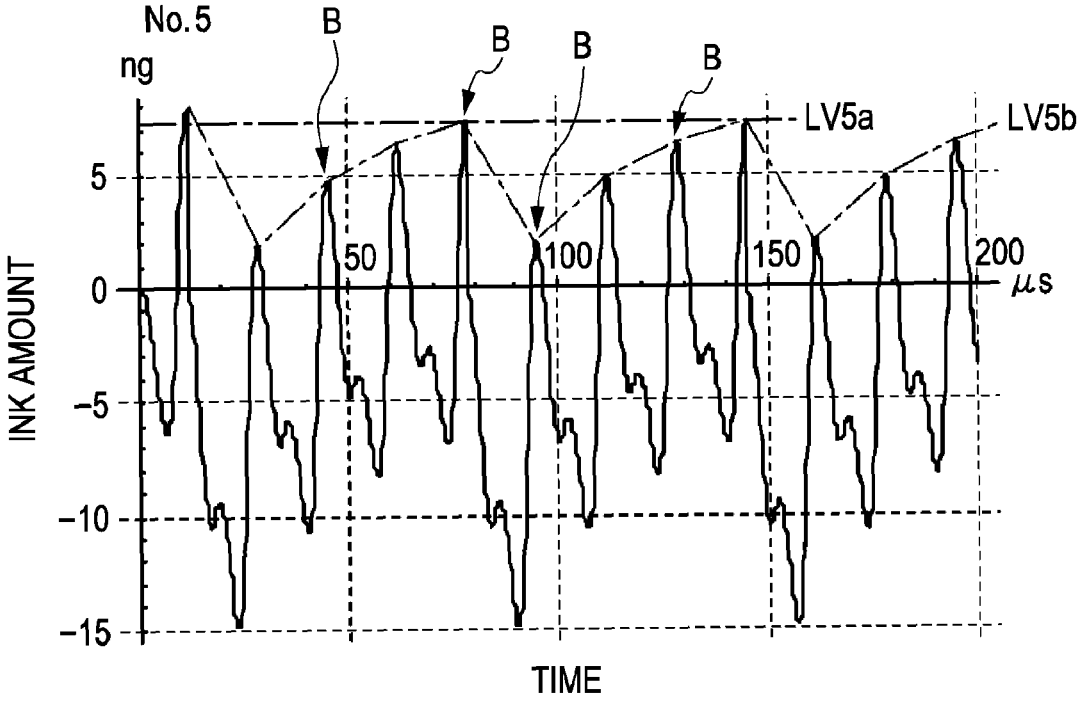
FIG. 16 is a view showing a simulation result at the time of 60-kHz ejection of a head of No. 5.
Figure 18:
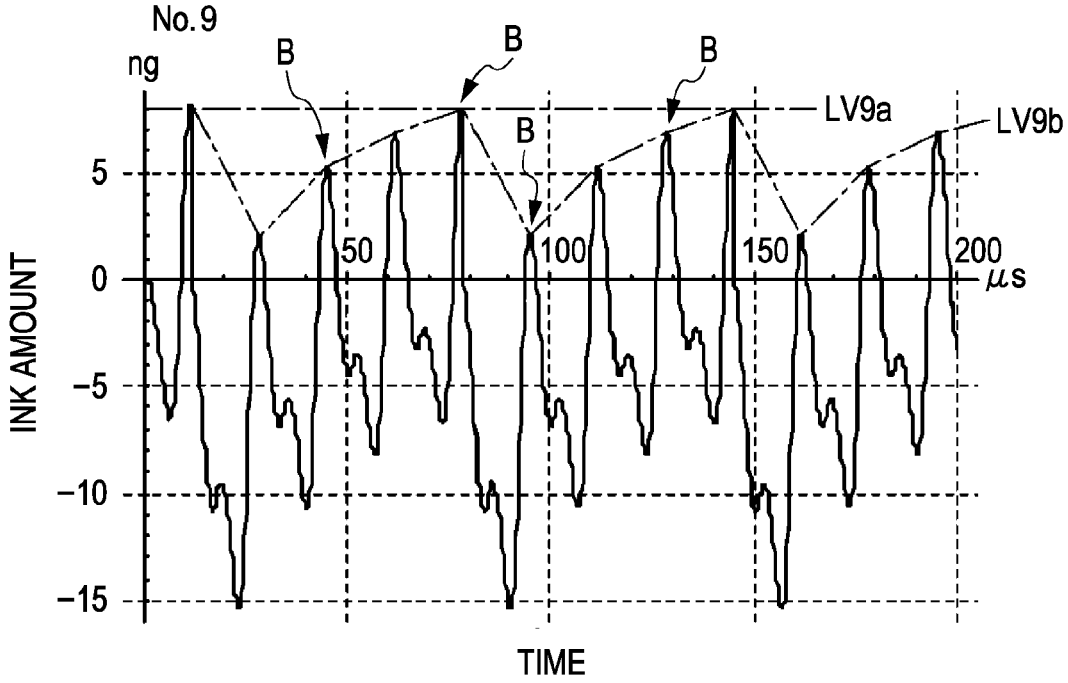
FIG. 18 is a view showing a simulation result at the time of 60-kHz ejection of a head of No. 9.

As shown in FIG. 12 (the head HD of No. 1), FIG. 16 (the head HD of No. 5), FIG. 18 (the head HD of No. 9) and FIG. 20 (the head HD of No. 13), in these heads HD, the amount of ink droplets is smaller than the reference value. For example, if the maximum ejection amount is compared with respect to the ink droplets in the fourth ink droplet and later ink droplets, the ejection amount of the heads HD of No. 1 and No. 5 is about 7.2 ng (LV1*a* and LV5*a*) and the ejection amount of the heads HD of No. 9 and No. 13 is about 8 ng (LV9*a* and LV13*a*). That is, the periodical variation of the ejection amount occurs in the heads HD. That is, as denoted by lens of the reference numerals LV1*b*, LV5*b*, LV9*b* and LV13*b*, four types of ink droplets are repeatedly ejected from a minimum amount of ink droplets to a maximum amount of ink droplets.

Heads HD of L424=1100 μm

Figure 17:
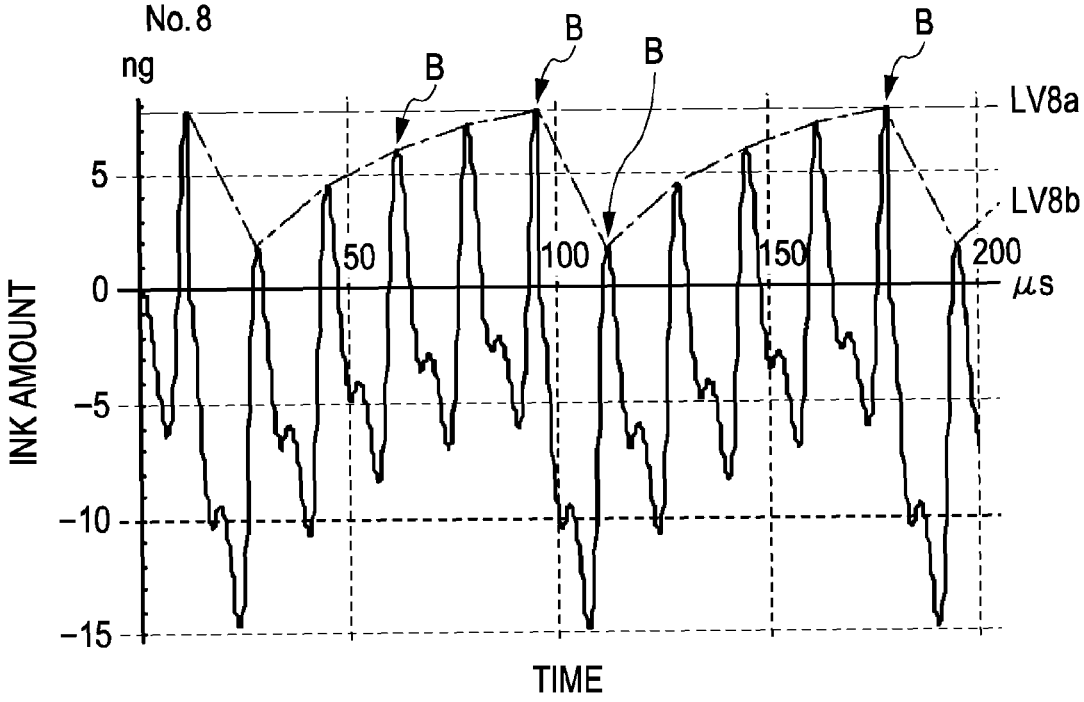
FIG. 17 is a view showing a simulation result at the time of 60-kHz ejection of a head of No. 8.
Figure 19:
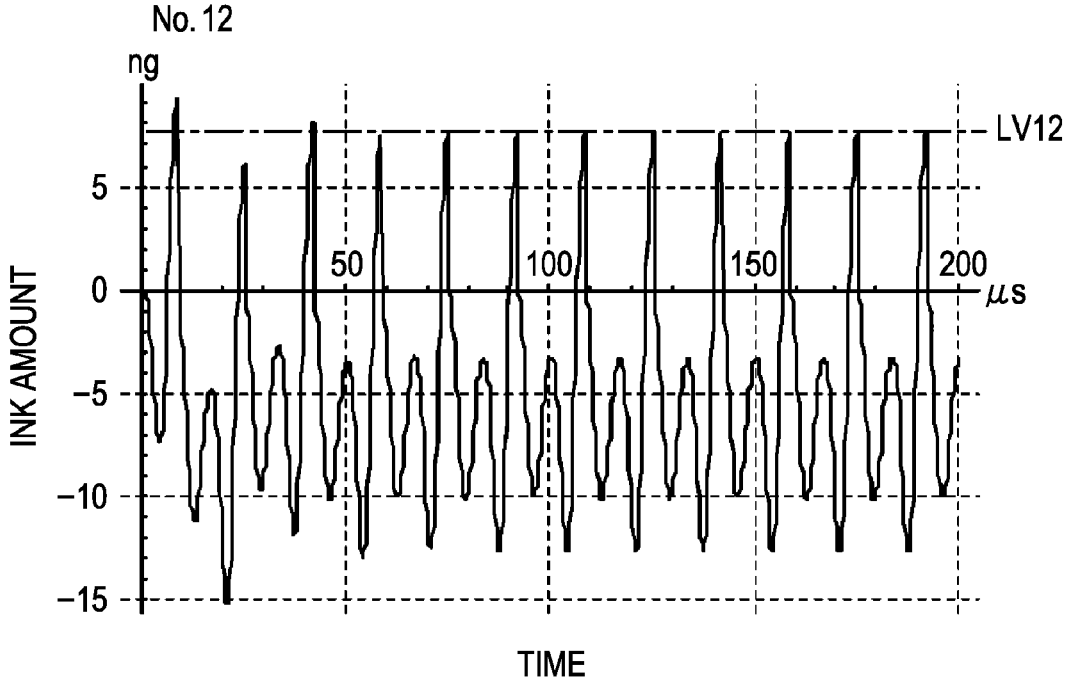
FIG. 19 is a view showing a simulation result at the time of 60-kHz ejection of a head of No. 12.

As shown in FIG. 15 (the head HD of No. 4), FIG. 17 (the head HD of No. 8), FIG. 19 (the head HD of No. 12) and FIG. 23 (the head HD of No. 16), in these heads HD, the amount of ink droplets is smaller than the reference value. For example, if the maximum ejection amount is compared with respect to the ink droplets in the fourth ink droplet and later ink droplets, the ejection amount of the heads HD of No. 4 and No. 8 is about 7.8 ng (LV4*a* and LV8*a*). In addition, in the head HD of No. 12, the ejection amount is uniform at the ink droplets in the fourth ink droplet and later ink droplets, but the maximum ejection amount is about 7.5 ng (LV12). Similarly, the ejection amount of the head HD of No. 16 is about 8.8 ng (LV16). In the head HD of No. 4 and the head HD of No. 8, the ejection amount is unstable. In these heads HD, as denoted by lines of the reference numerals LV13*b* and LV14*b*, five types of ink droplets are repeatedly ejected from a minimum amount of ink droplets to a maximum amount of ink droplets.

Discussion About Ejection Amount

With respect to the heads HD of the comparative examples, the reason why the shortage or the periodical variation of the ejection amount occurs is not accurately known. In the shortage of the ejection amount, in the head HD of No. 1 to the head HD of No. 4, since the volume of the pressure chamber 424 is excessively large, it may be considered that the pressure variation of the ink contained in the pressure chamber 424 is insufficient. That is, it may be considered that the deformation of the diaphragm portion 423*a* (the partitioning portion) is insufficient with respect to the volume of the pressure chamber 424. In the heads HD of No. 12, 15 and 16, since the width of the pressure chamber 424 is excessively small, it may be considered that the deformation of the diaphragm portion 423*a* is insufficient.

In the periodical variation of the ejection amount, it may be considered that the ink contained in the pressure chamber 424 is not sufficiently depressurized after the ejection of the ink droplets. For example, if the depressurization of the ink contained in the pressure chamber 424 immediately after the first ink droplet is ejected is insufficient, it is considered that it is difficult to move the ink contained in the ink supply path 425. Accordingly, it is considered that the ejection amount is excessively decreased with respect to the second ink droplet. If the ink contained in the pressure chamber 424 is sufficiently depressurized by the ejection operation of the second ink droplet, it is considered that the movement of the ink contained in the ink supply path 425 to the pressure chamber 424 is started and the ink contained in the pressure chamber 424 is filled. This can be seen in that the heads HD of No. 3 and 4, in which the length L425 of the ink supply path 425 is long, requires much time consumed for filling the ink compared with the heads HD of No. 1 and 2.

Variation in Ejection Amount due to Ejection Frequency

Figure 25:
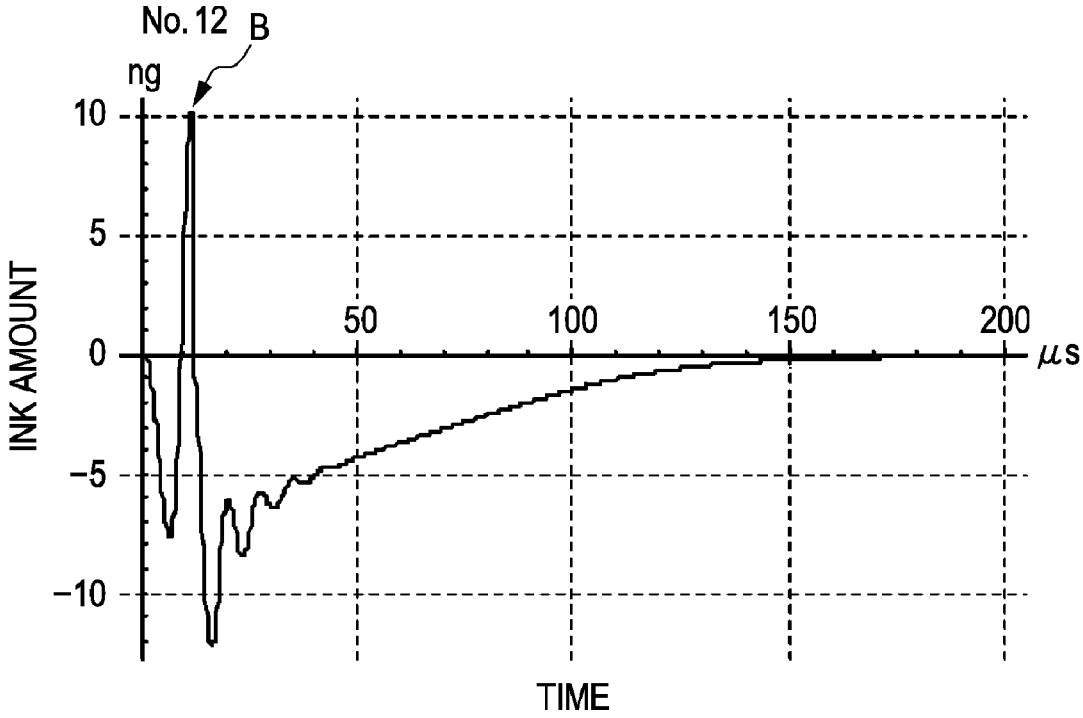
FIG. 25 is a view showing a simulation result when one ink droplet is ejected by the head of No. 12.
Figure 26:
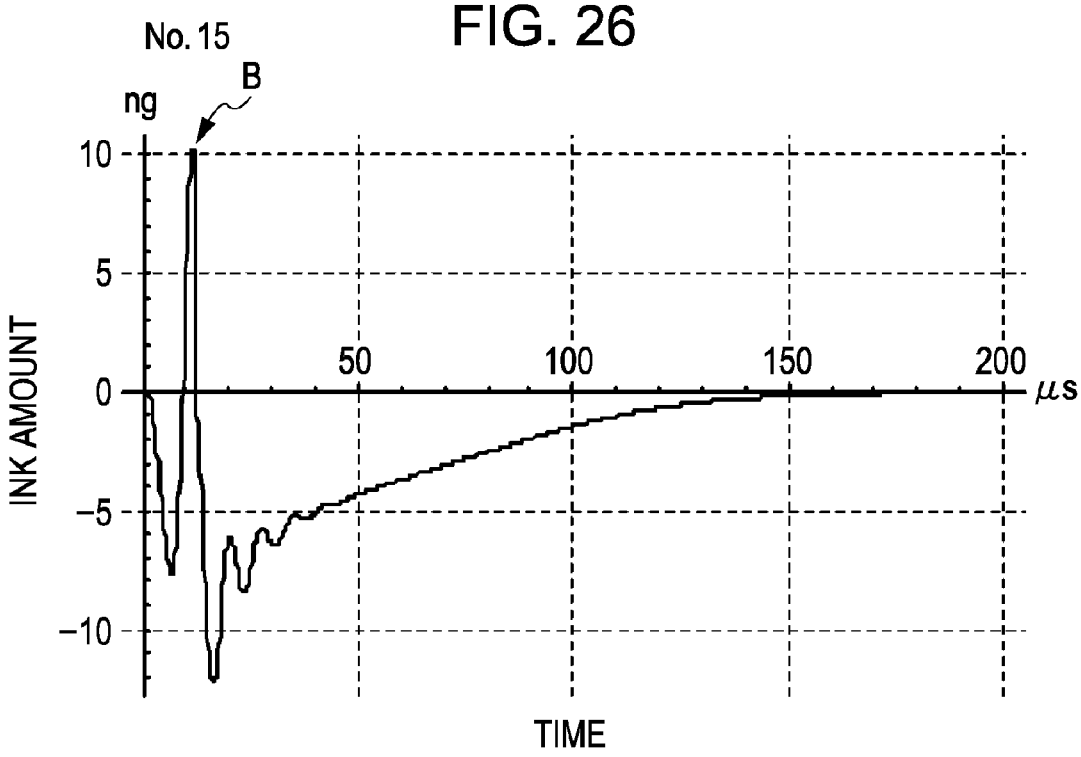
FIG. 26 is a view showing a simulation result when one ink droplet is ejected by the head of No. 15.
Figure 27:
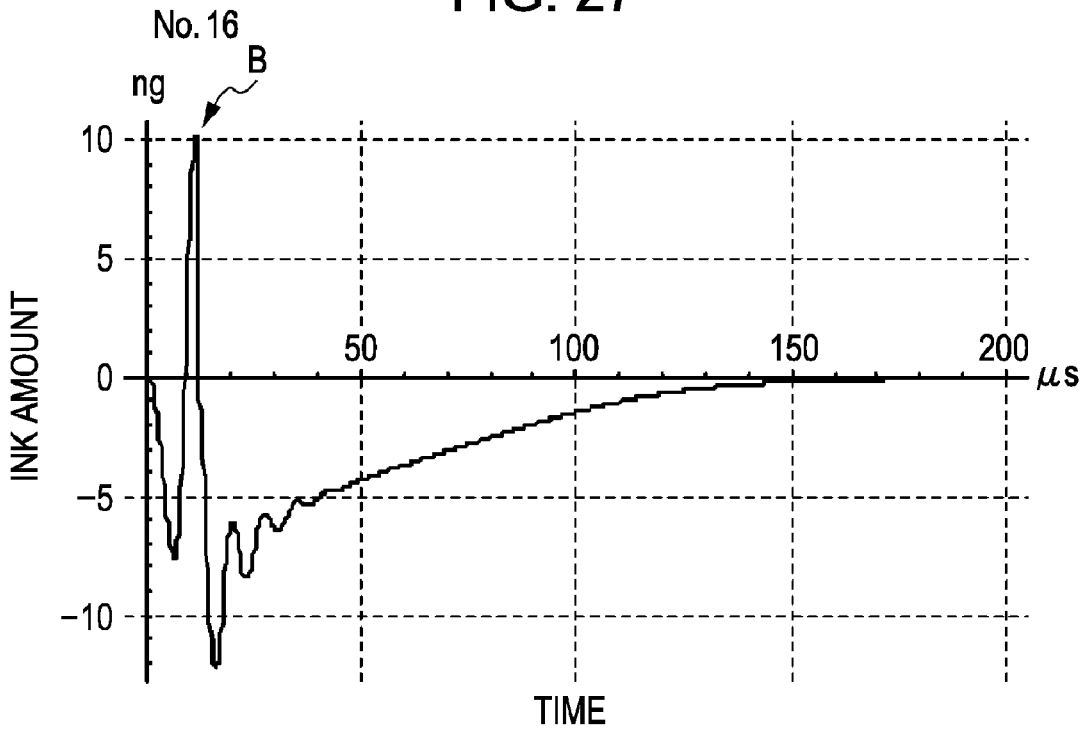
FIG. 27 is a view showing a simulation result when one ink droplet is ejected by the head of No. 16.
Figure 29:
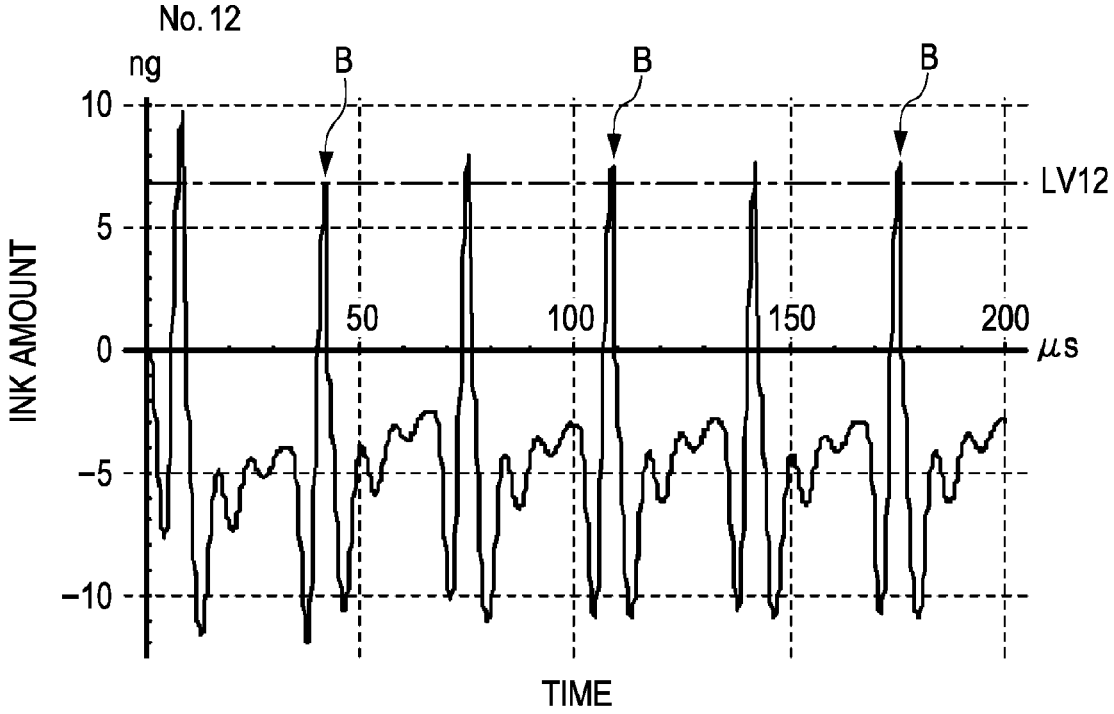
FIG. 29 is a view showing a simulation result at the time of 30-kHz ejection of a head of No. 12.
Figure 30:
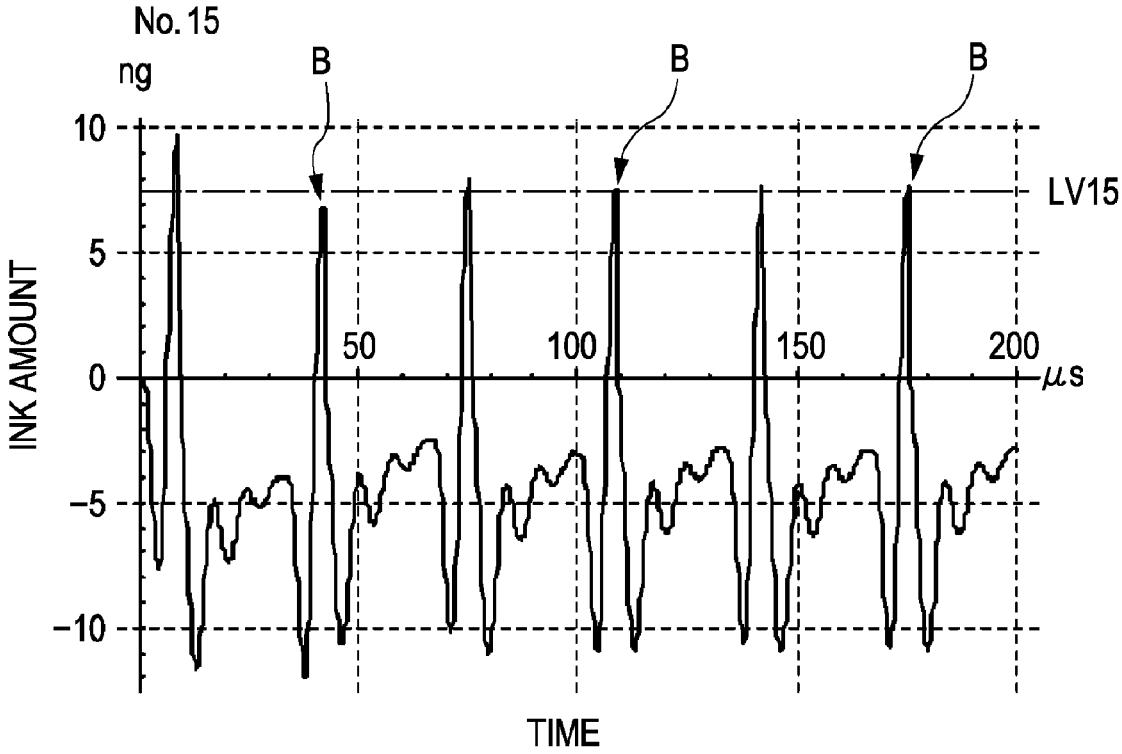
FIG. 30 is a view showing a simulation result at the time of 30-kHz ejection of a head of No. 15.
Figure 31:
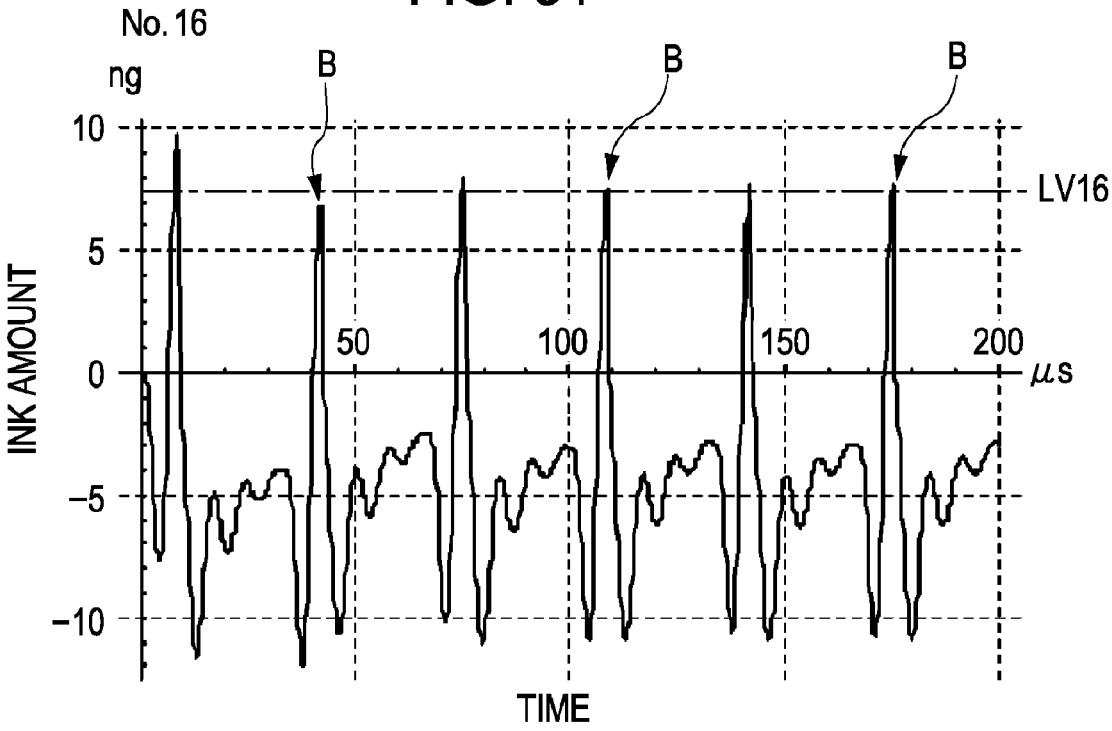
FIG. 31 is a view showing a simulation result at the time of 30-kHz ejection of a head of No. 16.

With the heads HD of No. 12, 15 and 16, the variation in ejection amount due to the ejection frequency will be discussed. In these heads HD, as shown in FIG. 25 (the head HD of No. 12), FIG. 26 (the head HD of No. 15) and FIG. 27 (the head HD of No. 16), when one ink droplet is ejected, the ejection amount which is substantially equal to the reference value is obtained. However, as shown in FIG. 29 (the head HD of No. 12), FIG. 30 (the head HD of No. 15) and FIG. 31 (the head HD of No. 16), when the ejection frequency is 30 kHz, the ejection amount does not reach the reference value. In this example, in the heads HD of No. 12, 15 and 16, the ejection amount is decreased to about 7.5 ng (LV12, LV15 and LV16).

Figure 24:
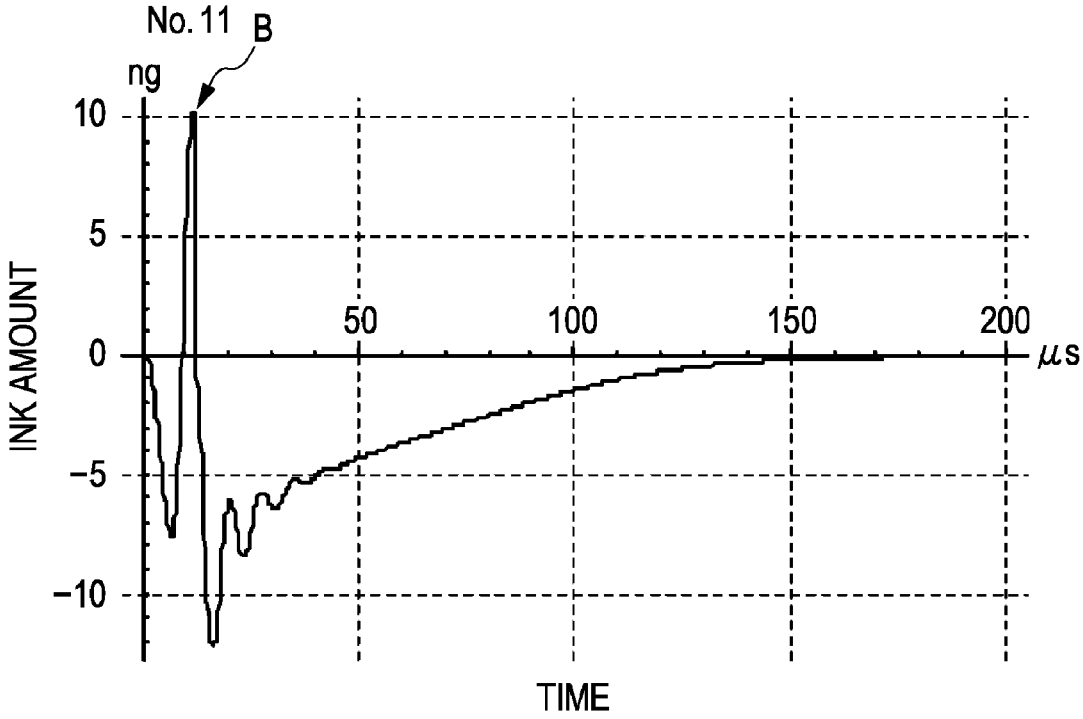
FIG. 24 is a view showing a simulation result when one ink droplet is ejected by the head of No. 11.
Figure 28:
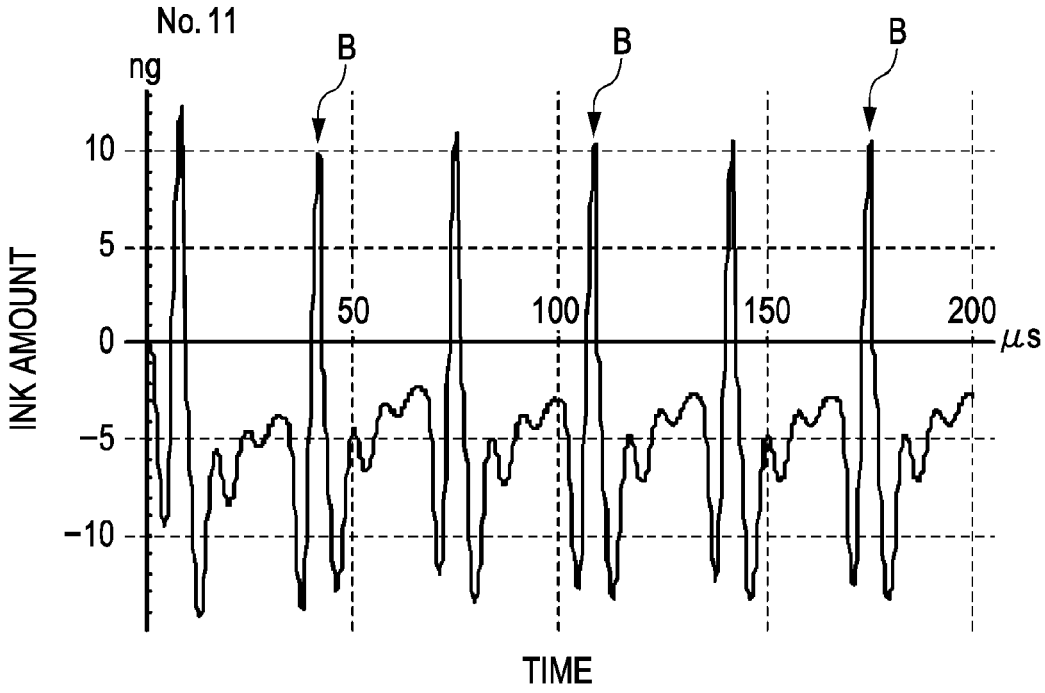
FIG. 28 is a view showing a simulation result at the time of 30-kHz ejection of a head of No. 11.

In contrast, in the head HD of No. 11, as shown in FIGS. 24 and 28, both when one ink droplet is ejected and when the ejection frequency is 30 kHz, the ejection amount is equal to or greater than the reference value. The heads of the present embodiment and the heads of the comparative examples are significantly different from each other in the variation in ejection amount due to the ejection frequency.

Ink Having Viscosity of 6 mPa·s

In the above-described evaluated result, the viscosity of the ink was 15 mPa·s. By using the head of the present embodiment, the ink having the viscosity of 6 mPa·s can be similarly ejected. The low viscosity of the ink indicates that the channel resistance is low. In this case, it is considered that the head HD in which the channel resistance of the ink supply path 425 or the pressure chamber 424 is low is significantly influenced. Accordingly, the head HD having the low channel resistance, that is, the head HD in which the pressure chamber 424 or the ink supply path 425 is thick and short, is evaluated.

In detail, the head HD of No. 6 is evaluated. That is, if the ink having the viscosity of 6 mPa·s can be stably ejected by the head HD of No. 6, this ink can be stably ejected with a high frequency by the heads HD of No. 7, 10 and 11. In addition, as the comparative examples, the heads HD of No. 1, 2 and 5 are evaluated.

Figure 32:
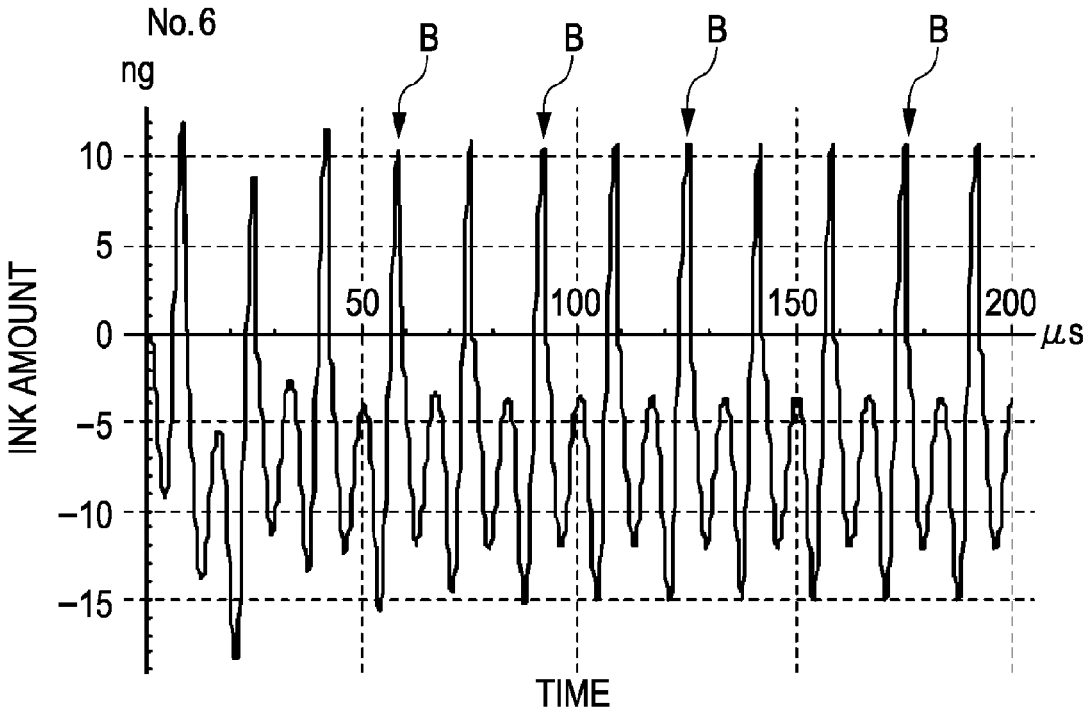
FIG. 32 is a view showing a simulation result when an ink having viscosity of 6 mPa·s is ejected with a frequency 60 kHz using a head of No. 6.

FIG. 32 shows a simulation result when the ink having the viscosity of 6 mPa·s (the specific gravity is substantially 1) is ejected with the frequency of 60 kHz using the head HD of No. 6. In the head HD of No. 6, the ink droplets in the fourth ink droplet and later ink droplets are stably ejected by the amount of about 10.5 ng. From this result, the head HD of No. 6 also satisfies the above-described evaluation reference. That is, the head HD of No. 6 can stably eject the ink droplets with a high frequency although the ink has the viscosity of 6 mPa·s.

Figure 33:
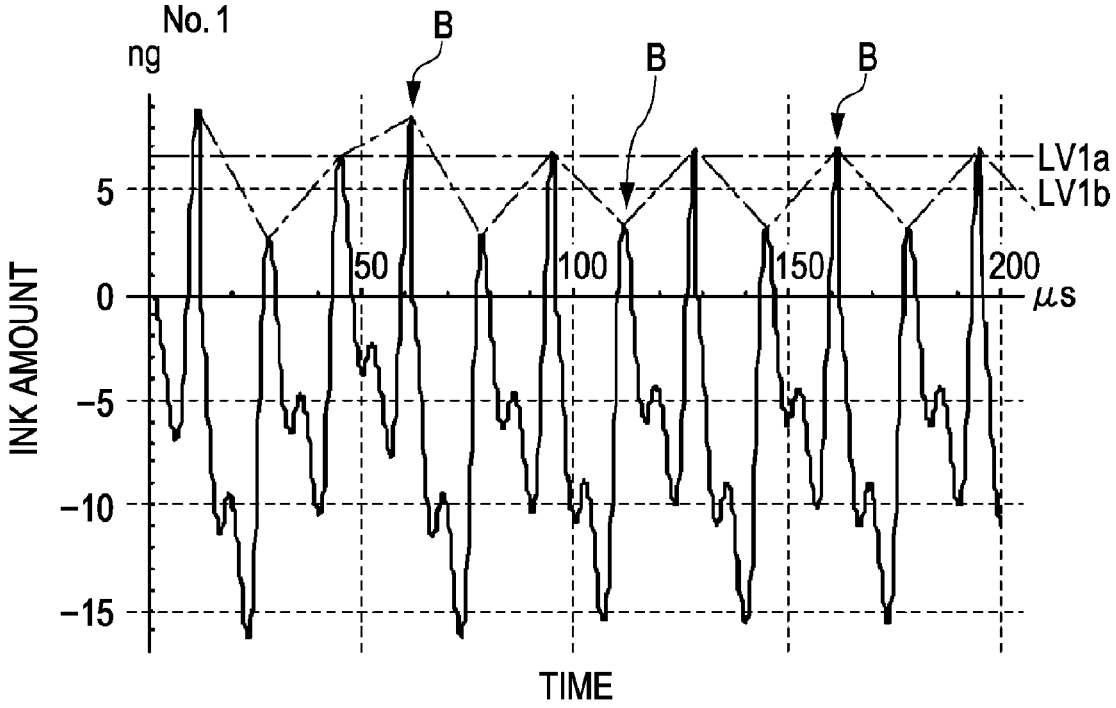
FIG. 33 is a view showing a simulation result when an ink having viscosity of 6 mPa·s is ejected with a frequency 60 kHz using a head of No. 1.
Figure 34:
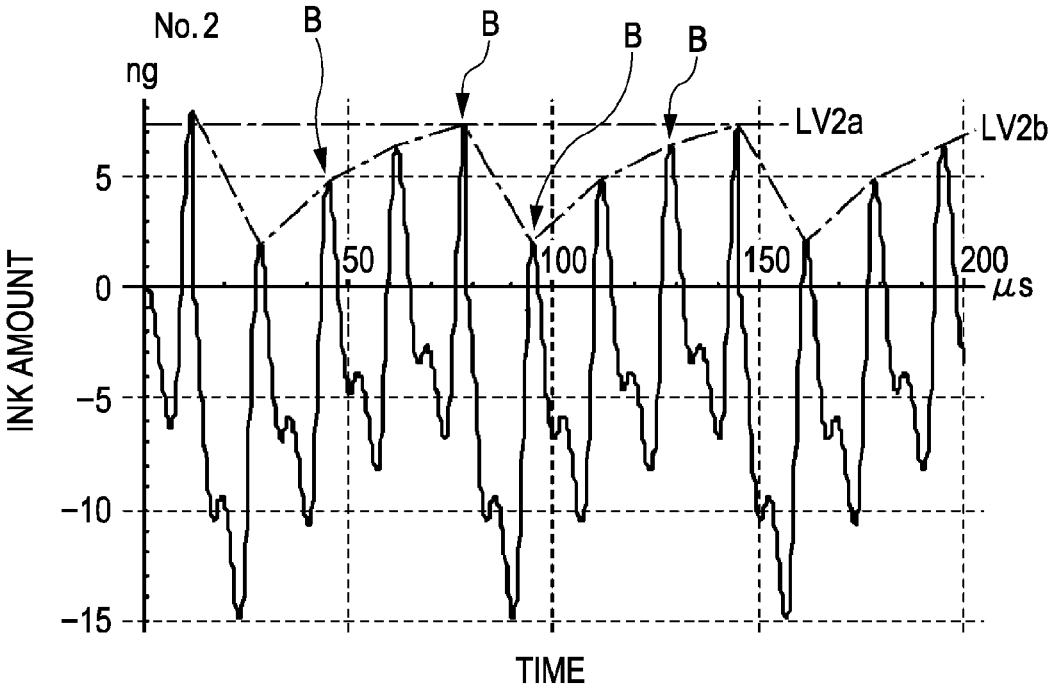
FIG. 34 is a view showing a simulation result when an ink having viscosity of 6 mPa·s is ejected with a frequency 60 kHz using a head of No. 2.
Figure 35:
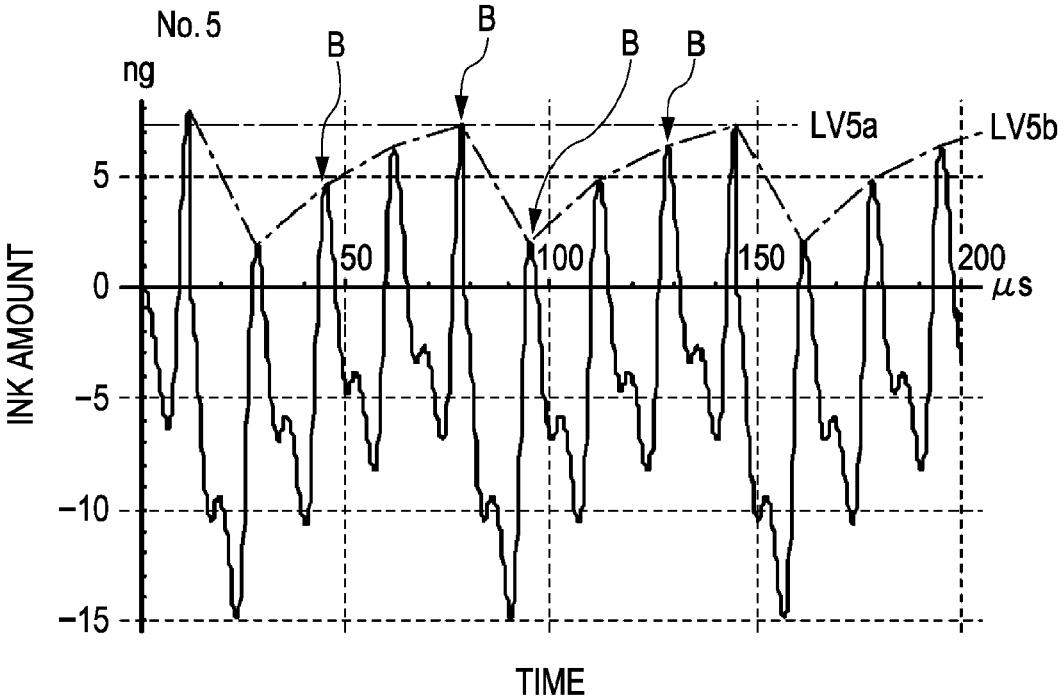
FIG. 35 is a view showing a simulation result when an ink having viscosity of 6 mPa·s is ejected with a frequency 60 kHz using a head of No. 5.

FIGS. 33 to 35 show the simulation results when the ink having the viscosity of 6 mPa·s is ejected with the frequency of 60 kHz using the heads HD of No. 1, 2 and 5. As shown in these drawings, all the maximum amounts of ink droplets of the heads HD do not reach the reference amount (10 ng) (LV1*a*, LV2*a* and LV5*a*). In addition, the deviation in ejection amount occurs (LV1*b*, LV2*b* and LV5*b*). From these results, in the heads HD of No. 1, 2 and 5, if the ink having the viscosity of 6 mPa·s is ejected with the high frequency, the shortage of the amount of ink droplets occurs and thus the amount of ink droplets becomes unstable.

Another Ejection Pulse PS2

Figure 36:
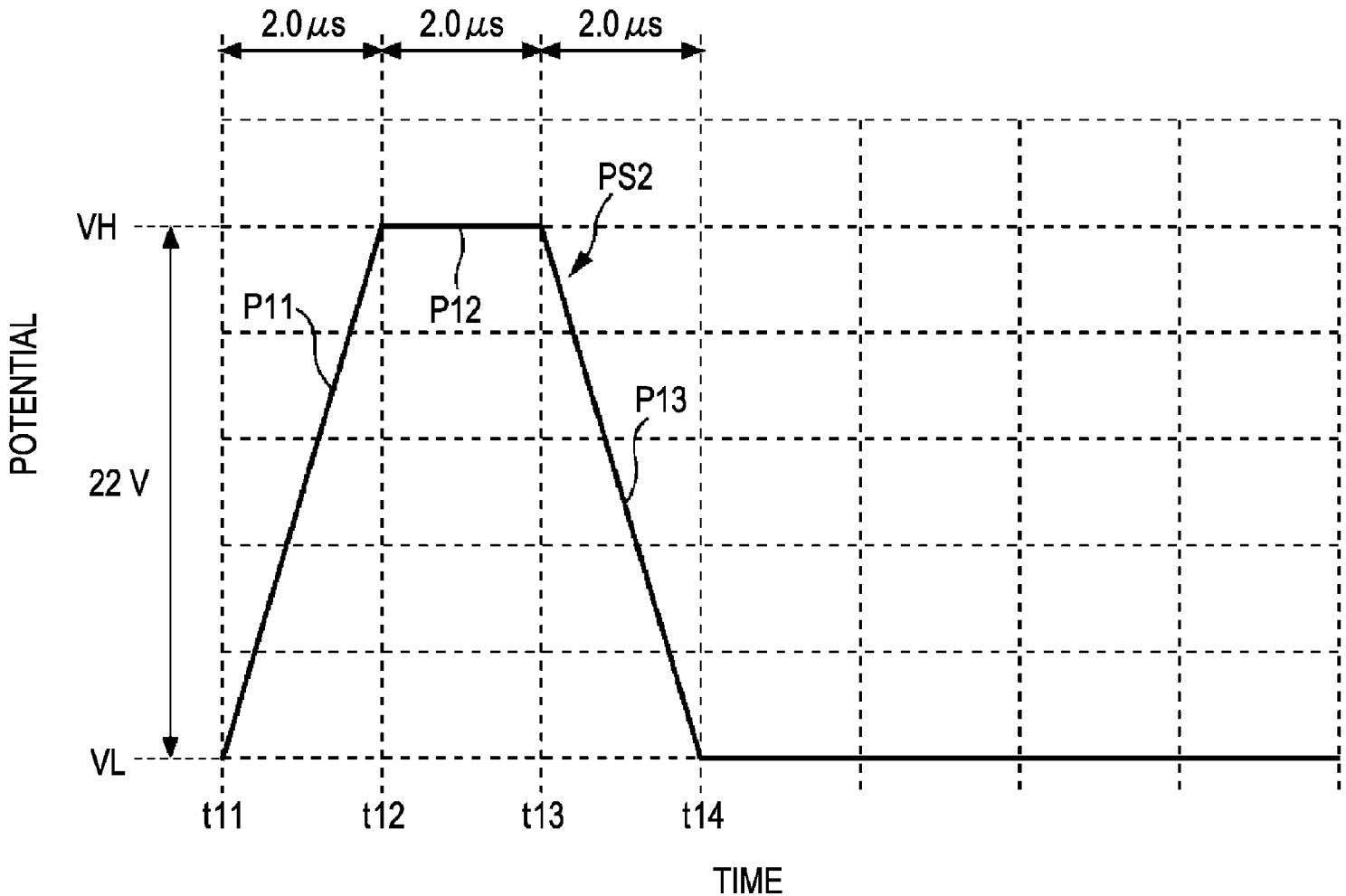
FIG. 36 is a view explaining another ejection pulse.

Next, the evaluated result using another ejection pulse PS2 which is different from the above-described ejection pulse PS1 in the potential variation pattern will be described. FIG. 36 is a view explaining another ejection pulse PS2. In addition, in FIG. 36, a vertical axis denotes the potential of the driving signal COM and a horizontal axis denotes a time. Another ejection pulse PS2 has a plurality of portions denoted by reference numerals P11 to P13. That is, another ejection pulse PS2 has a trapezoidal potential variation pattern including a depressurization portion P11, a potential holding portion P12 and a pressurization portion P13.

In the depressurization portion P11, a start potential at a timing t1 is a lowest potential VL and an end potential at a timing t2 is a highest potential VH. In this ejection pulse PS2, the generation period of the depressurization portion P11 is 2.0 μs. The potential holding portion P12 is generated from the timing t2 to a timing t3 and is held at the highest potential VH. In this ejection pulse PS2, the generation period of the potential holding portion P12 is 2.0 μs. In the pressurization portion P13, a start potential at the timing t3 is the highest potential VH and an end potential at a timing t4 is the lowest potential VL. In this ejection pulse PS2, the generation period of the pressurization portion P13 is 2.0 μs.

Figure 38:
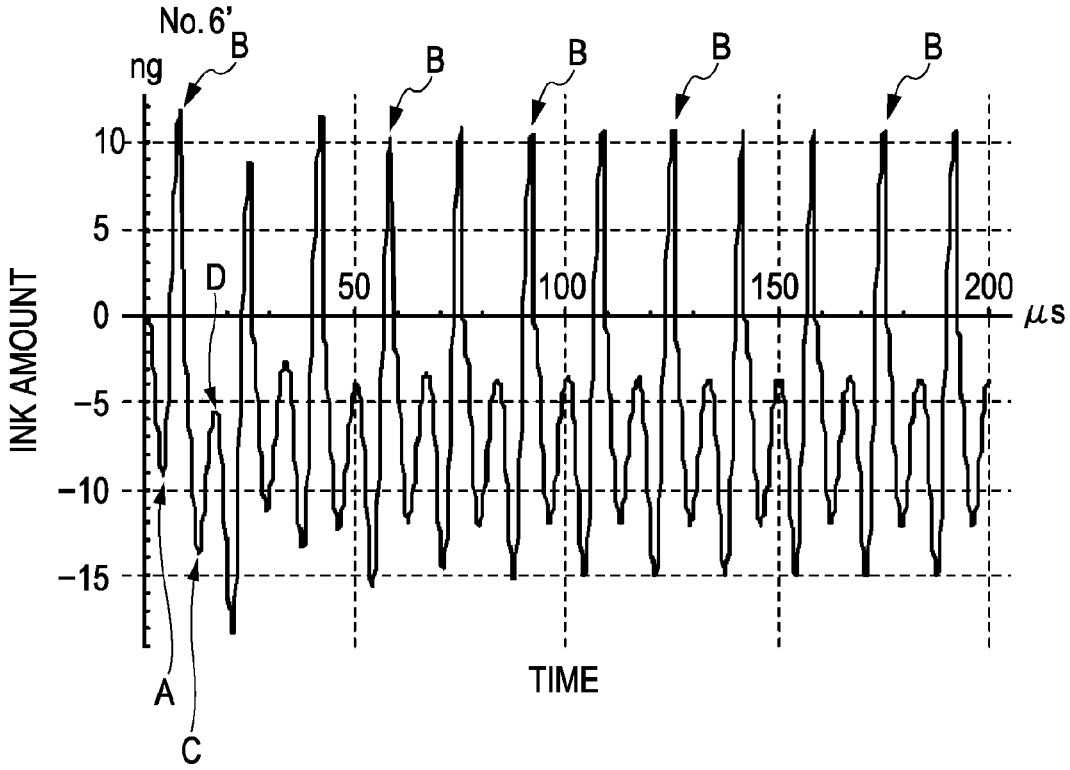
FIG. 38 is a view showing a simulation result at the time of 60-kHz ejection of a head of No. 6'.
Figure 39:
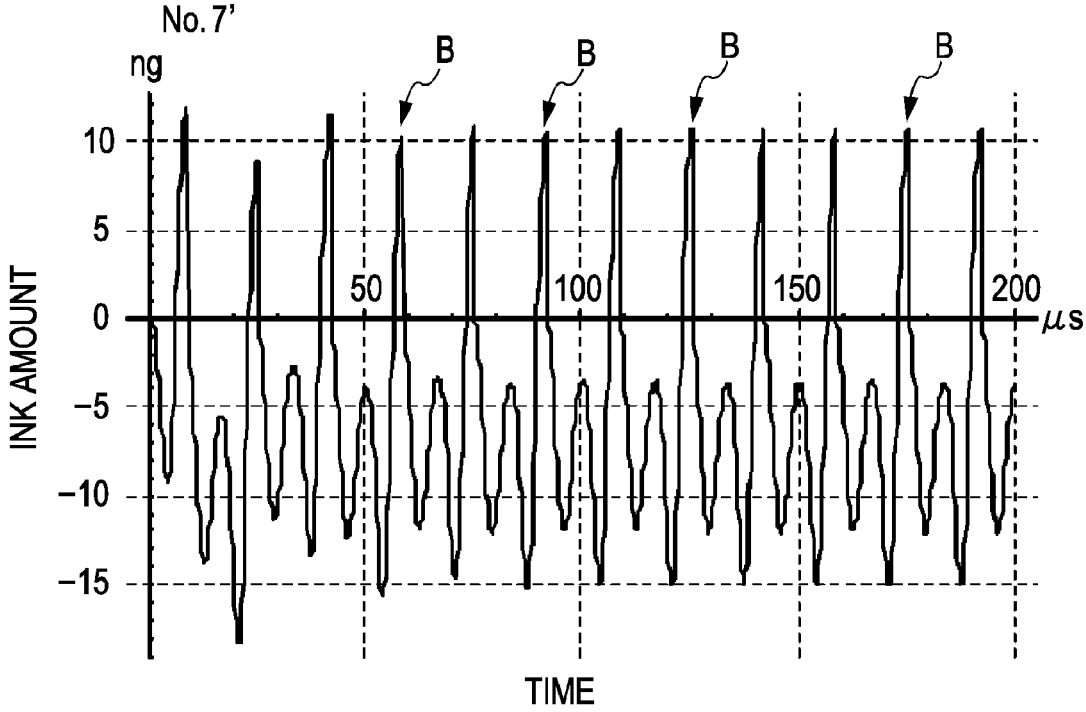
FIG. 39 is a view showing a simulation result at the time of 60-kHz ejection of a head of No. 7'.
Figure 40:
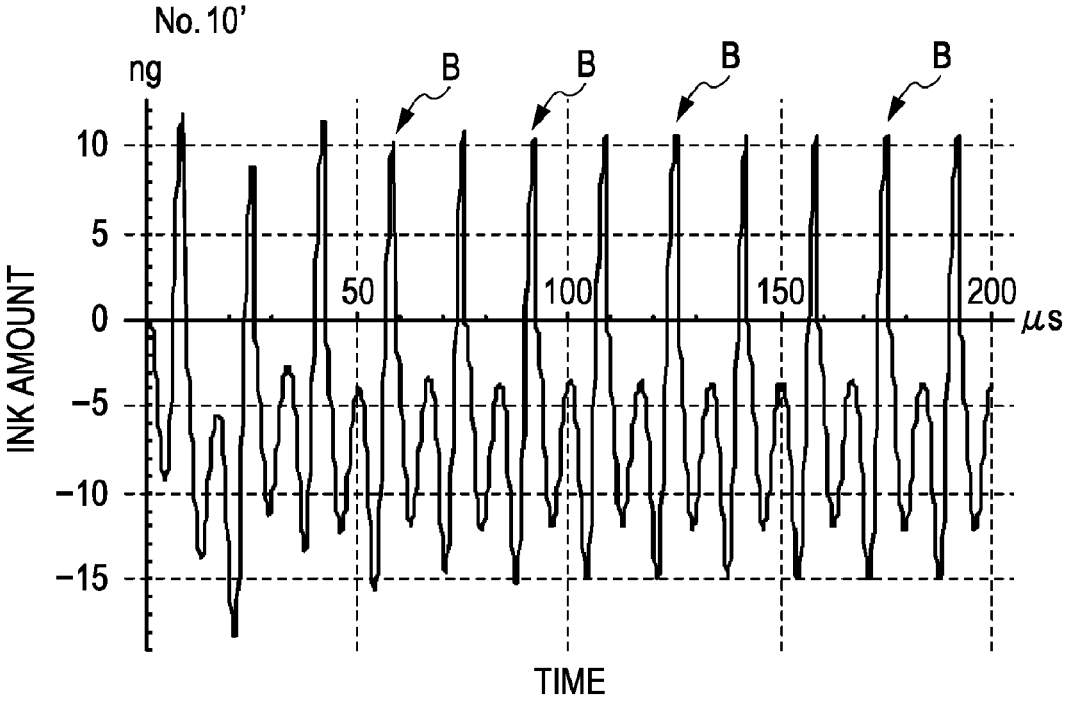
FIG. 40 is a view showing a simulation result at the time of 60-kHz ejection of a head of No. 10'.
Figure 41:
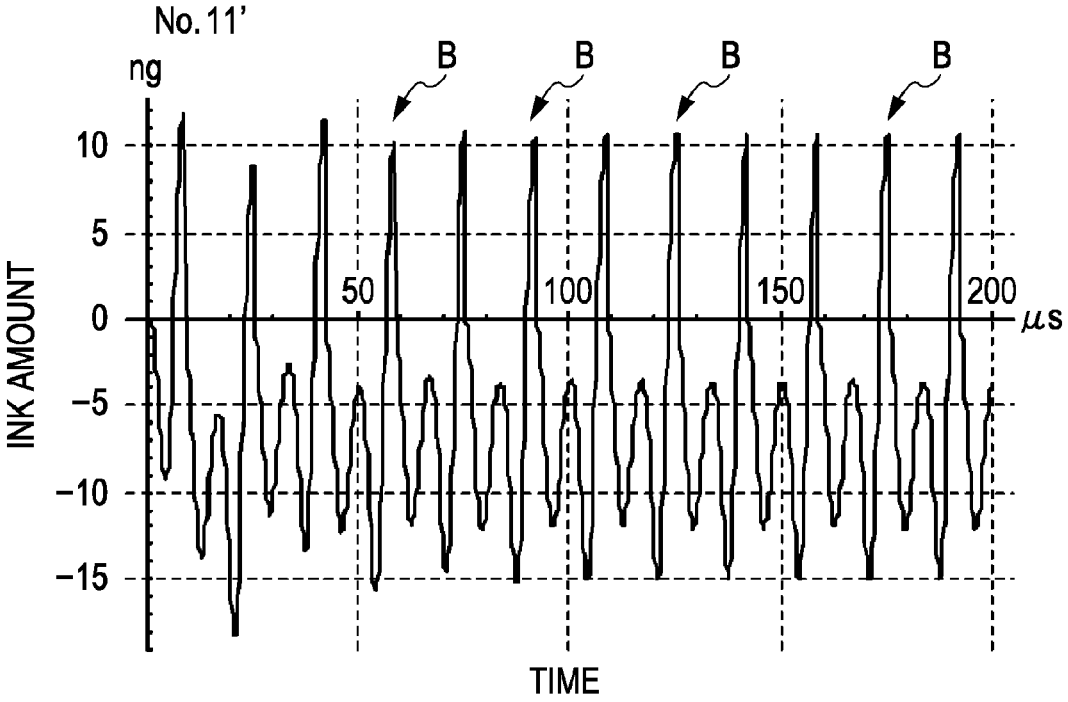
FIG. 41 is a view showing a simulation result at the time of 60-kHz ejection of a head of No. 11'.
Figure 42:
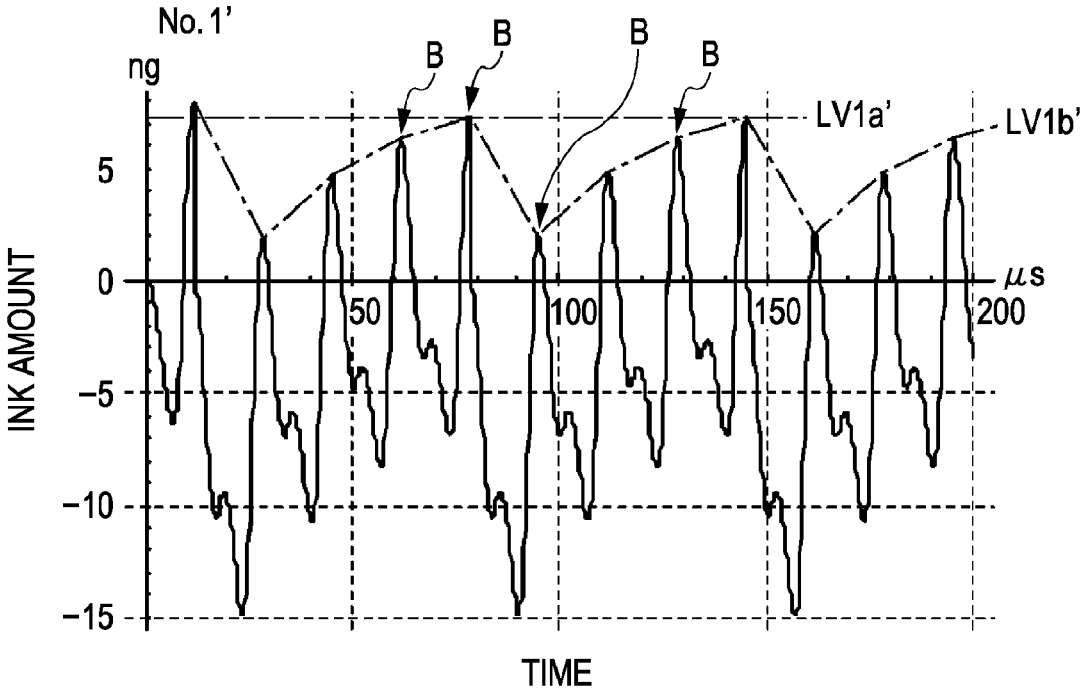
FIG. 42 is a view showing a simulation result at the time of 60-kHz ejection of a head of No. 1'.
Figure 43:
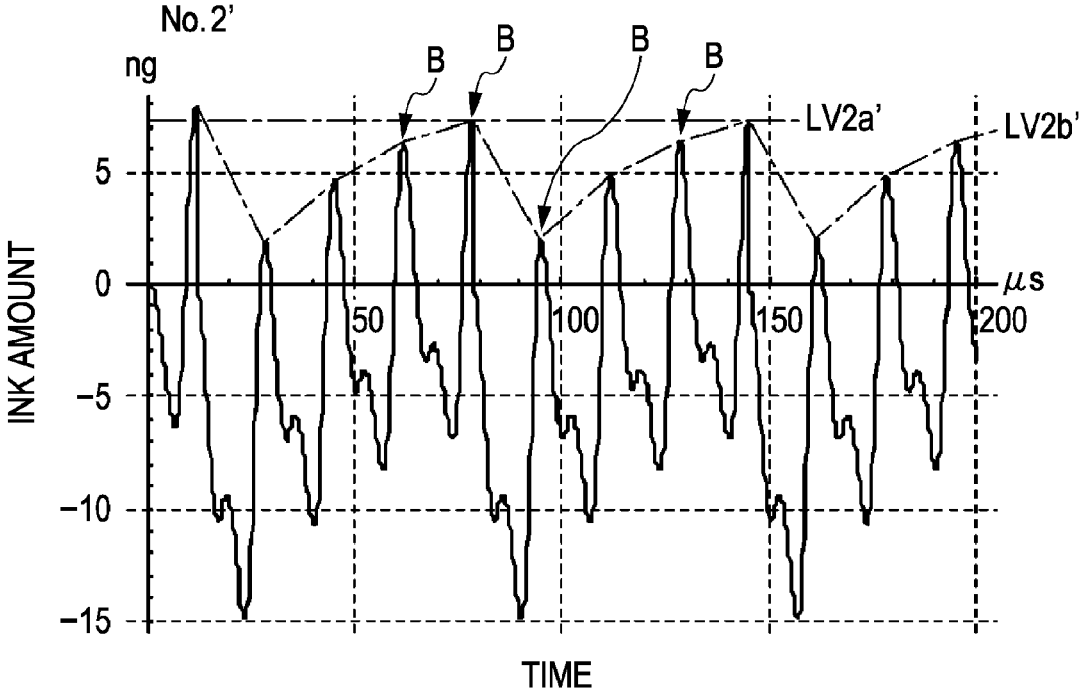
FIG. 43 is a view showing a simulation result at the time of 60-kHz ejection of a head of No. 2'.
Figure 44:
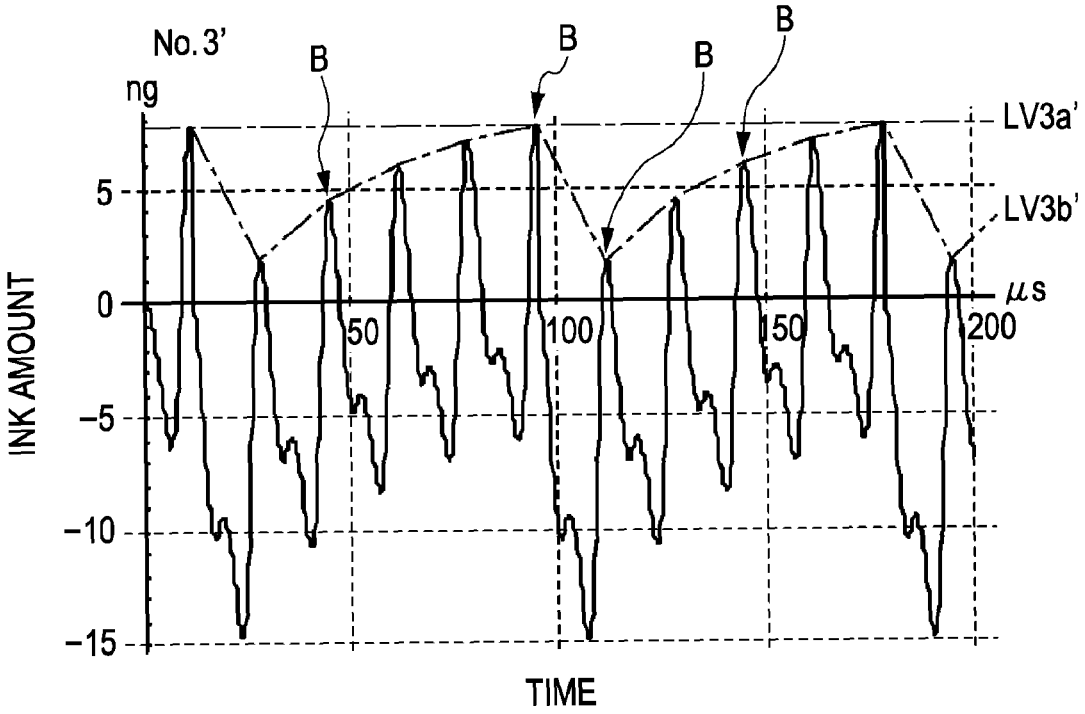
FIG. 44 is a view showing a simulation result at the time of 60-kHz ejection of a head of No. 3'.
Figure 45:
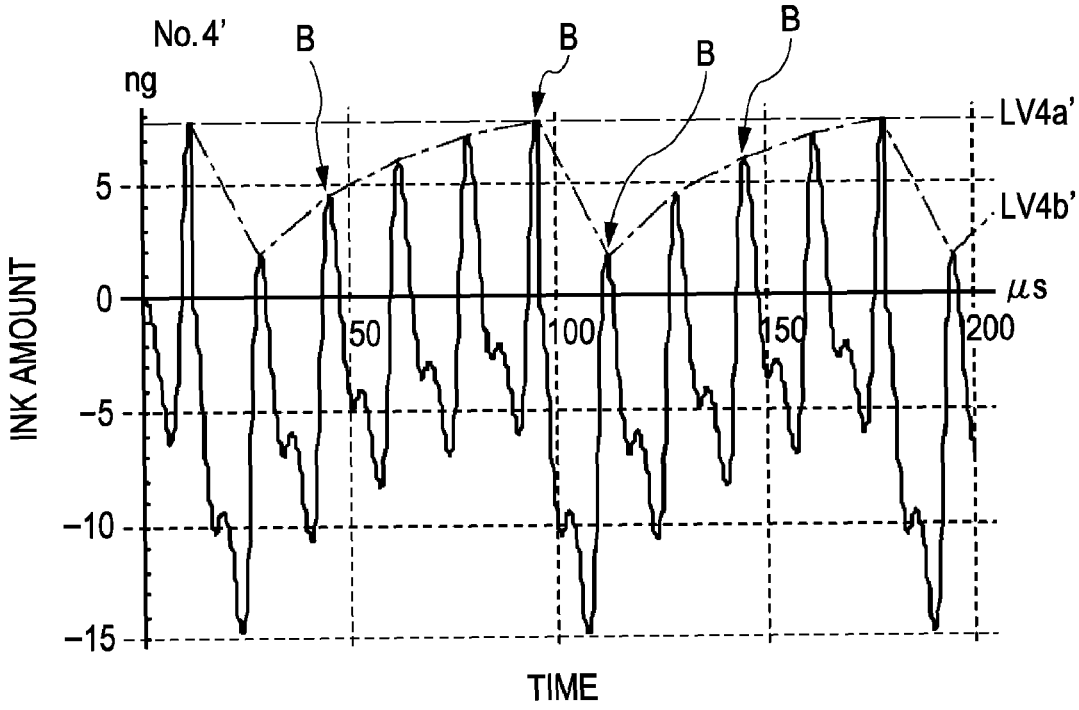
FIG. 45 is a view showing a simulation result at the time of 60-kHz ejection of a head of No. 4'.
Figure 46:
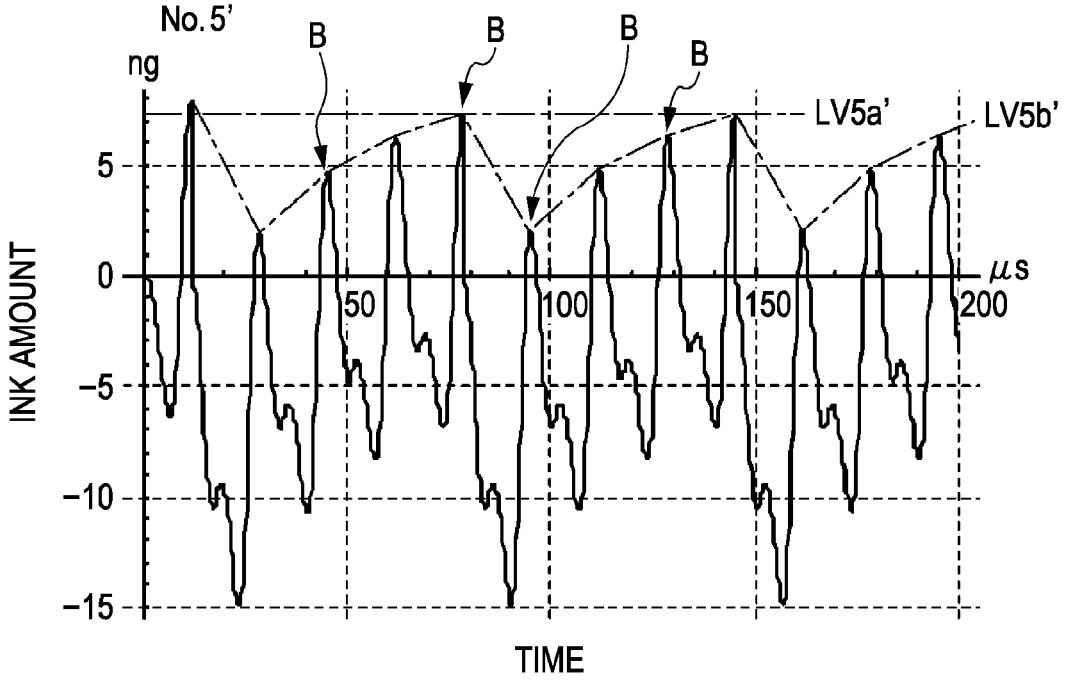
FIG. 46 is a view showing a simulation result at the time of 60-kHz ejection of a head of No. 5'.
Figure 47:
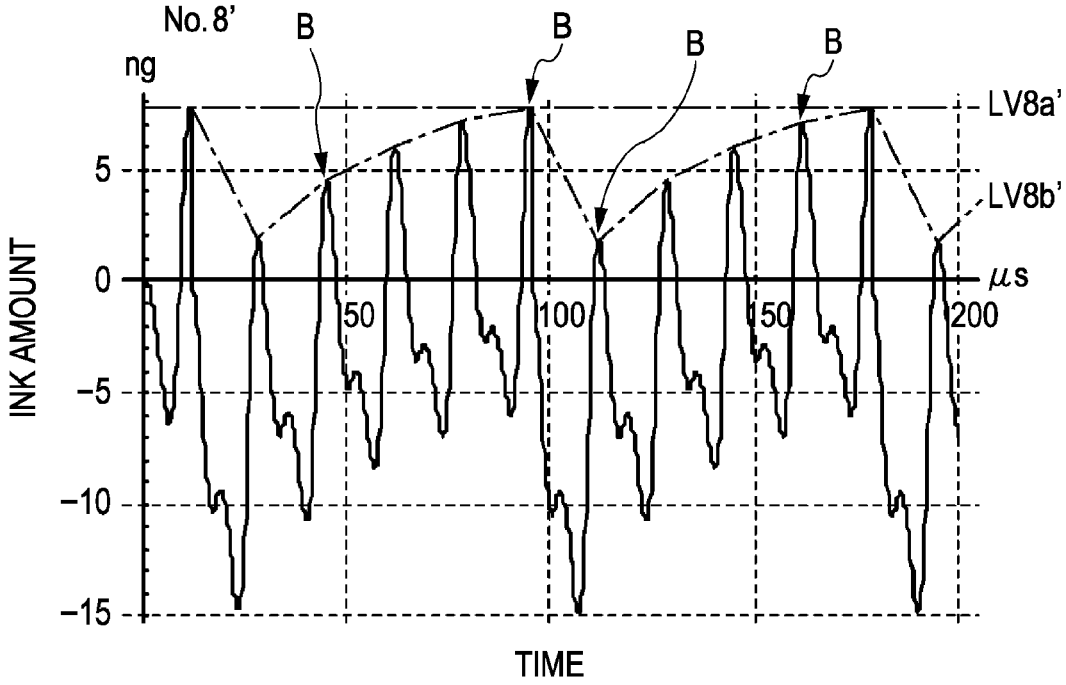
FIG. 47 is a view showing a simulation result at the time of 60-kHz ejection of a head of No. 8'.
Figure 48:
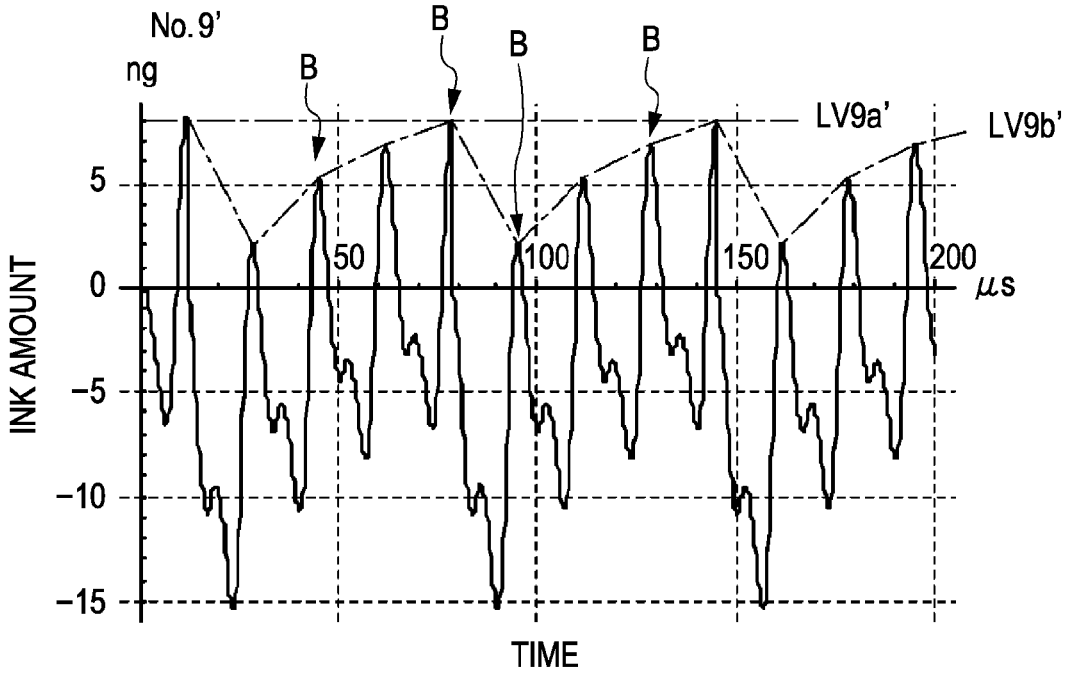
FIG. 48 is a view showing a simulation result at the time of 60-kHz ejection of a head of No. 9'.
Figure 49:
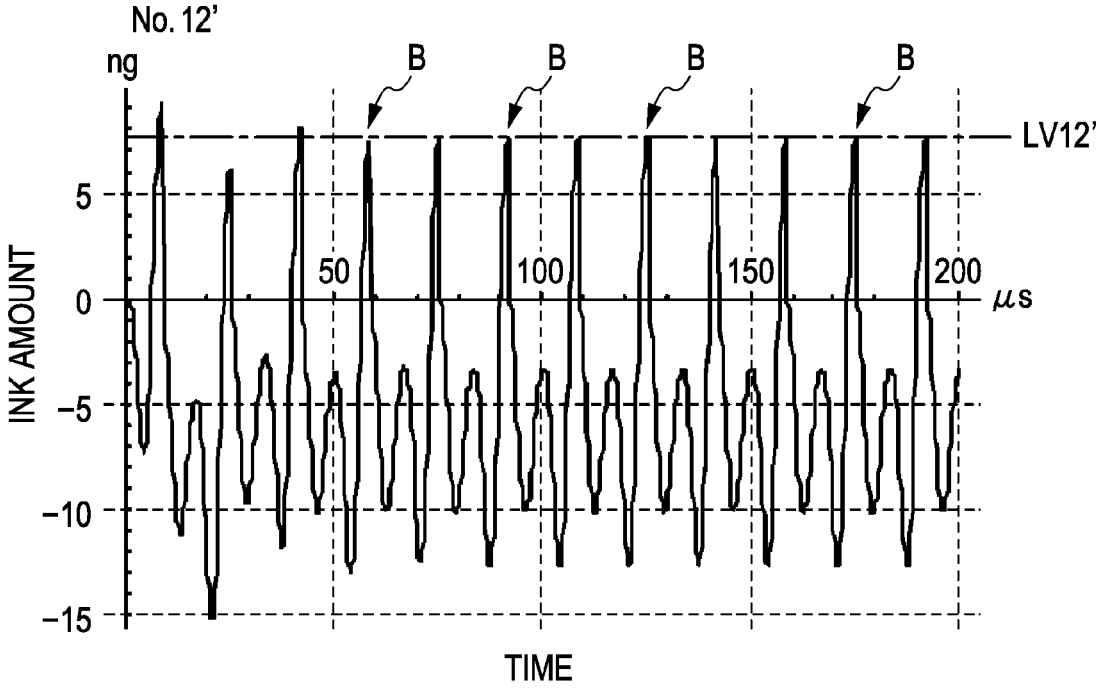
FIG. 49 is a view showing a simulation result at the time of 60-kHz ejection of a head of No. 12'.
Figure 50:
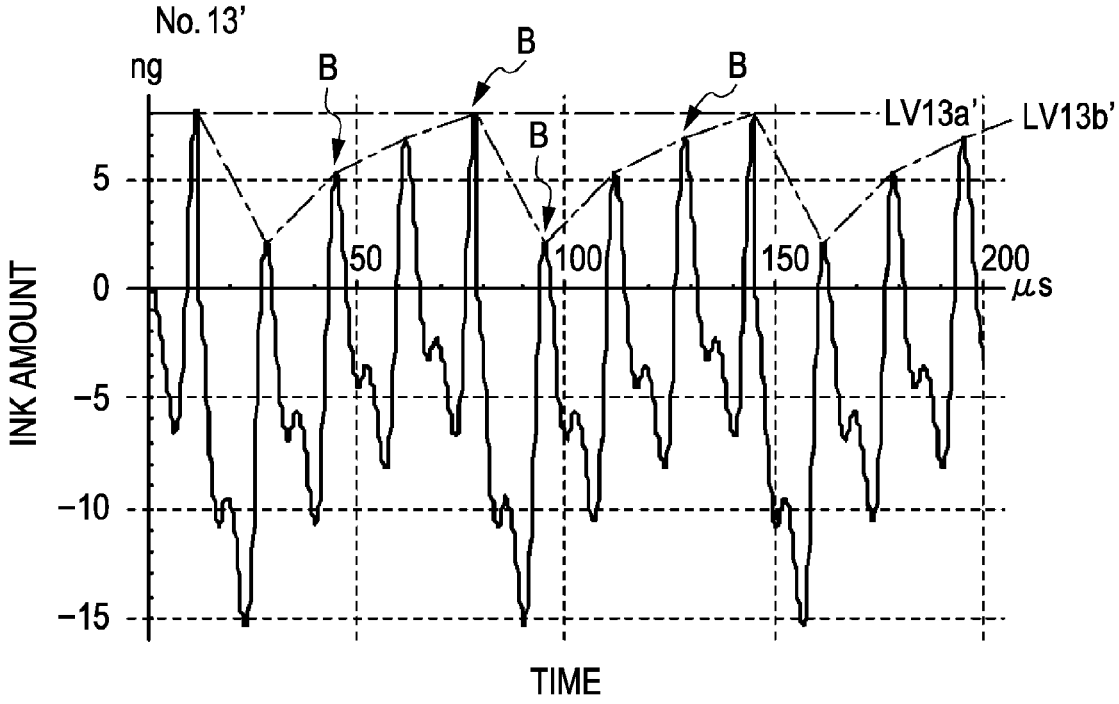
FIG. 50 is a view showing a simulation result at the time of 60-kHz ejection of a head of No. 13'.
Figure 51:
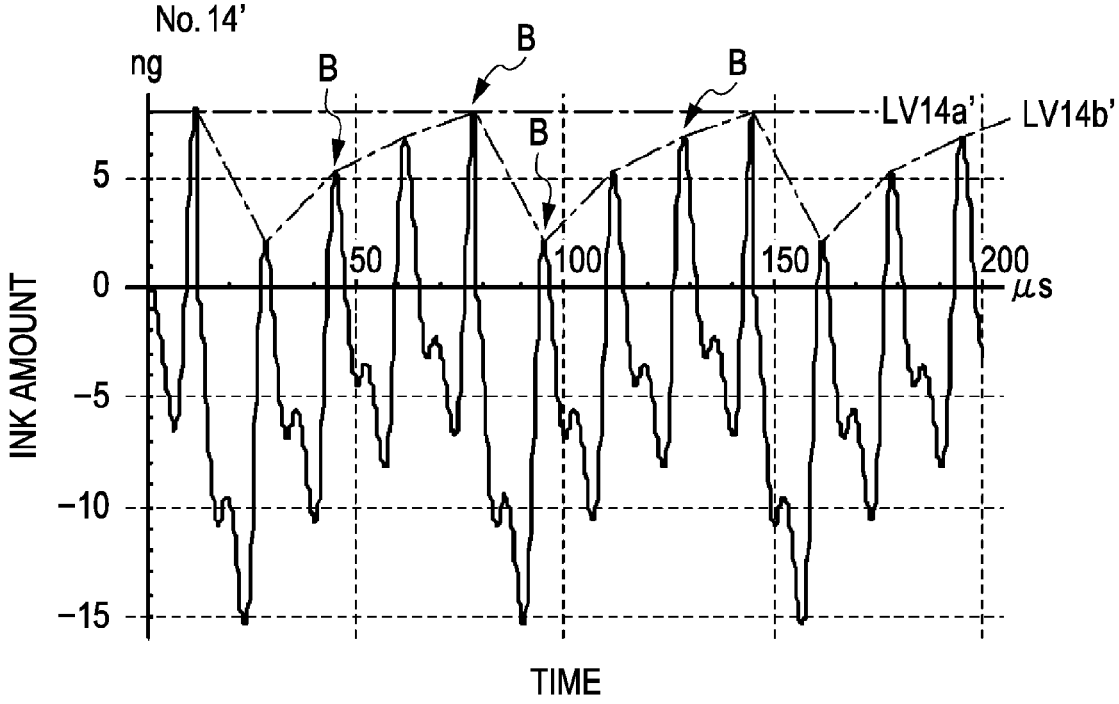
FIG. 51 is a view showing a simulation result at the time of 60-kHz ejection of a head of No. 14'.
Figure 52:
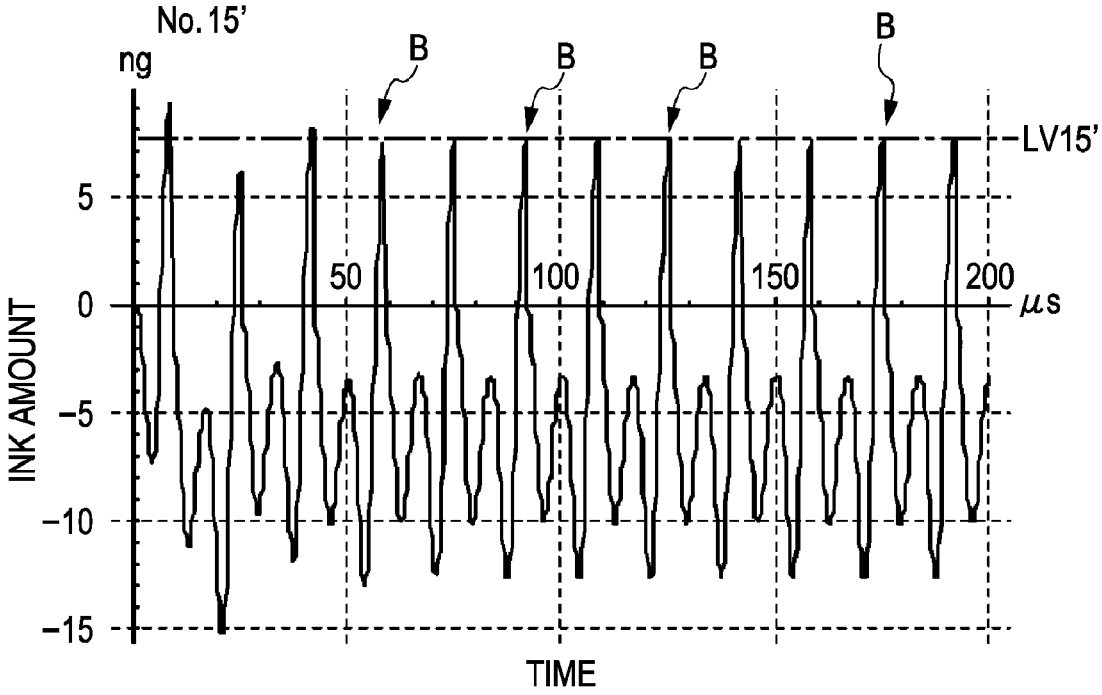
FIG. 52 is a view showing a simulation result at the time of 60-kHz ejection of a head of No. 15'.
Figure 53:
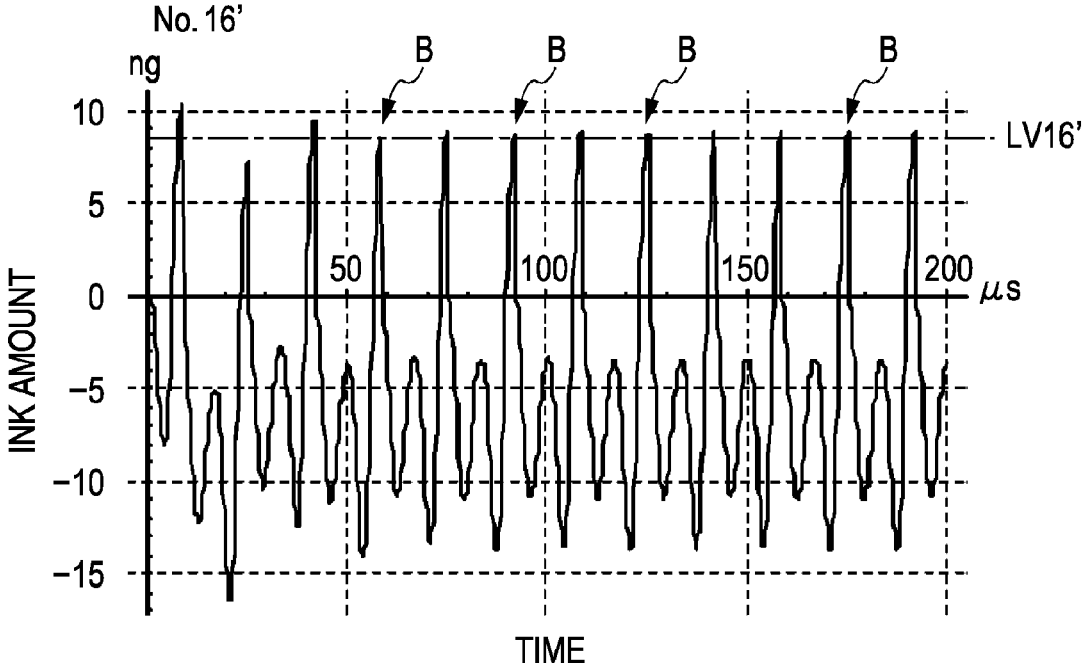
FIG. 53 is a view showing a simulation result at the time of 60-kHz ejection of a head of No. 16'.

When another ejection pulse PS2 is applied to the piezoelement 433, the ink is ejected from the nozzles 427. The behavior of the meniscus at this time is equal to that when the above-described ejection pulse PS1 is applied to the piezoelement 433. In brief, the ink contained in the pressure chamber 424 is depressurized due to the depressurization portion P11 and the meniscus is introduced to the pressure chamber 424. The movement of the meniscus is continued even when the potential holding portion P12 is applied. In addition, the pressurization portion P13 is applied according to a timing when the movement direction of the meniscus is inverted (a timing denoted by a reference numeral A of FIG. 38) Accordingly, the ink contained in the pressure chamber 424 is pressurized and the meniscus extends in a columnar shape. At a timing B, a portion of the front end of the meniscus is ejected as the ink droplet. By the reaction thereof, the meniscus is rapidly returned to the pressure chamber 424 and is then inverted (a timing denoted by a reference numeral C). At a timing D, the applying of a next ejection pulse PS2 is started.

Evaluated Result

Figure 37:
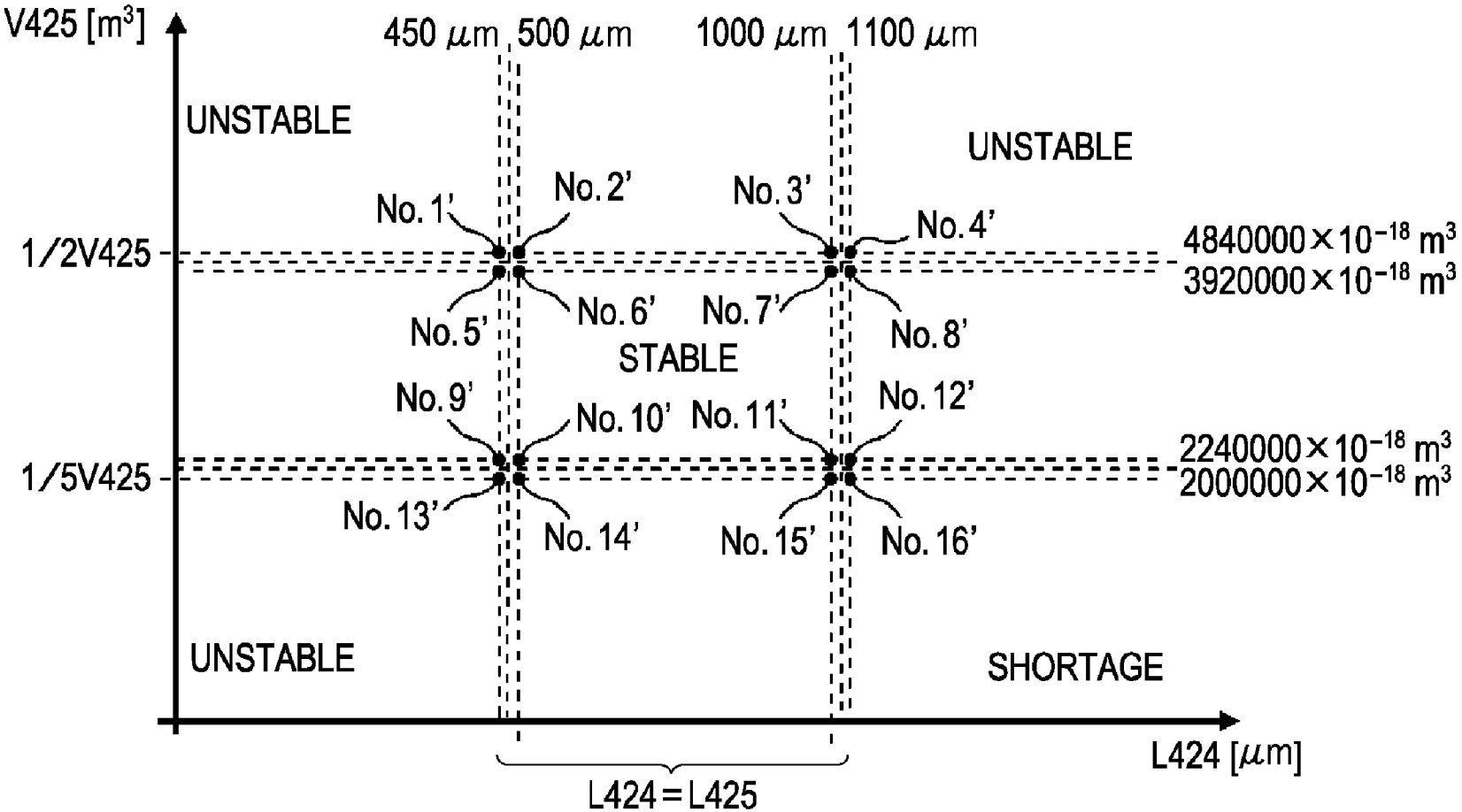
FIG. 37 is a view explaining a parameter in the structure of each head when another ejection pulse is used, according to the first embodiment of the invention.

FIG. 37 is a view explaining a parameter in the structure of each head HD to be evaluated and corresponds to FIG. 7 described above. The structure of the head HD is equal to that described above, but, for convenience, ['] is suffixed to reference numerals with respect to the evaluated result using another ejection pulse PS2. Accordingly, among the heads HD to be evaluated, the heads belonging to the present embodiment are heads HD of No. 6', 7', 10' and 11'. In addition, the residual heads HD are heads of comparative examples.

FIGS. 38 to 53 are views showing the simulation results when the ink having the viscosity of 15 mPa·s is ejected using the heads HD of No. 1' to No. 16'.

As shown in FIGS. 38 to 41, in the heads HD of No. 6', 7', 10' and 11' of the present embodiment, although the ink droplets are ejected with the high frequency of 60 kHz, it can be seen that the ejection amount equal to or greater than the reference amount (10 ng) can be ensured and the ink amount of ink droplets is uniform. Even when another ejection pulse PS2 is used, the ink droplets can be stably ejected by the reference amount or more with the high frequency, similar to the case of using the above-described ejection pulse PS1.

Meanwhile, as shown in FIGS. 42 to 53, in the heads HD of No. 1' to 5', No. 8' to 9', and No. 12' to 16' as the comparative examples, when the ink droplets are ejected with the high frequency, the maximum ejection amount does not reach the reference amount (LV1*a*' to LV5*a*', LV8*a*' to LV9*a*', LV12', LV13*a*', and LV15' to LV16') and the periodical variation occurs in the ejection amount (LV1*b*' to LV5*b*', LV8*b*' to LV9*b*', and LV13*b*').

It may be considered that these results are equal to those of the case where the above-described ejection pulse PS1 is used, although there is a slight difference.

Heads HD of L424=2×L425

In all the above-described heads HD to be evaluated, the length L424 of the pressure chamber 424 was equal to the length L425 of the ink supply path 425. Even in the head HD in which the length L424 of the pressure chamber 424 is twice of the length L425 of the ink supply path 425, the ink having the high viscosity can be similarly ejected. Hereinafter, this will be described.

Figure 54:
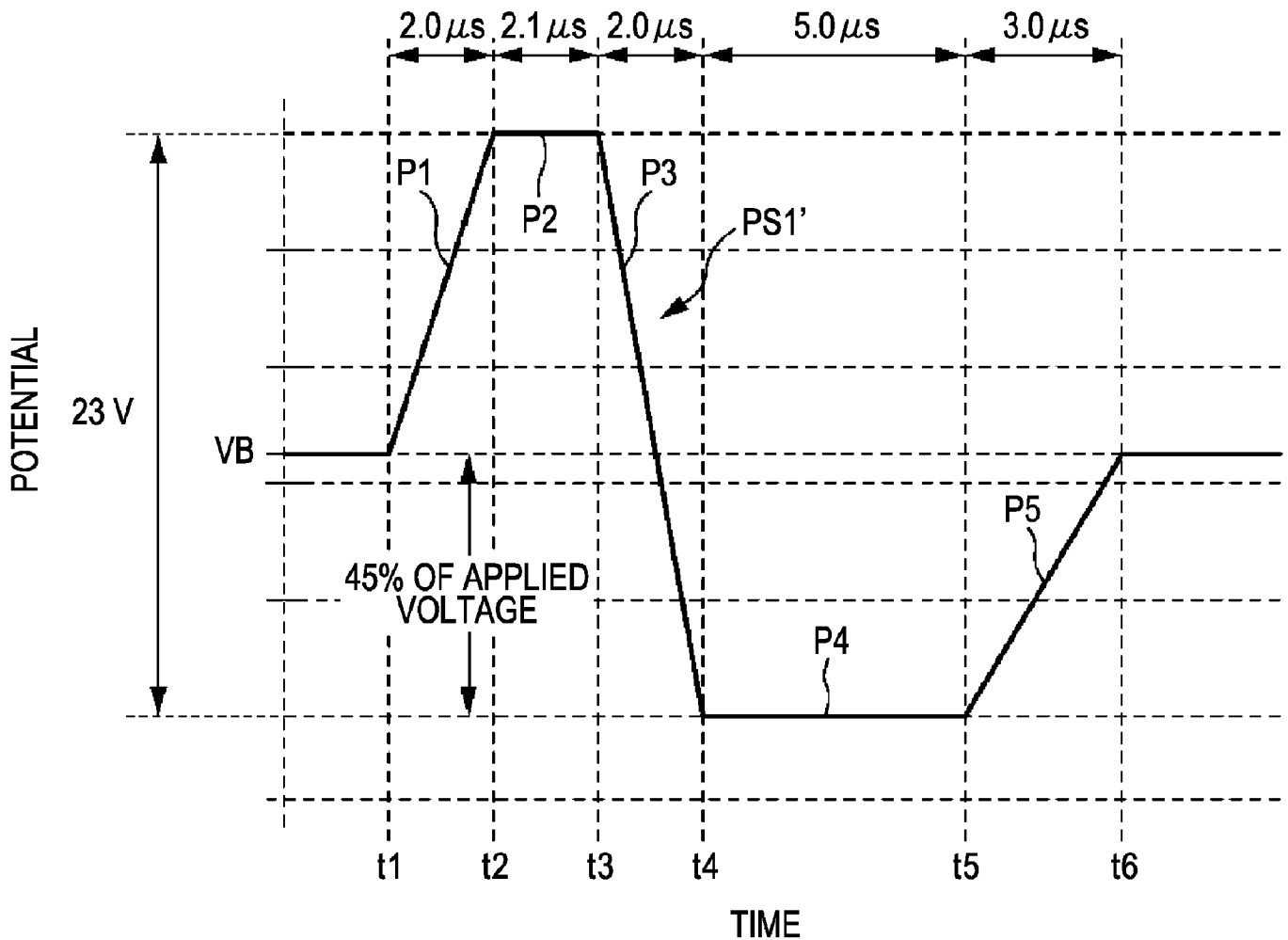
FIG. 54 is a view explaining an ejection pulse used in evaluation.

FIG. 54 is a view explaining the ejection pulse PS1' used for evaluation. This ejection pulse PS1' has a first depressurization portion P1, a first potential holding portion P2, a pressurization portion P3, a second potential holding portion P4, and a second depressurization portion P5, similar to the ejection pulse PS1 of FIG. 6. This ejection pulse is different from the ejection pulse PS1 of FIG. 6 in a difference between the highest potential VH and the lowest potential VL (the applied voltage) and the medium potential VB. That is, the difference between the highest potential VH and the lowest potential VL is set to 23 V. In addition, the medium potential VB is set to a potential higher than the lowest potential VL of the ejection pulse PS1' by 45% of the difference between the highest potential VH and the lowest potential VL. In addition, the functions and the generation periods of the portions of the ejection pulse PS1' are equal to those of the ejection pulse PS1 of FIG. 6. Accordingly, the description thereof will be omitted.

Figure 55:
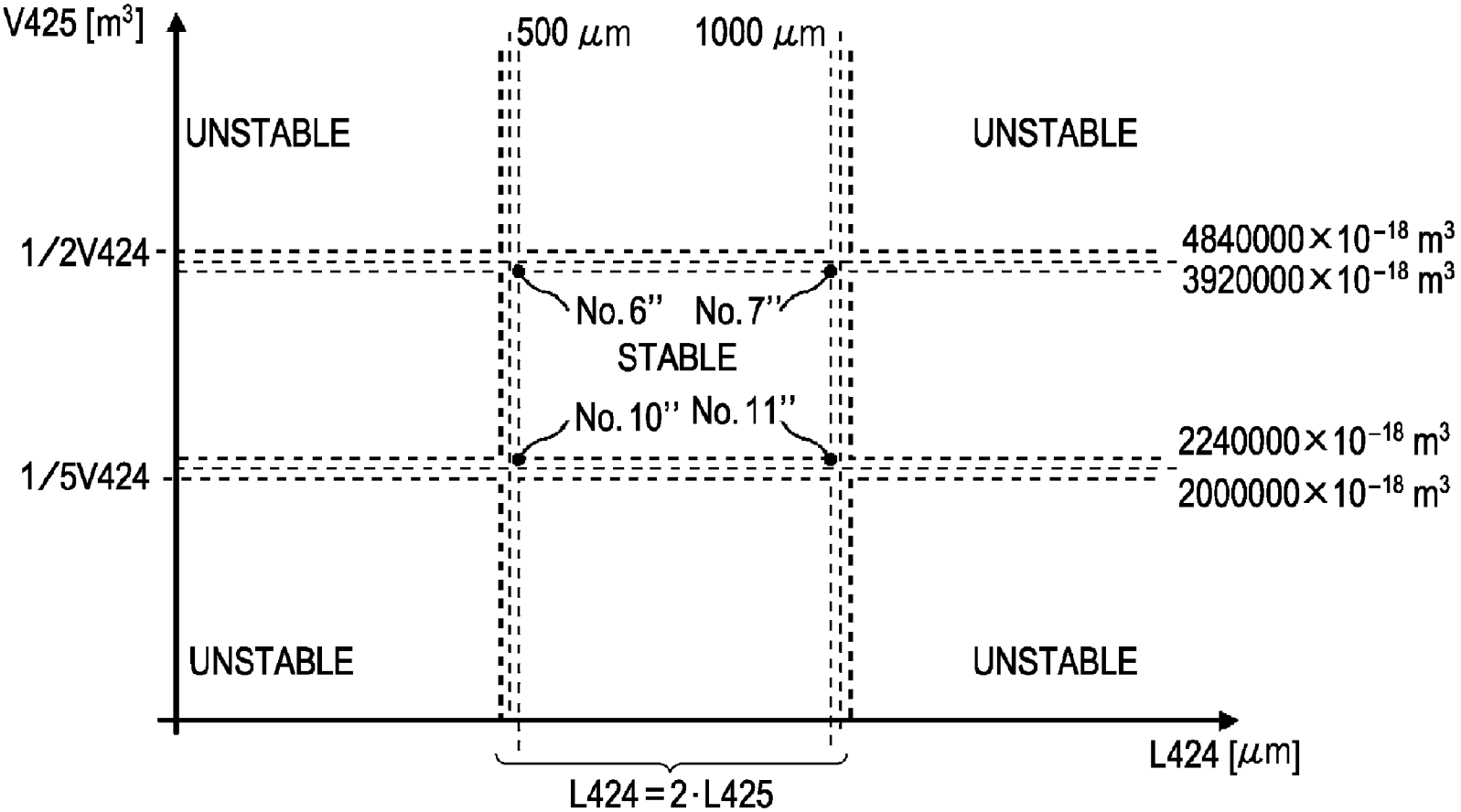
FIG. 55 is a view explaining a parameter in the structure of each head in which the length of a pressure chamber is twice of the length of an ink supply path, according to the first embodiment of the invention.
Figure 56:
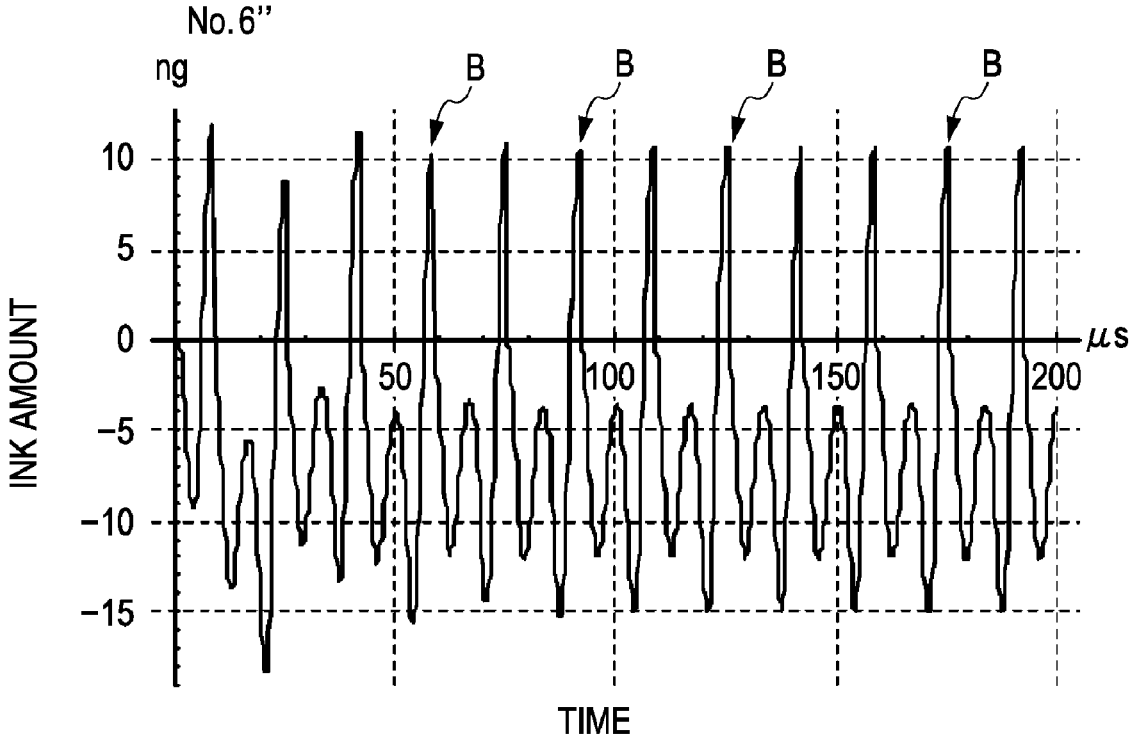
FIG. 56 is a view showing a simulation result at the time of 60-kHz ejection of a head of No. 6".
Figure 57:
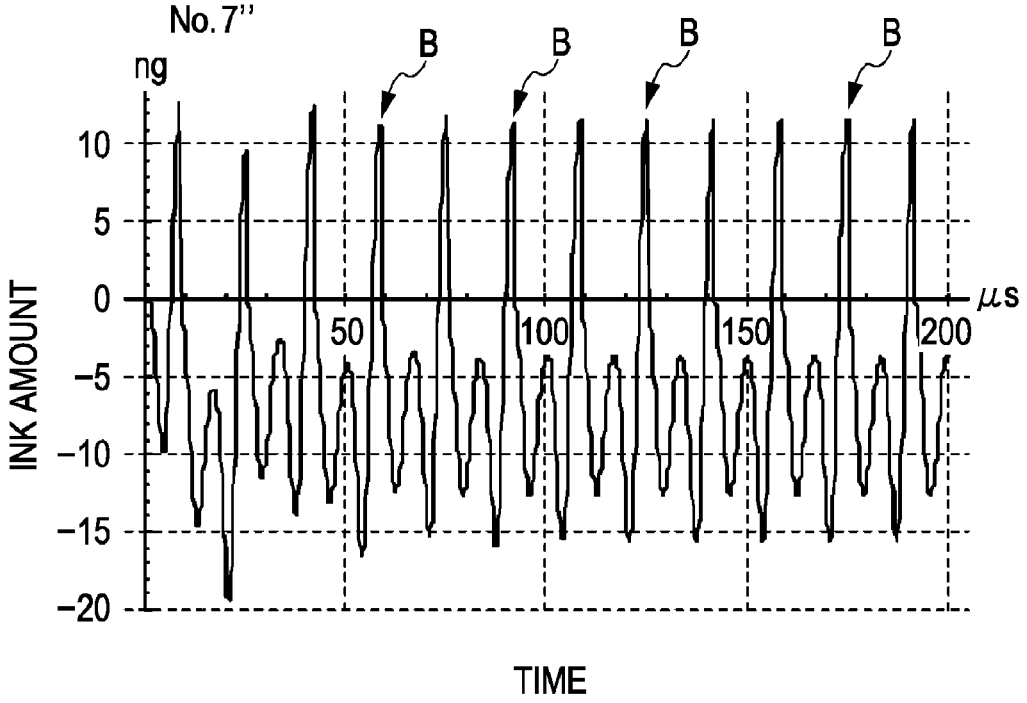
FIG. 57 is a view showing a simulation result at the time of 60-kHz ejection of a head of No. 7".
Figure 58:
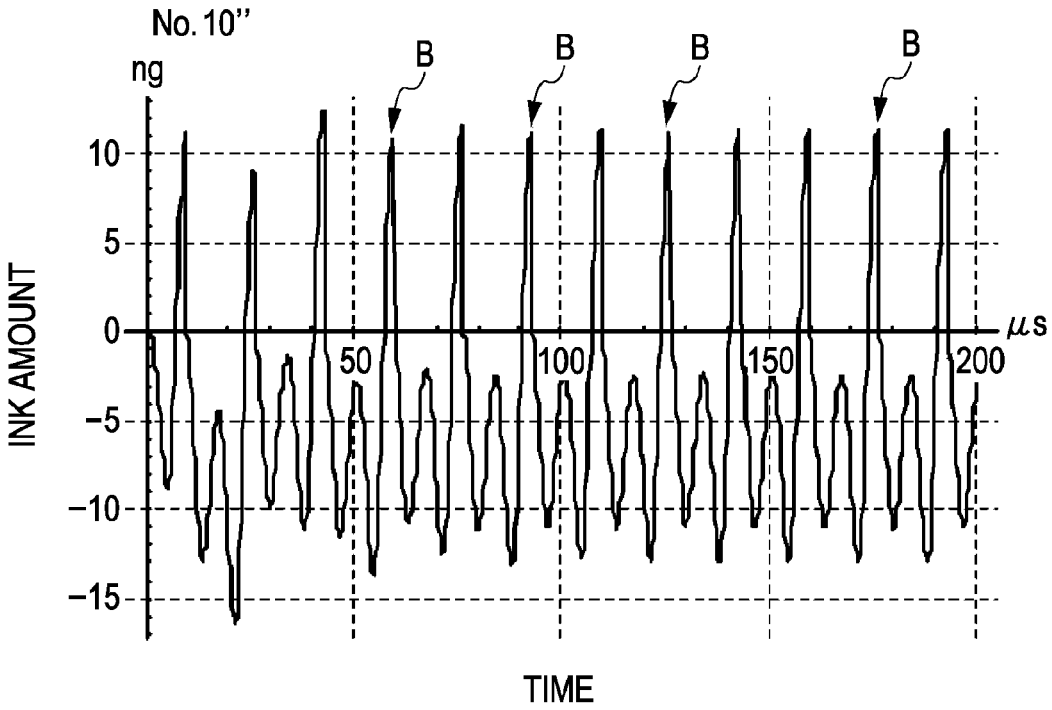
FIG. 58 is a view showing a simulation result at the time of 60-kHz ejection of a head of No. 10".
Figure 59:
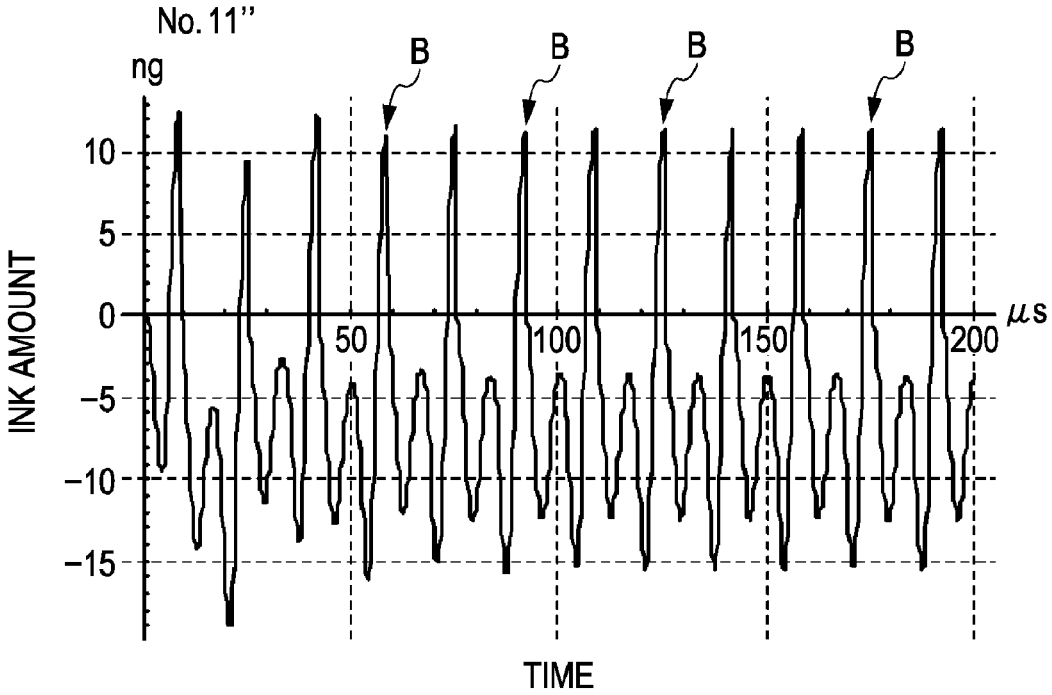
FIG. 59 is a view showing a simulation result at the time of 60-kHz ejection of a head of No. 11".

FIG. 55 is a view explaining a parameter in the structure of each head HD to be evaluated and corresponds to FIG. 7 or 37 described above. For convenience, ["] is suffixed to reference numerals of the heads HD with respect to the evaluated result. Accordingly, the heads belonging to the present embodiment are heads HD of No. 6", 7", 10" and 11". The structures of the heads HD are different from those of the heads HD of FIG. 7 in the length L425 of the ink supply path 425, and, more particularly, in that the length L425 of the ink supply path 425 is ½ of the length L424 of the pressure chamber 424, that is, the length L424 of the pressure chamber 424 is twice of the length L425 of the ink supply path 425. For example, the heads HD (the heads HD of No. 6" and 10") in which the length of the pressure chamber 424 is 500 μm, the length of the ink supply path 425 is 250 μm. Similarly, the heads HD (the heads HD of No. 7" and 11") in which the length of the pressure chamber 424 is 1000 μm, the length of the ink supply path 425 is 500 μm.

As shown in FIGS. 56 to 59, in the heads HD of No. 6", 7", 10" and 11" of the present embodiment, although the ink droplets are elected with the high frequency of 60 kHz, it can be seen that the ejection amount equal to or greater than the reference amount (10 ng) can be ensured and the ink amount of ink droplets is uniform. Even in the head HD in which the length L424 of the pressure chamber 424 is twice of the length L425 of the ink supply path 425, the ink droplets can be stably ejected by the reference amount or more with the high frequency, similar to the heads HD of FIG. 7.

In consideration of the above evaluated result, if the length of the pressure chamber 424 is set in a range from the length L425 of the ink supply path 425 to twice of the length L425 of the ink supply path 425, it can be seen that the above-described evaluation reference is satisfied. By setting the length of the pressure chamber 424 in this range, it may be considered that the flow of the ink from the common ink chamber 426 to the nozzles 427, which occurs due to the continuous ejection of the ink droplets, can be efficiently used. For example, it may be considered that this ink flow can be used for the purpose of aiding the ejection of the ink droplets.

Second Embodiment

As described above, in the heads HD of the second embodiment, the cross-sectional area S425 of the ink supply path 425 is set in a range from ⅓ of the cross-sectional area S424 of the pressure chamber 424 to the cross-sectional area S424. The channel length L424 of the pressure chamber 424 is set in a range from the length L425 of the ink supply path 425 to twice of the length L425. Hereinafter, the evaluated result of the heads HD of the second embodiment will be described. In addition, the ejection pulse PS used for evaluation is the ejection pulse PS1 described in FIG. 6. Accordingly, the description thereof will be omitted.

Ink Having Viscosity of 15 mPa·s

Figure 60:
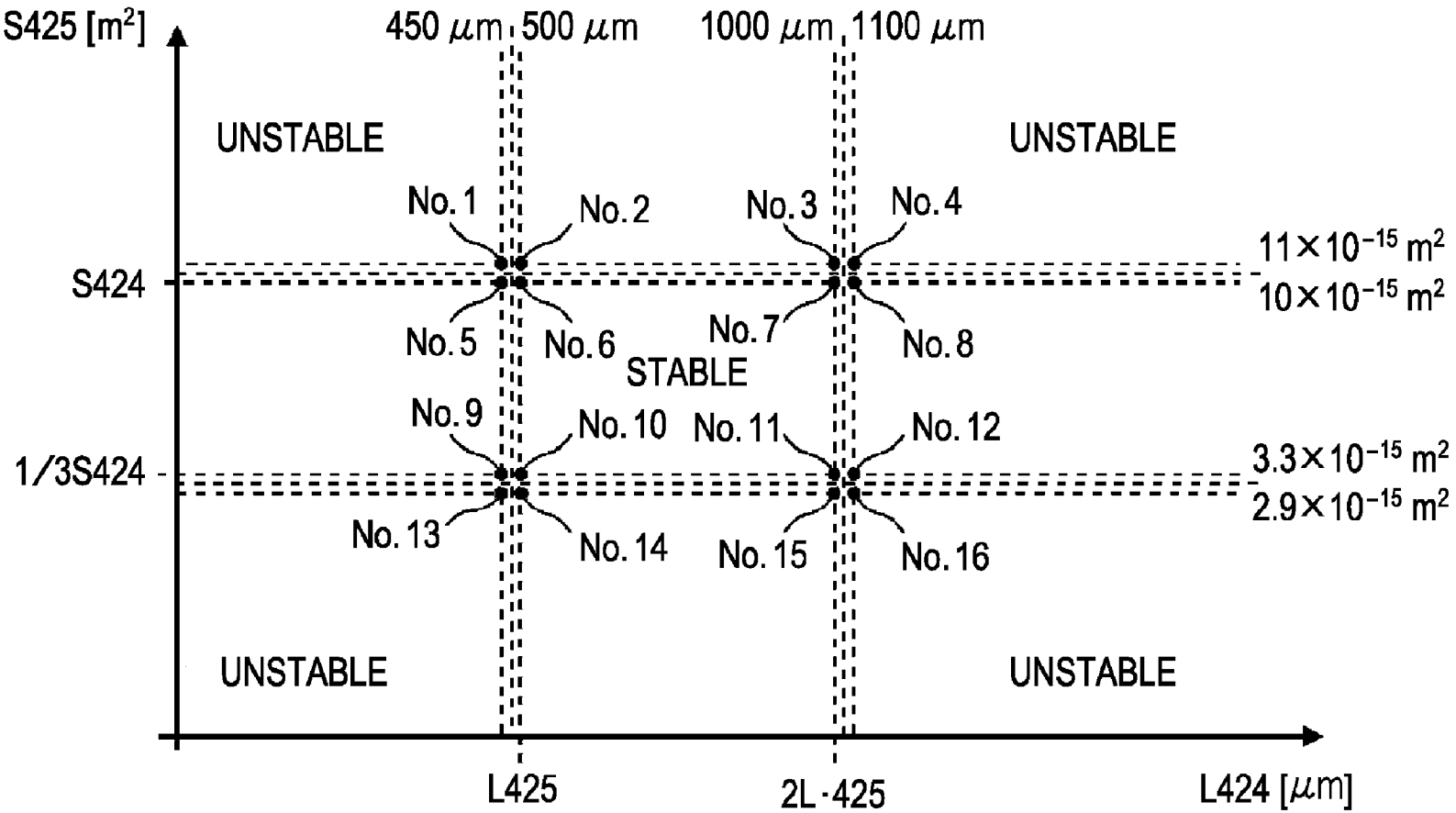
FIG. 60 is a view explaining a parameter in the structure of each head to be evaluated, according to a second embodiment of the invention.

FIG. 60 is a view explaining a parameter in the structure of each head HD to be evaluated. In FIG. 60, a vertical axis denotes the cross-sectional area S425 of the ink supply path 425 and a horizontal axis denotes the length L424 of the pressure chamber 424. In addition, points No. 1 to No. 16 denote the heads HD which are subjected to simulation for continuously ejecting the ink having viscosity 15 mPa·s. For example, the head HD of No. 1 has the cross-sectional area S425 of the ink supply path 425 of $11\times10^{-15}$ $m^2$ and the length L424 of the pressure chamber 424 of 450 μm. In addition, the head HD of No. 16 has the cross-sectional area S425 of the ink supply path 425 of $2.9\times10^{-15}$ $m^2$ and the length L424 of the pressure chamber 424 of 1100 μm.

Other values used in the simulation are as follows. First, in the heads HD (heads HD of No. 1 to No. 16) to be evaluated, the height H424 of the pressure chamber 424 is 80 μm and the cross-sectional area S424 thereof is $10\times10^{-15}$ $m^2$. In addition, the depth H425 of the ink supply path 425 is 80 μm and the length L425 thereof is 500 μm. The shape of each of the nozzles 427 is equal to that of the first embodiment.

Among the heads HD to be evaluated, the heads of the present embodiment are the heads HD of No. 6, 7, 10 and 11. In addition, the other heads HD are the heads of comparative examples. Hereinafter, the simulation result of these heads HD will be described.

Head HD of No. 6

In the head HD of No. 6, the length L424 of the pressure chamber 424 is 500 μm and the cross-sectional area S425 of the ink supply path 425 is $10\times10^{-15}$ $m^2$. That is, the cross-sectional area S425 of the ink supply path 425 is equal to the cross-sectional area S424 of the pressure chamber 424.

Figure 61:
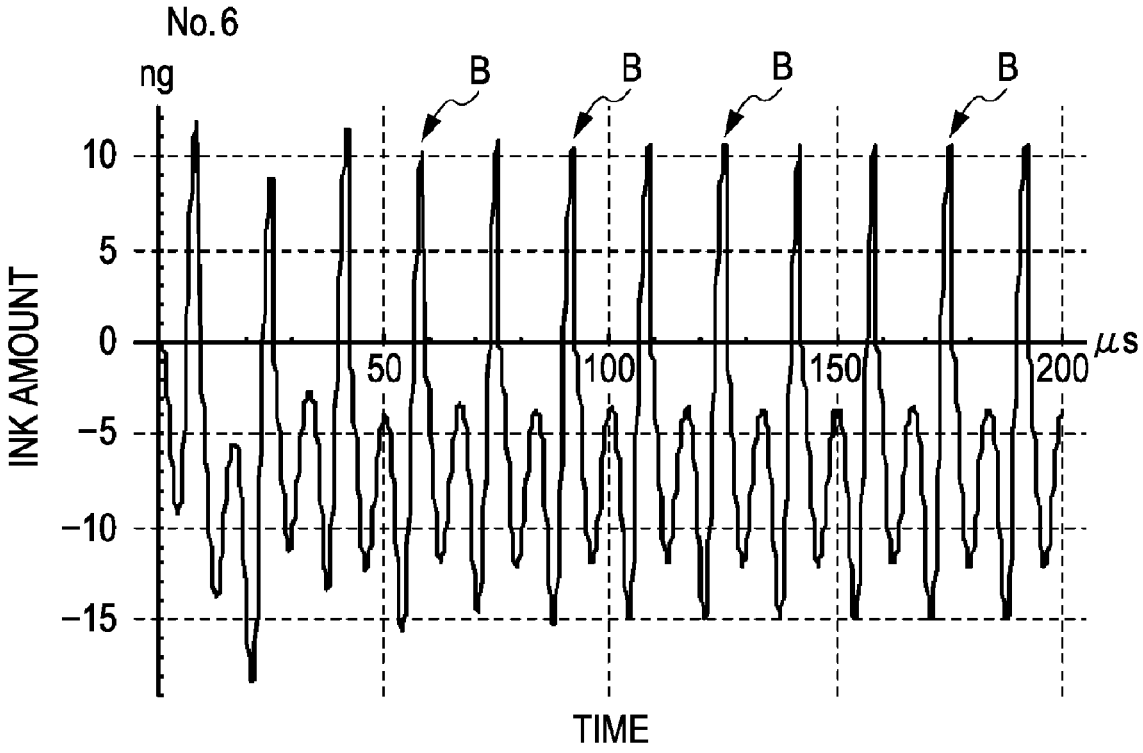
FIG. 61 is a view showing a simulation result at the time of 60-kHz ejection of a head of No. 6.

FIG. 61 is a view showing a simulation result at the time of continuous ejection of the ink droplets by the head HD of No. 6, that is, a simulation result when the ink droplets are ejected with a frequency of 60 kHz using the ejection pulse PS1 of FIG. 6. In the head HD of No. 6, the ink droplets in the fourth ink droplet and later ink droplets are stably ejected by the amount of about 10.5 ng. Accordingly, it may be considered that the head HD of No. 6 satisfies the above-described evaluation reference.

Head HD of No. 7

In the head HD of No. 7, the length L424 of the pressure chamber 424 is 1000 μm. In addition, the cross-sectional area S425 of the ink supply path 425 is $10\times10^{-15}$ $m^2$. This is similar to the head HD of No. 6 in that the cross-sectional area S425 of the ink supply path 425 is equal to the cross-sectional area S424 of the pressure chamber 424. In contrast, this is different from the head HD of No. 6 in that the length L424 of the pressure chamber 424 is 1000 μm, and is twice of the length L425 of the ink supply path 425.

Figure 62:
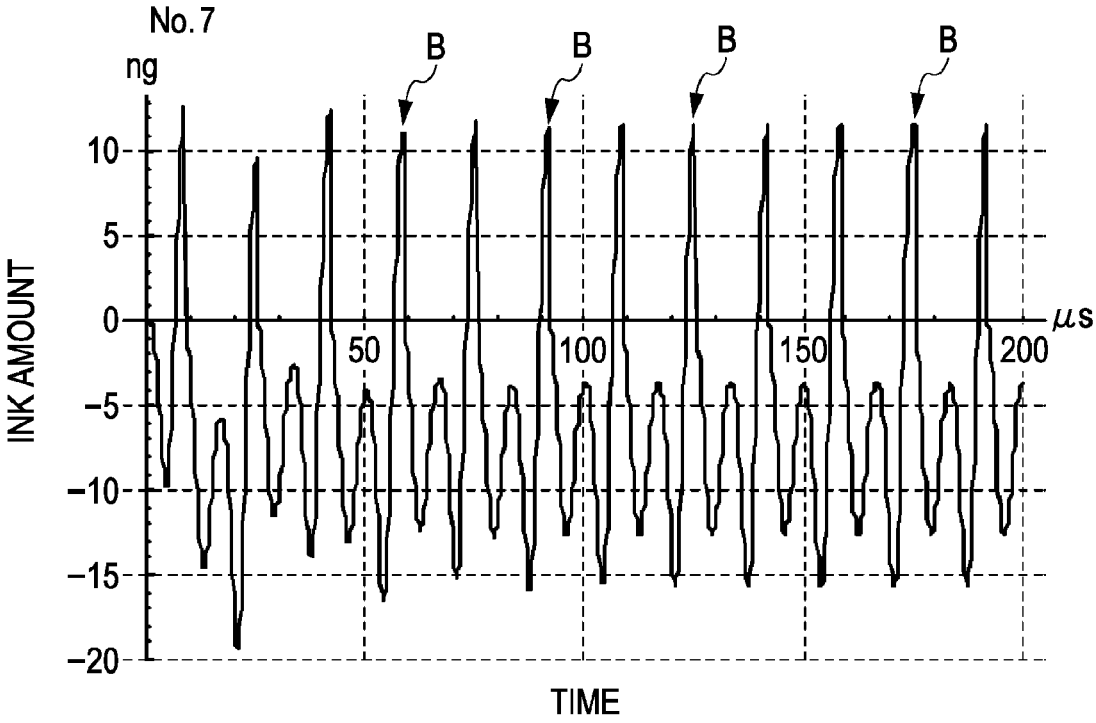
FIG. 62 is a view showing a simulation result at the time of 60-kHz ejection of a head of No. 7.

FIG. 62 is a view showing a simulation result at the time of continuous ejection of the ink droplets by the head HD of No. 7. In the head HD of No. 7, the ink droplets in the fourth ink droplet and later ink droplets are stably ejected by the amount of about 11.5 ng. Accordingly, it may be considered that the head HD of No. 7 satisfies the above-described evaluation reference.

Head HD of No. 10

In the head HD of No. 10, the length 424 of the pressure chamber 424 is 500 μm and the cross-sectional area S425 of the ink supply path 425 is $3.3\times10^{-15}$ $m^2$. This is similar to the head HD of No. 6 in that the length S424 of the pressure chamber 424 is equal to the length L425 of the ink supply path 425. In contrast, this is different from the head HD of No. 6 in that the cross-sectional area S425 of the ink supply path 425 is substantially ⅓ of the cross-sectional area S424 of the pressure chamber 424.

Figure 63:
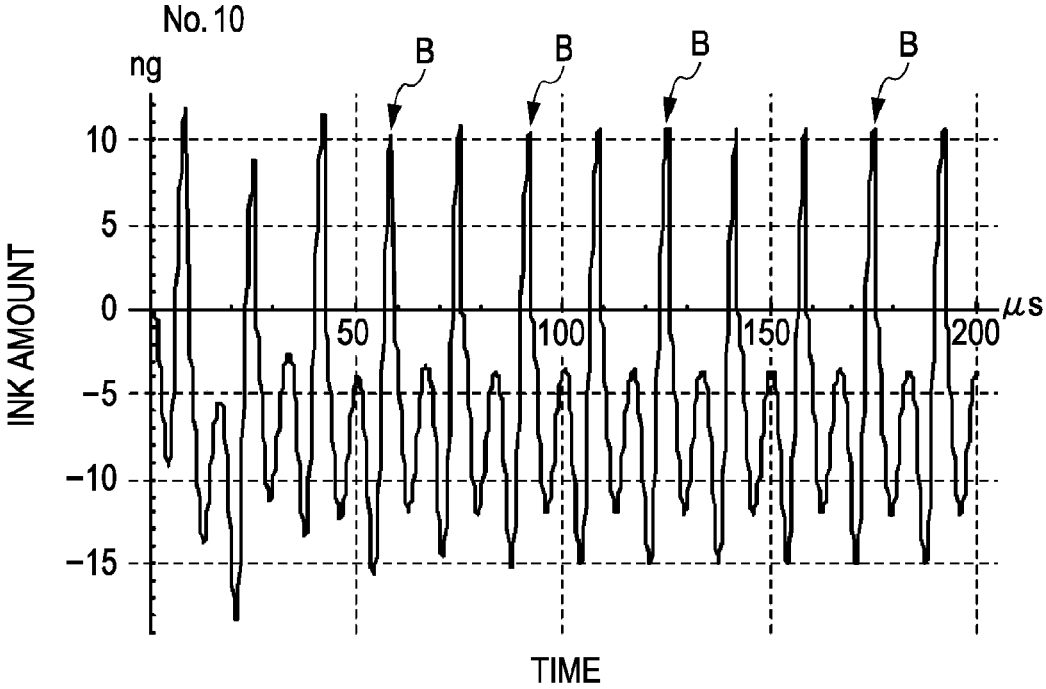
FIG. 63 is a view showing a simulation result at the time of 60-kHz ejection of a head of No. 10.

FIG. 63 is a view showing a simulation result at the time of continuous ejection of the ink droplets by the head HD of No. 10. In the head HD of No. 10, the ink droplets in the fourth ink droplet and later ink droplets are stably ejected by the amount of about 10.5 ng. Accordingly, it may be considered that the head HD of No. 10 satisfies the above-described evaluation reference.

Head HD of No. 11

In the head HD of No. 11, the length L424 of the pressure chamber 424 is 1000 μm and the cross-sectional area S425 of the ink supply path 425 is $3.3\times10^{-15}$ $m^2$. This is different from the head HD of No. 6 in that the length L424 of the pressure chamber 424 is 1000 μm and is twice of the length L425 of the ink supply path 425, and the cross-sectional area S425 of the ink supply path 425 is substantially ⅓ of the cross-sectional area S424 of the pressure chamber 424.

Figure 64:
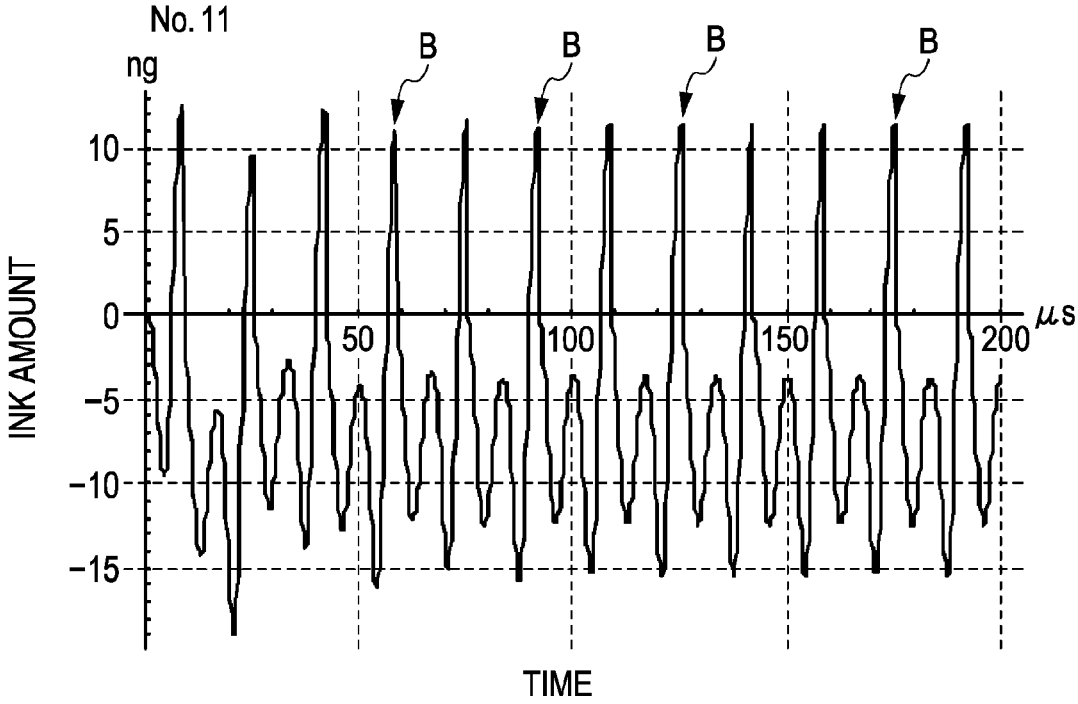
FIG. 64 is a view showing a simulation result at the time of 60-kHz ejection of a head of No. 11.

FIG. 64 is a view showing a simulation result at the time of continuous ejection of the ink droplets by the head HD of No. 11. In the head HD of No. 11, the ink droplets in the fourth ink droplet and later ink droplets are stably ejected by the amount slightly exceeding 11 ng. Accordingly, it my be considered that the head HD of No. 11 satisfies the above-described evaluation reference.

Conclusion

As described above, it can be seen that the heads HD of No. 6, 7, 10 and 11 satisfy the above-described evaluation reference. That is, in the head HD in which the length L424 of the pressure chamber 424 is set in the range from the length L425 of the ink supply path 425 to twice of the length L425 of the ink supply path 425, it can be seen that the evaluation reference is satisfied when the cross-sectional area S425 of the ink supply path 425 is set in the range from ⅓ of the cross-sectional area S424 of the pressure chamber 424 to the cross-sectional area S424. In more detail, when the length L424 of the pressure chamber 424 is set in a range from 500 μm to 1000 μm and the cross-sectional area S425 of the ink supply path 425 is set in a range from $3.3\times10^{-15}$ $m^2$ to $10\times10^{-15}$ $m^2$, it can be seen that the amount of 10 ng or more can be ensured although the ink having the viscosity of 15 mPa·s is ejected with the frequency of 60 kHz.

In these heads HD, since the cross-sectional area S425 (opening size) of the ink supply path 425 is determined from the relationship with the cross-sectional area S424 of the pressure chamber 424, it is considered that the amount of ink flowing in the ink supply path 425 is properly adjusted. The cross-sectional area S425 of the ink supply path 425 is equal to the cross-sectional area S424 of the pressure chamber 424 at the maximum. Accordingly, if the ink flows in the ink supply path 425, it is considered that the confusion of the flow of the ink in the ink supply path 425 is suppressed. In addition, since the length L424 of the pressure chamber 424 is determined in a predetermined range, the flow of the ink from the common ink chamber 426 to the nozzles 427, which occurs due to the continuous ejection of the ink droplets, can be used and thus the shortage of the supply of the ink in the pressure chamber 424 is suppressed. From these reasons, it is considered that the ejection can be stabilized at the time of the continuous ejection of the ink droplets.

Channel Resistance

In the heads HD of the second embodiment, although the channel resistance of the ink supply path 425 may be equal to that of the pressure chamber 424, it is more preferable that the channel resistance of the ink supply path 425 is larger than that of the pressure chamber 424. By this configuration, the residual vibration of the ink contained in the pressure chamber 424 after the ejection of the ink droplets can be suppressed at an early stage.

Relationship with Nozzles 427

In the heads HD of the second embodiment, similar to the heads HD of the first embodiment, the shape of the nozzles 427 may have an influence on the ejection of the ink droplets. For example, it is preferable that the channel resistance of the nozzles 427 is higher than the channel resistance of the ink supply path 425. This is because the shortage of the supply of the ink to the pressure chamber 424 is suppressed with certainty. In addition, it is preferable that the inertance of the nozzles 427 is smaller than that of the ink supply path 425. Accordingly, the pressure variation applied to the ink contained in the pressure chamber 424 can be efficiently used for the ejection of the ink droplets.

COMPARATIVE EXAMPLES

Next, the heads of comparative examples will be described. The heads of the comparative examples are heads HD of No. 1 to 5, No. 8 to 9, No. 12 to 16 of FIG. 60. Among these heads HD, in the heads HD of No. 1 to No. 4, the cross-sectional area S425 of the ink supply path 425 is more than the cross-sectional area S424 of the pressure chamber 424 and, more particularly, is set to $11\times10^{-15}$ m$^2$. In the heads HD of No. 13 to No. 16, the cross-sectional area S425 of the ink supply path 425 is less than ⅓ of the cross-sectional area S424 of the pressure chamber 424 and, more particularly, is set to $2.9\times10^{-15}$ m$^2$. In the heads HD of No. 1, 5, 9 and 13, the length L424 of the pressure chamber 424 is set to be shorter than the length L425 of the ink supply path 425 and, more particularly, is set to 450 μm which is shorter than 500 μm by 50 μm. In the heads HD of No. 4, 8, 12 and 16, the length L424 of the pressure chamber 424 is set to be longer than twice of the length L425 of the ink supply path 425 and, more particularly, is set to 1100 μm which is longer than twice of 500 μm by 100 μm.

Heads HD of S425>S424

Figure 65:
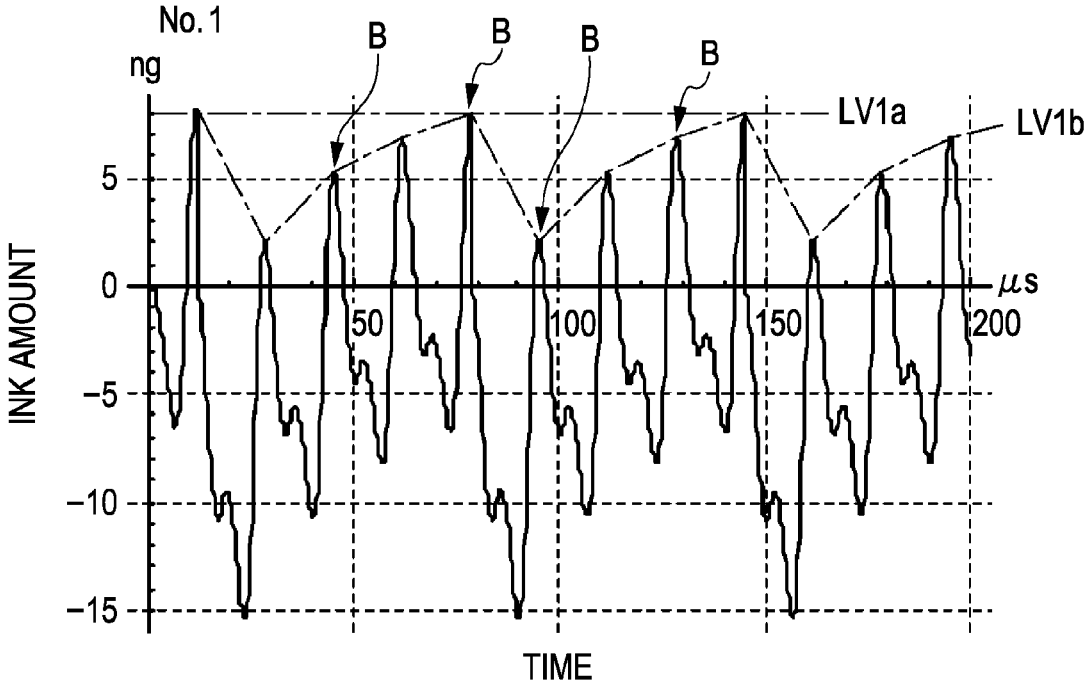
FIG. 65 is a view showing a simulation result at the time of 60-kHz ejection of a head of No. 1.
Figure 66:
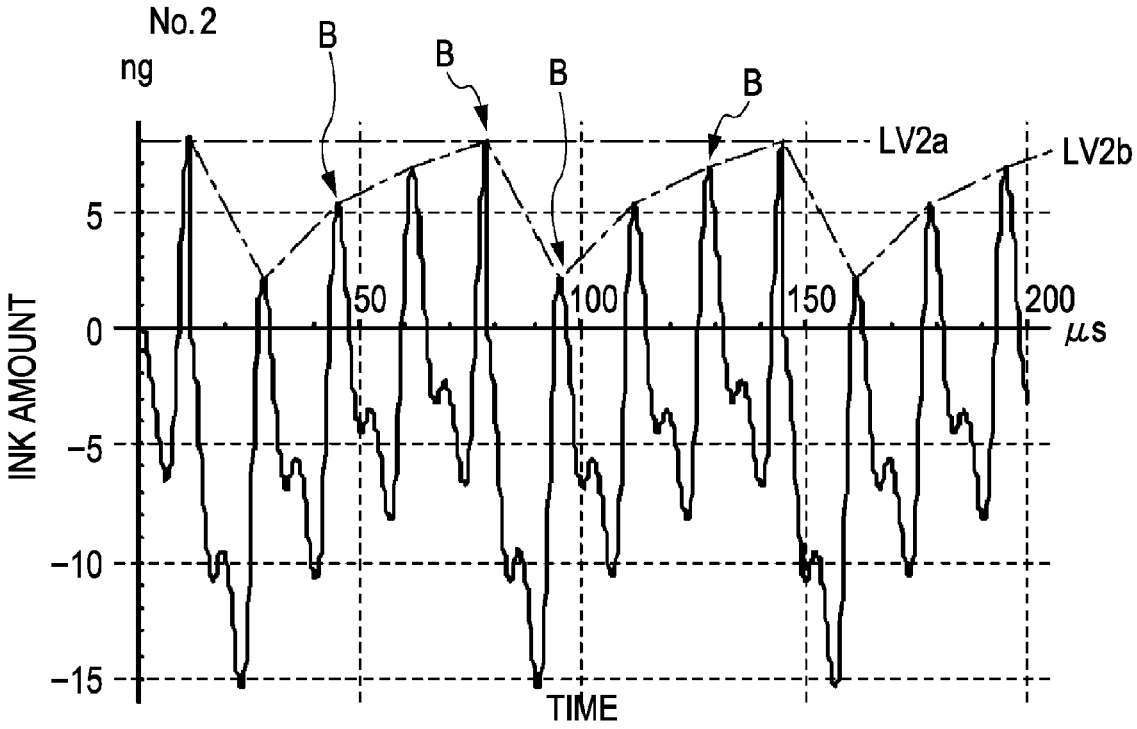
FIG. 66 is a view showing a simulation result at the time of 60-kHz ejection of a head of No. 2.
Figure 67:
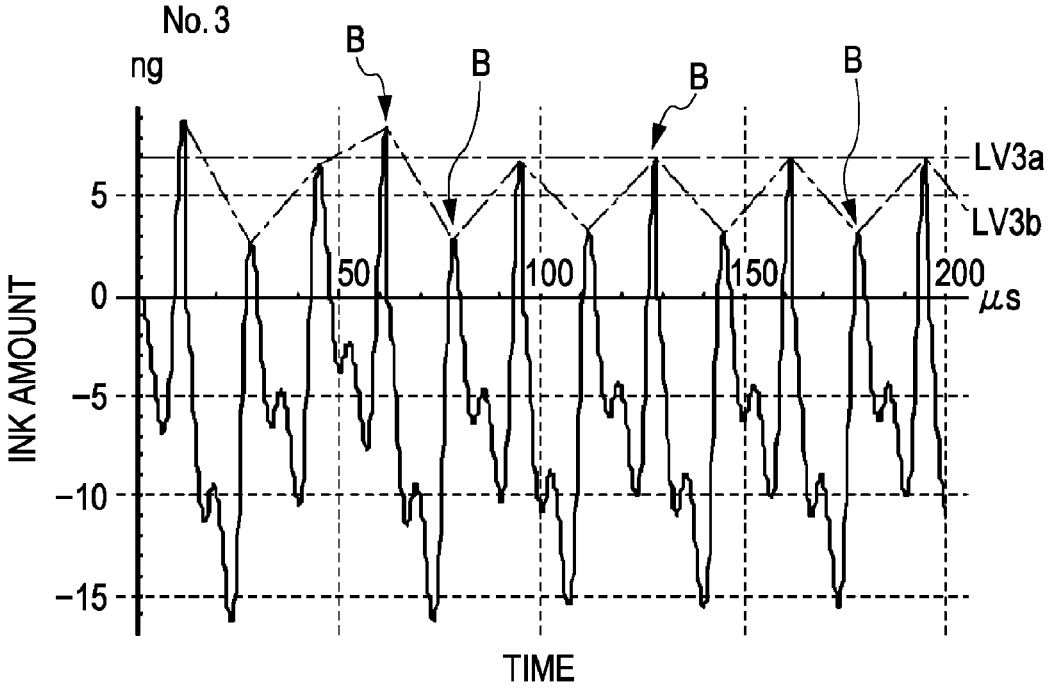
FIG. 67 is a view showing a simulation result at the time of 60-kHz ejection of a head of No. 3.
Figure 68:
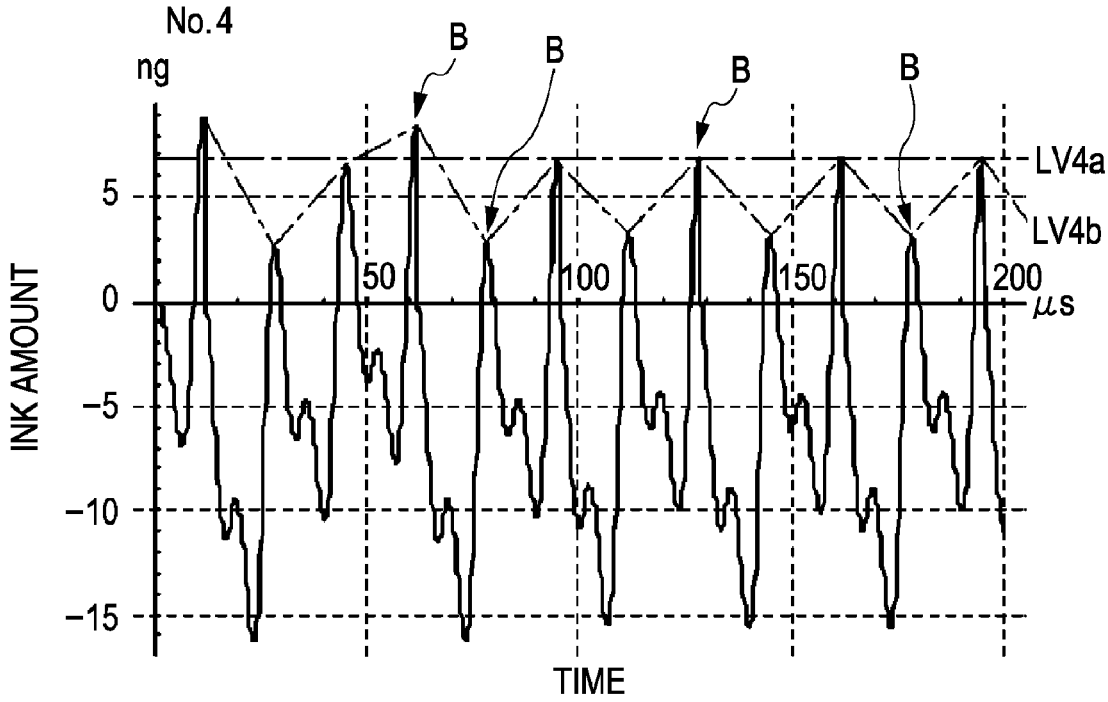
FIG. 68 is a view showing a simulation result at the time of 60-kHz ejection of a head of No. 4.

As shown in FIG. 65 (the head HD of No. 1) to FIG. 68 (the head HD of No. 4), in these heads HD, the amount of ink droplets is smaller than the reference value (10 ng). For example, if the maximum ejection amount is compared with respect to the ink droplets in the fourth ink droplet and later ink droplets, the ejection amount of the heads HD of No. 1 and No. 2 is about 8 ng (LV1*a*, LV2*a*). In addition, the ejection amount of the heads HD of No. 3 and No. 4 is about 7 ng, which is slightly insufficient (LV3*a* and LV4*a*). In the heads HD, the ejection amount is unstable. That is, the periodical variation of the ejection amount occurs For example, in the heads HD of No. 1 and 2, as denoted by lines of the reference numerals LV1*b* and LV2*b*, four types of ink droplets are repeatedly ejected from a minimum amount of ink droplets to a maximum amount of ink droplets. Similarly, in the heads HD of No. 3 and 4, as denoted by lines of the reference numerals LV3*b* and LV4*b*, two types of ink droplets which are different in the amount are alternately ejected.

Heads HD of S425<⅓×S424

Figure 73:
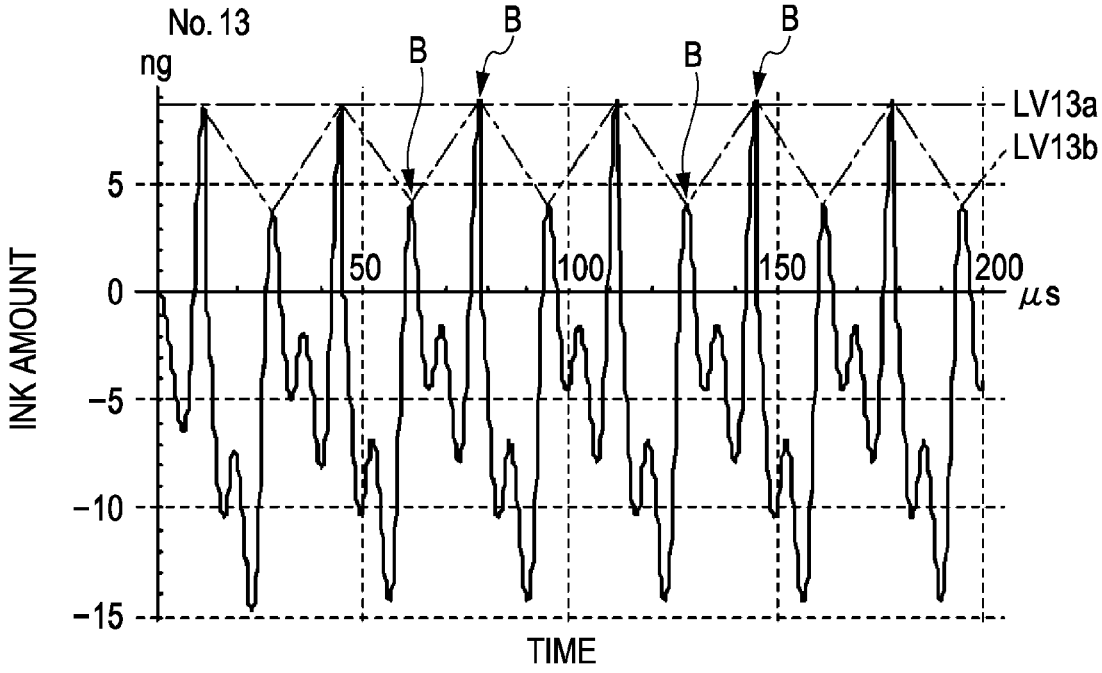
FIG. 73 is a view showing a simulation result at the time of 60-kHz ejection of a head of No. 13.
Figure 74:
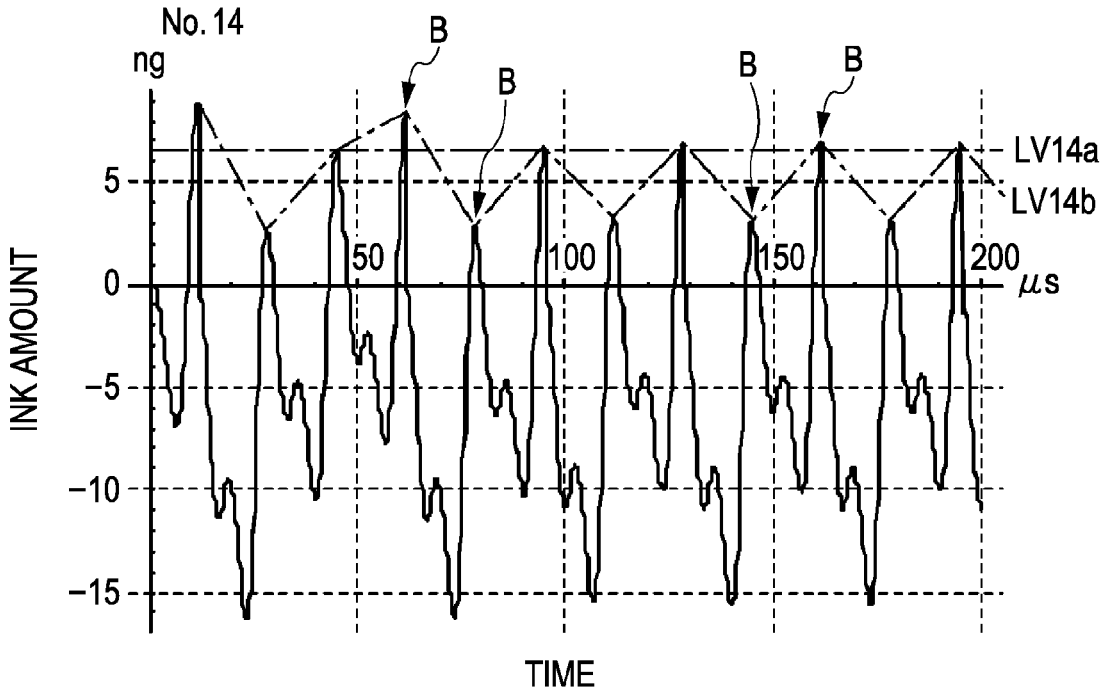
FIG. 74 is a view showing a simulation result at the time of 60-kHz ejection of a head of No. 14.
Figure 75:
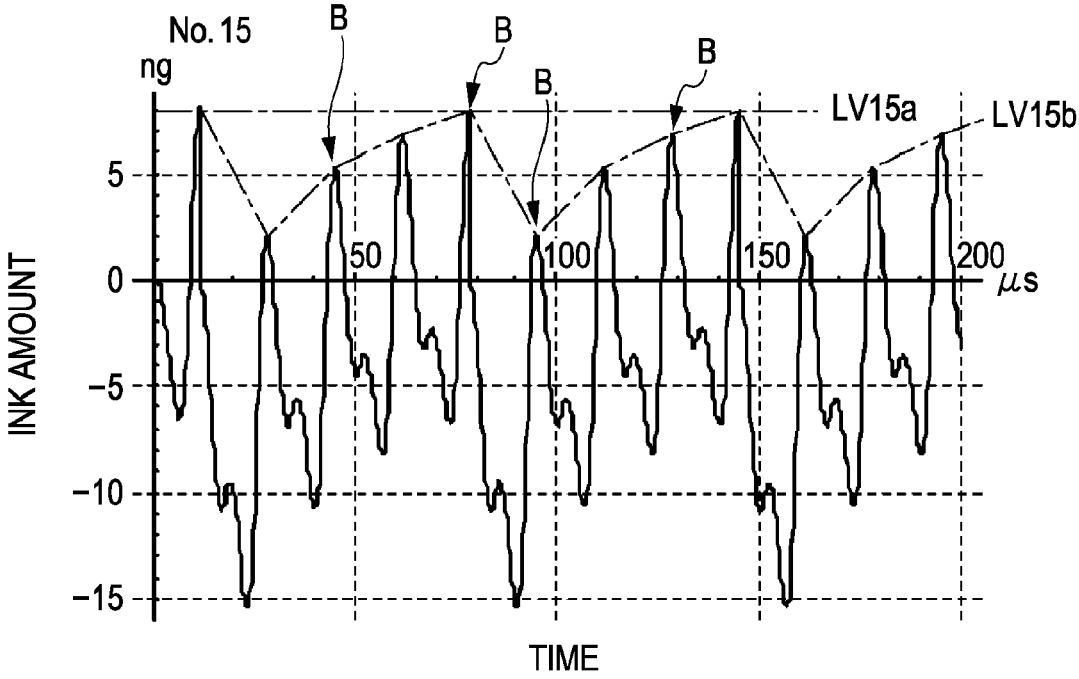
FIG. 75 is a view showing a simulation result at the time of 60-kHz ejection of a head of No. 15.
Figure 76:
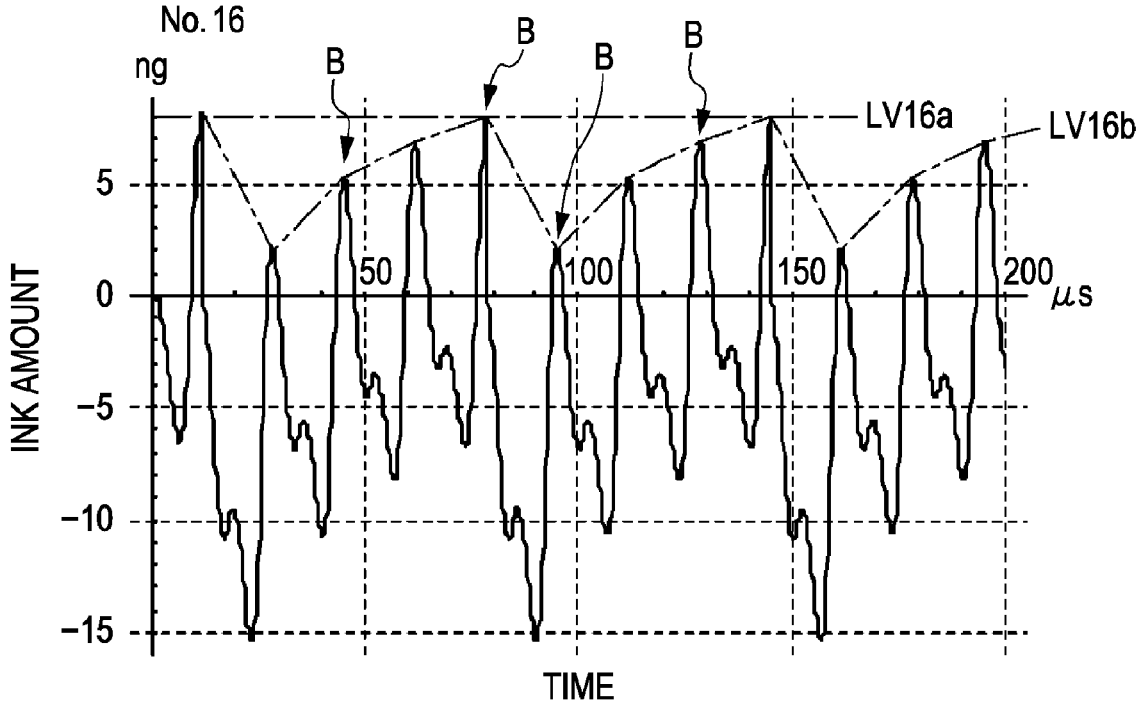
FIG. 76 is a view showing a simulation result at the time of 60-kHz ejection of a head of No. 16.

As shown in FIG. 73 (the head HD of No. 13) to FIG. 76 (the head HD of No. 16), in these heads HD, the amount of ink droplets is smaller than the reference value. For example, if the maximum ejection amount is compared with respect to the ink droplets in the fourth ink droplet and later ink droplets, the ejection amount of the head HD of No. 13 is about 8.8 ng (LV13*a*) and the ejection amount of the head HD of No. 14 is about 6.5 ng (LV14*a*). In addition, the ejection amount of the head HD of No. 15 and the head HD of No. 16 is about 8 ng (LV15*a* and LV16*a*). In addition, in the heads HD, the ejection amount is unstable, For example, in the heads HD of No. 13 and No. 14, as denoted by lines of the reference numerals LV13*b* and LV14*b*, two types of ink droplets which are different in the amount are alternately ejected. Similarly, in the heads HD of No. 15 and 16, as denoted by lines of the reference numerals LV15*b* and LV16*b*, four types of ink droplets are repeatedly ejected from a minimum amount of ink droplets to a maximum amount of ink droplets.

Heads HD of L424<L425

Figure 69:
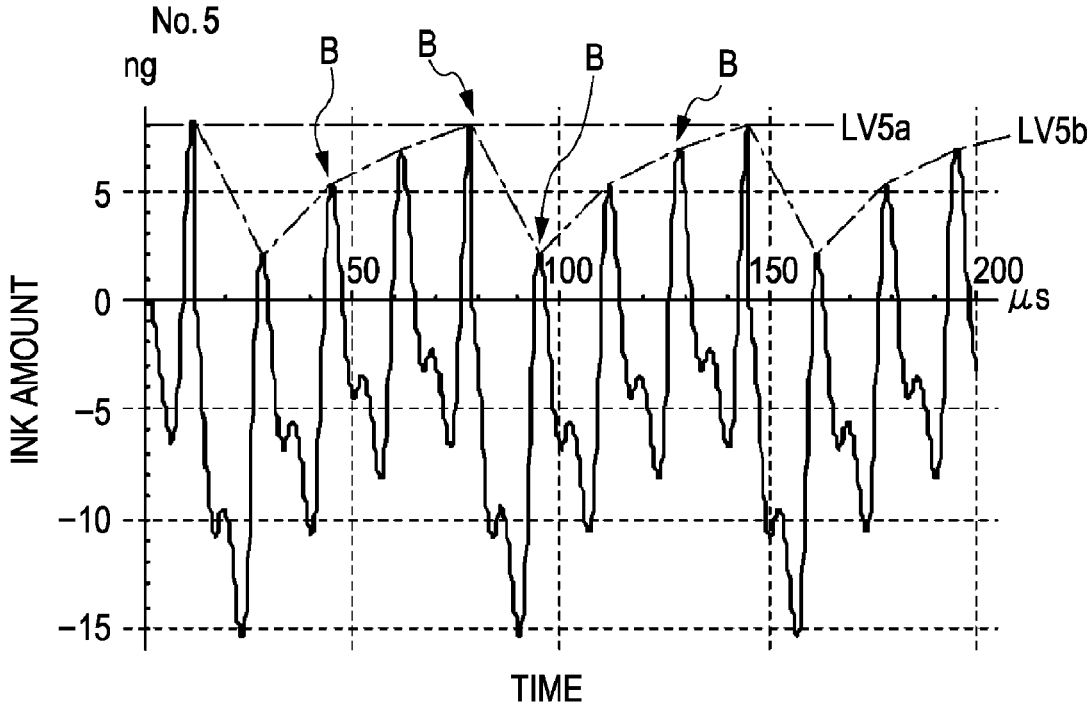
FIG. 69 is a view showing a simulation result at the time of 60-kHz ejection of a head of No. 5
Figure 71:
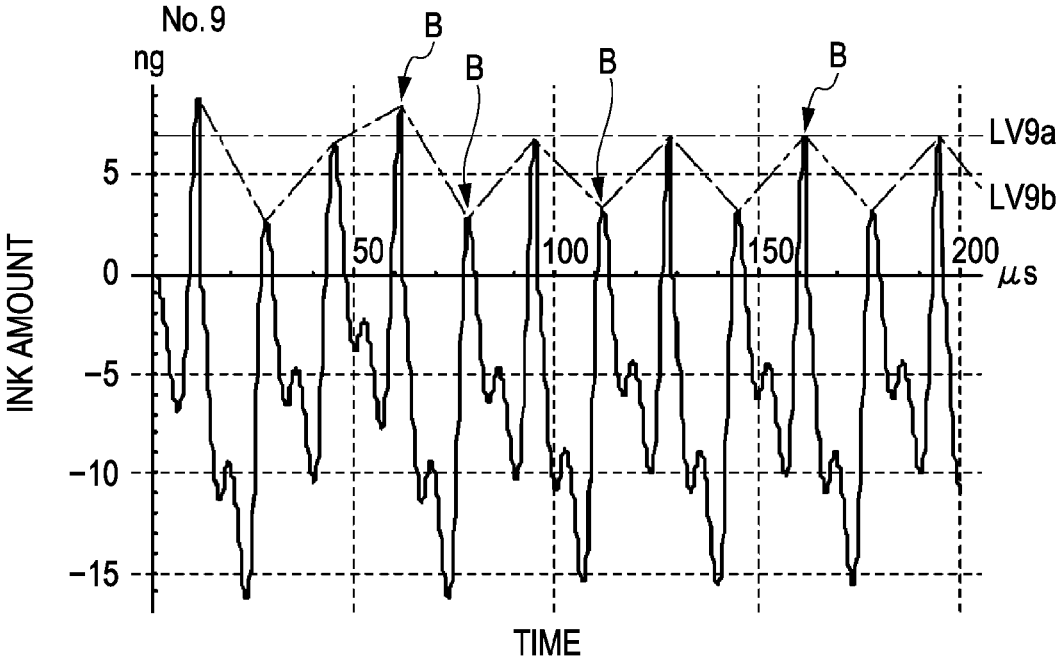
FIG. 71 is a view showing a simulation result at the time of 60-kHz ejection of a head of No. 9.

As shown in FIG. 65 (the head HD of No. 1), FIG. 69 (the head HD of No. 5), FIG. 71 (the head HD of No. 9) and FIG. 73 (the head HD of No. 13), in these heads HD, the amount of ink droplets is smaller than the reference value. For example, if the maximum ejection amount is compared with respect to the ink droplets in the fourth ink droplet and later ink droplets, the ejection amount of the heads HD of No. 1 and No. 5 is about 8 ng (LV1*a* and LV5*a*). In addition, the ejection amount of the head HD of No. 9 is about 7 ng (LV9*a*), and the ejection amount of the head HD of No. 13 is about 8.8 ng (LV13*a*). That is, the periodical variation of the ejection amount occurs in the heads HD. For example, in the heads HD of No. 1 and No. 5, as denoted by lines of the reference numerals LV1*b* and LV5*b*, four types of ink droplets are repeatedly ejected from a minimum amount of ink droplets to a maximum amount of ink droplets. In addition, in the heads HD of No. 9 and No. 13, as denoted by lines of the reference numerals LV9*b* and LV13*b*, two type of ink droplets which are different in the amount are alternately ejected.

Heads HD of L424>2×L425

Figure 70:
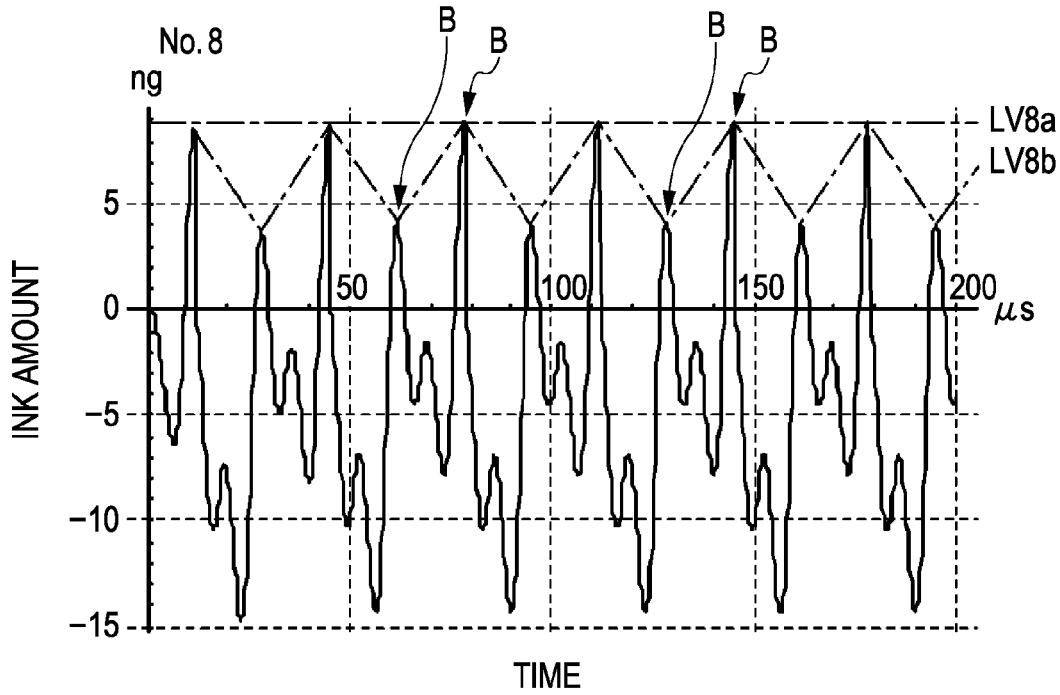
FIG. 70 is a view showing a simulation result at the time of 60-kHz ejection of a head of No. 8.
Figure 72:
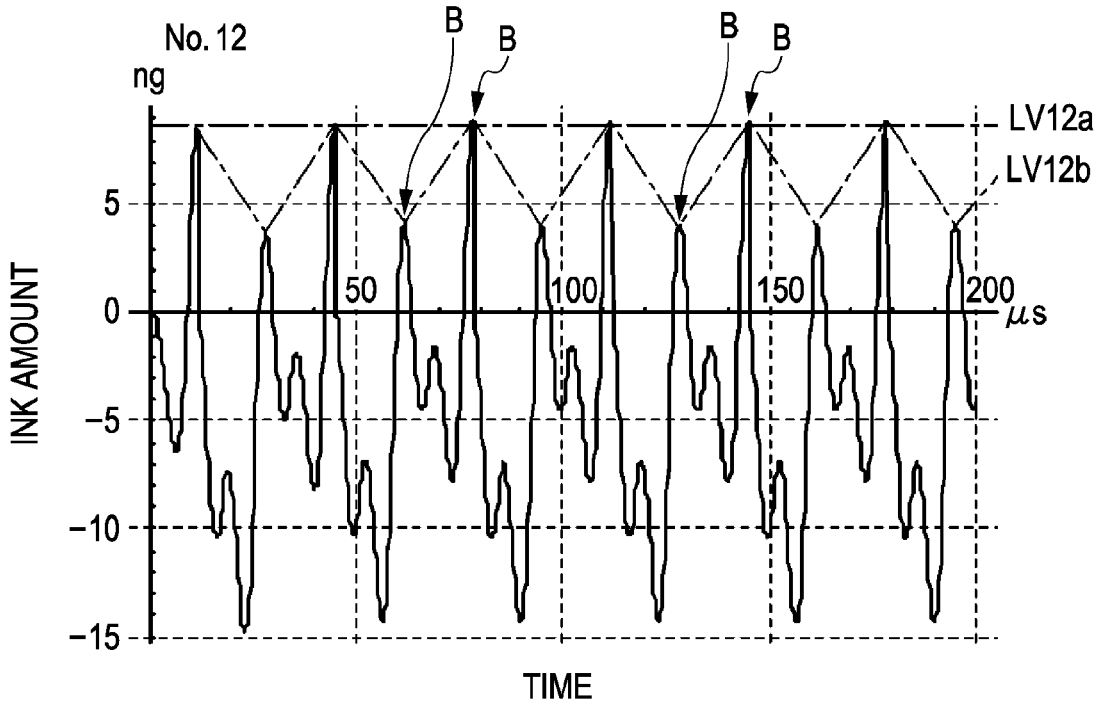
FIG. 72 is a view showing a simulation result at the time of 60-kHz ejection of a head of No. 12.

As shown in FIG. 68 (the head HD of No. 4), FIG. 70 (the head HD of No. 8), FIG. 72 (the head HD of No. 12) and FIG. 76 (the head HD of No. 16), in these heads HD, the amount of ink droplets is smaller than the reference value. For example, if the maximum ejection amount is compared with respect to the ink droplets in the fourth ink droplet and later ink droplets, the ejection amount of the head HD of No. 4 is about 7 ng which is slightly insufficient (LV4*a*) and the ejection amount of the head HD of No. 8 is about 9 ng which is slightly insufficient (LV8*a*). In addition, the ejection amount of the head HD of No. 12 is about 8.8 ng (LV12*a*) and the ejection amount of the head HD of No. 16 is about 8 ng (LV16*a*). That is, the periodical variation of the ejection amount occurs in the heads HD. For example, in the heads HD of No. 4, No. 8 and No. 12, as denoted by lines of the reference numerals LV4*b*, LV8*b* and LV12*b*, two types of ink droplets which are different in the amount are alternately ejected. In addition, in the head HD of No. 16, as denoted by line of the reference numeral LV16*b*, four types of ink droplets are repeatedly elected from a minimum amount of ink droplets to a maximum amount of ink droplets Discussion about Ejection Amount With respect to the heads HD of the comparative examples, the reason why the shortage or the periodical variation of the ejection amount occurs is not accurately known. In the shortage of the ejection amount, in the head HD of No. 1 to the head HD of No. 4, since the channel resistance of the ink supply path 425 is excessively low, it may be considered that, when the ink contained in the pressure chamber 424 is pressurized, the ink is excessively returned from the pressure chamber 424 to the ink supply path 425. In contrast, in the heads HD of No. 13 to the head HD of No. 16, since the width of the pressure chamber 424 is excessively small and the deformation of the diaphragm portion 423*a* is insufficient or the channel resistance of the ink supply path 425 is excessively high, it may be considered that the supply of the ink from the ink supply path 425 is insufficient.

In the periodical variation of the ejection amount, it may be considered that the ink contained in the pressure chamber 424 is not sufficiently depressurized after the ejection of the ink droplets or the channel resistance of the ink supply path 425 goes out of the proper range.

Ink having Viscosity of 6 mPa·s

In the above-described evaluated result, the viscosity of the ink was 15 mPa·s. By using the head of the present embodiment, the ink having the viscosity of 6 mPa·s can be similarly ejected. The low viscosity of the ink indicates that the channel resistance is low. Accordingly, the head HD in which the channel resistance of the ink supply path 425 is low is evaluated.

In detail, the head HD of No. 6 in which the cross-sectional area S425 of the ink supply path 425 is largest and the length L425 is shortest is evaluated. That is, if the ink having the viscosity of 6 mPa·s can be stably ejected by the head HD of No. 6, this ink can be stably ejected with a high frequency by the heads HD of No. 7, 10 and 11. In addition, as the comparative examples, the heads HD of No. 1, 2 and 5 are evaluated.

Figure 77:
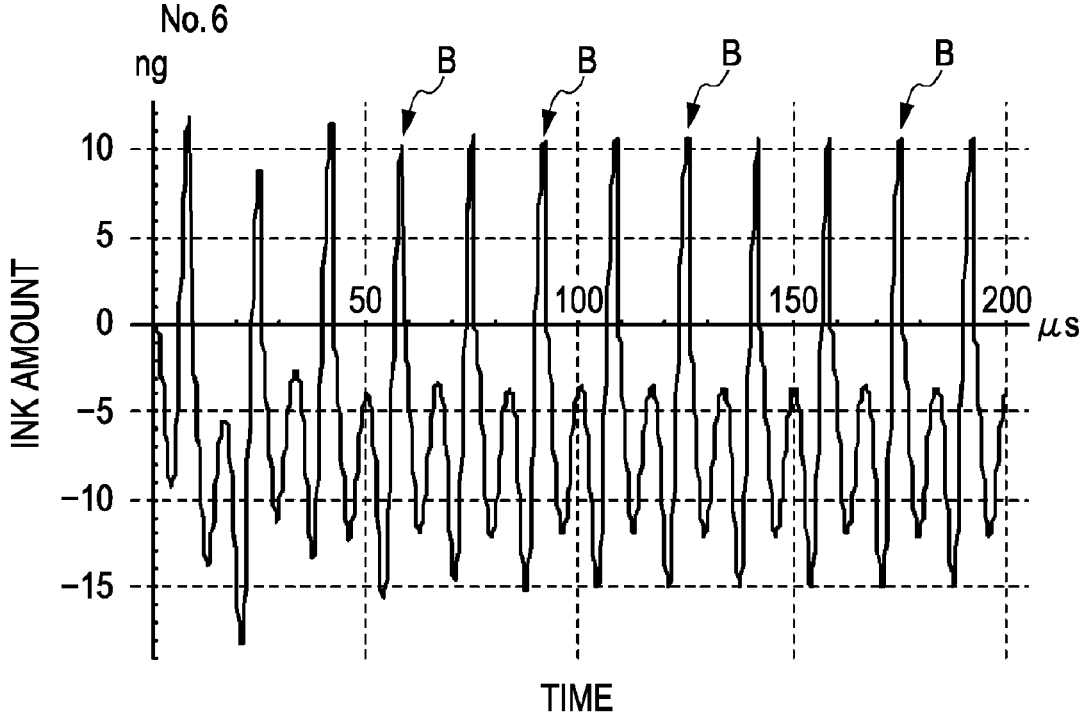
FIG. 77 is a view showing a simulation result when an ink having viscosity of 6 mPa·s is ejected with a frequency 60 kHz using a head of No. 6.

FIG. 77 shows a simulation result when the ink having the viscosity of 6 mPa·s is ejected with the frequency of 60 kHz using the head HD of No. 6. In the head HD of No. 6, the ink droplets in the fourth ink droplet and later ink droplets are stably ejected by the amount slightly less than 11 ng. From this result, the head HD of No. 6 also satisfies the above-described evaluation reference. That is, the head HD of No. 6 can stably eject the ink droplets with a high frequency although the ink has the viscosity of 6 mPa·s.

Figure 78:
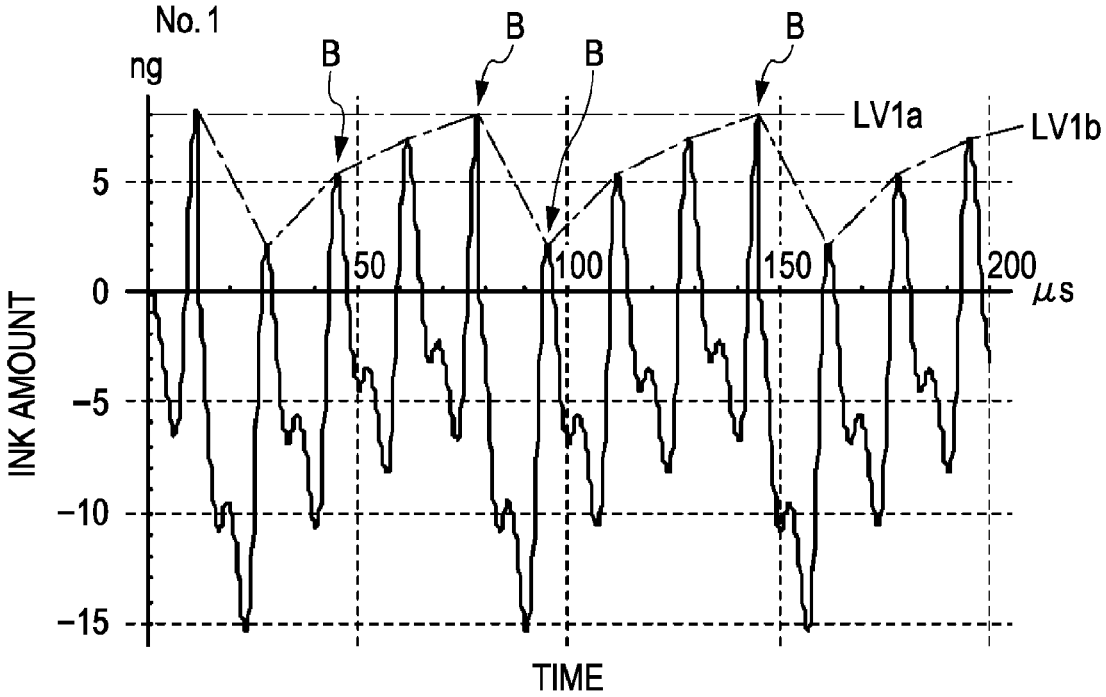
FIG. 78 is a view showing a simulation result when an ink having viscosity of 6 mPa·s is ejected with a frequency 60 kHz using a head of No. 1.
Figure 79:
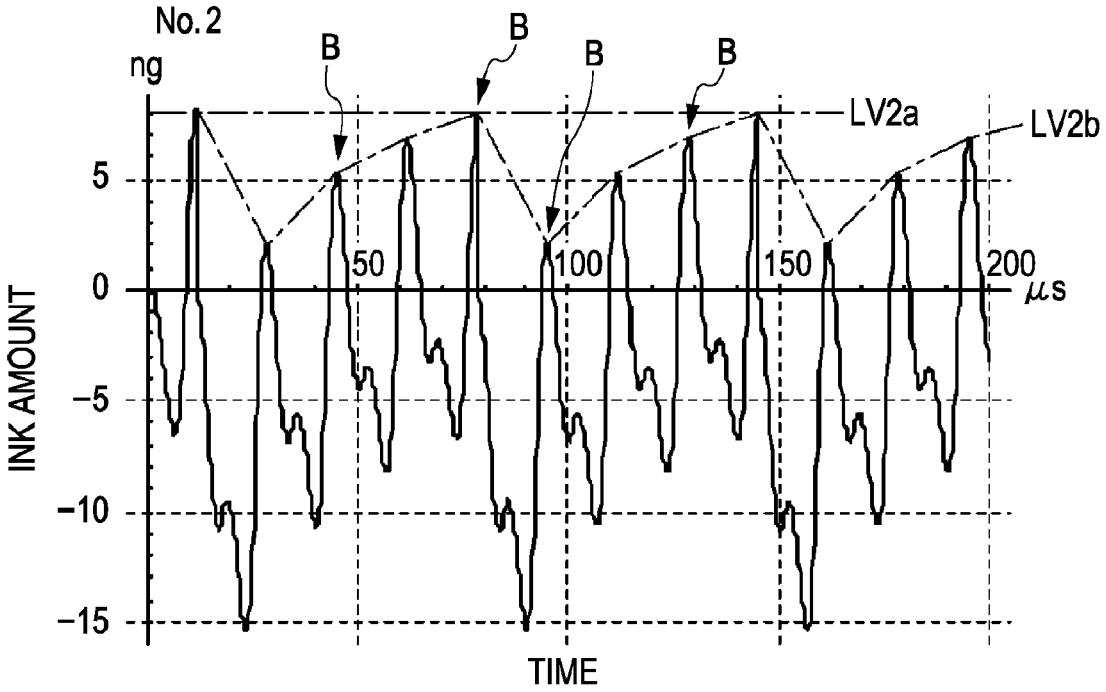
FIG. 79 is a view showing a simulation result when an ink having viscosity of 6 mPa·s is ejected with a frequency 60 kHz using a head of No. 2.
Figure 80:
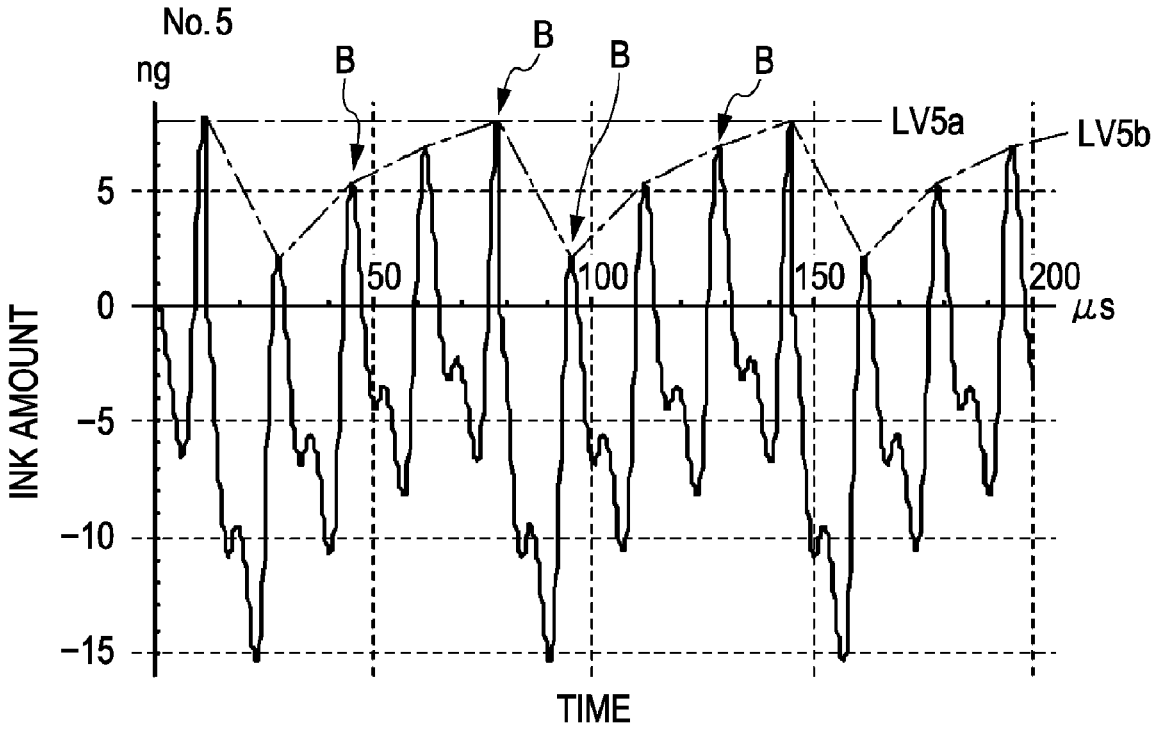
FIG. 80 is a view showing a simulation result when an ink having viscosity of 6 mPa·s is ejected with a frequency 60 kHz using a head of No. 5.

FIGS. 78 to 80 show the simulation results when the ink having the viscosity of 6 mPa·s is ejected with the frequency of 60 kHz using the heads HD of No. 1, 2 and 5. As shown in these drawings, all the maximum amounts of ink droplets of the heads HD do not reach the reference amount (LV1*a*, LV2*a* and LV5*a*) In addition, the deviation in ejection amount occurs (LV1*b*, LV2*b* and LV5*b*). From these results, in the heads HD of No. 1, 2 and 5, if the ink having the viscosity of 6 mPa·s is ejected with the high frequency, the shortage of the amount of ink droplets occurs and thus the amount of ink droplets becomes unstable.

Other Embodiments

Although the printing system having the printer 1 as the liquid ejecting apparatus is described in the above-described embodiments, the disclosure of the liquid ejecting method, the liquid ejecting system and the method of setting the ejection pulse are included. In addition, these embodiments are intended to facilitate the understanding of the invention and not to limit the invention. The invention may be modified or improved without departing the scope thereof and the invention includes the equivalent thereof. In particular, the following embodiments are included in the invention.

Other Heads HD'

Figure 81:
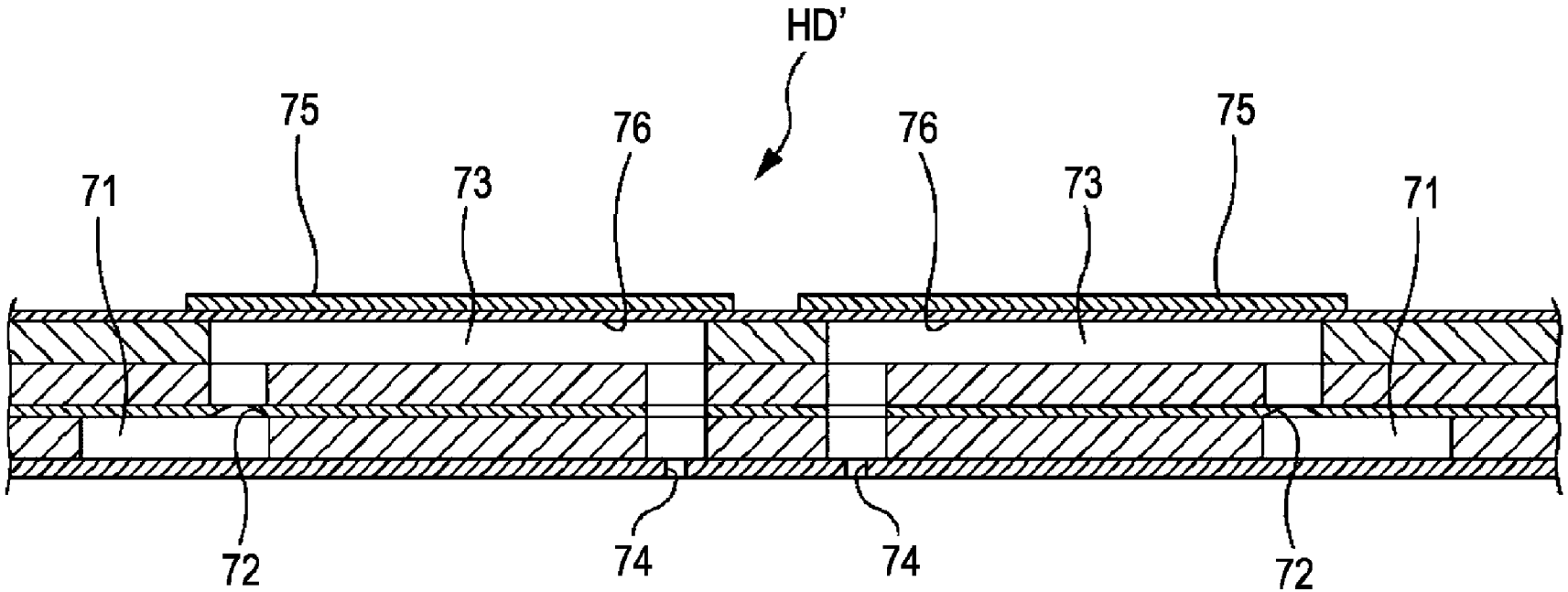
FIG. 81 is a cross-sectional view explaining another head.

In the heads HD of the above-described embodiments, an element which performs an operation for increasing the volume of the pressure chamber 424 as the potential applied by the ejection pulse PS1 (PS1, PS2 or the like) is increased was used as the piezo-element. Other types of piezo-elements may be used. Another head HD' shown in FIG. 81 uses piezo-elements which perform the operation for decreasing the volume of a pressure chamber 73 as the potential applied by the ejection pulse PS is increased, as piezo-elements 75.

In brief, another head HD' includes common ink chambers 71, ink supply openings 72, pressure chambers 73, and nozzles 74. A plurality of ink channels from the common ink chambers 71 to the nozzles 74 via the pressure chambers 73 is included in correspondence with the nozzles 74. Even in another head HD', the volumes of the pressure chambers 73 vary by the operation of the piezo-elements 75. That is, a portion of the pressure chambers 73 is partitioned by a vibration plate 76, and the piezo-elements 75 are provided on the surface of the vibration plate 76 which becomes the opposite side of the pressure chambers 73.

A plurality of piezo-elements 75 is provided in correspondence with the pressure chambers 73. Each of the piezo-elements 75 is configured by sandwiching a piezoelectric body between an upper electrode and a lower electrode (all not shown) and is deformed by applying a potential difference to these electrodes. In this example, if the potential of the upper electrode is increased, the piezoelectric body is charged and thus each piezo element 75 is bend to be convex to each pressure chamber 73. Accordingly, each pressure chamber 73 contracts. In addition, in another head HD', the portion of the vibration plate 76 which partitions each pressure chamber 73 corresponds to the partitioning portion.

Even in another head HD', a pressure variation is applied to the ink contained in the pressure chambers 73 and the ink droplets are ejected using this pressure variation. Accordingly, the behavior of the ink contained in the pressure chambers 73 at the time of the ejection of the ink droplet is equal to that of the above-described head HD. Accordingly, by adjusting the length and the cross-sectional area of the ink supply ports 72 or the length of the pressure chambers 73, the same effect as the above-described head HD can be obtained.

Combination of Embodiments

Although the first embodiment and the second embodiment are individually described in the present specification, heads HD including the feature of the first embodiment and the feature of the second embodiment may be obtained. In these heads HD, the ejection of the ink droplets can be stabilized with certainty.

Element for Performing Ejection Operation

In the above-described heads HD, the piezo-elements 433 and 75 are used as the elements which perform the operation (the ejection operation) for ejecting the ink. The elements which perform the ejection operation are not limited to the piezo-elements 433 and 75. For example, magnetostrictive elements may be used. If the piezo-elements 433 and 75 are used, the volumes of the pressure chambers 424 and 73 can be controlled on the basis of the potential of the ejection pulse PS with accuracy.

Shape of Nozzles 427 or Ink Supply Path 425

In the above-described embodiments, the nozzles 427 are composed of substantially funnel-shaped holes which penetrate in the thickness direction of the nozzle plate 422. The ink supply path 425 has a rectangular opening shape and is composed of a hole for communicating the pressure chamber 424 and the common ink chamber 426, that is, a communication hole which partitions a rectangular column-shaped space.

Figure 84A:
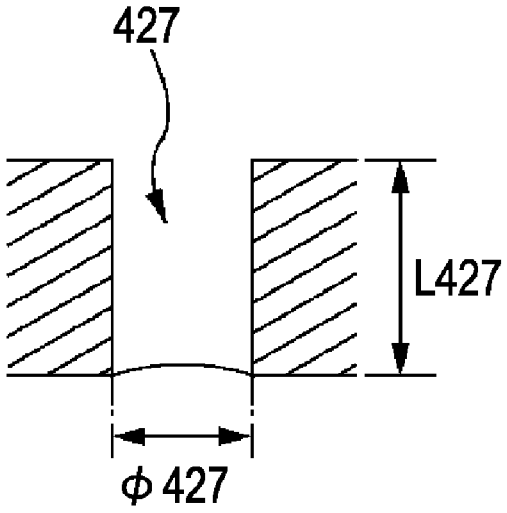
FIG. 84A is an enlarged view of a nozzle composed of only a straight portion.

The nozzles 427 or the ink supply path 425 may have various shapes. For example, the nozzles 427 may have a shape in which the cross-sectional area is substantially constant in the surface perpendicular to the nozzle direction, that is, a shape partitioning a columnar space, as shown in FIG. 84A. In other words, the nozzles 427 composed of only the above-described straight portions 427*b* may be used.

Figure 84B:
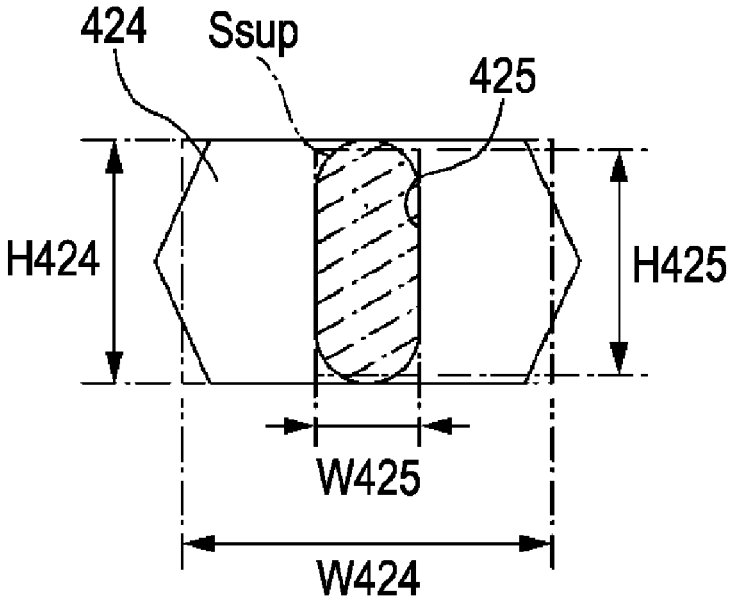
FIG. 84B is a view explaining a modified example of an ink supply path and a pressure chamber.

In addition, the ink supply path 425 may be, for example, as shown in FIG. 84B, composed of a channel having an opening having a vertically elongated ellipse-shape (having a shape obtained by connecting two semicircles having the same radius at a common circumscribed line). In this case, the cross-sectional area Ssup of the ink supply path 425 corresponds to the area of the ellipse-shaped portion denoted by oblique lines With respect to the ink supply path 425 having the ellipse-shaped opening, a channel having a rectangular opening equivalent thereto may be defined and analyzed. In this case, the height H425 of the ink supply path 425 is slightly lower than a maximum height of the actual ink supply path 425. In addition, the same is true although the opening of the ink supply path 425 has an ellipse shape.

In addition, the same is true in the pressure chamber 424. As shown in FIG. 84B, if the surface perpendicular to the longitudinal direction of the pressure chamber 424 has a horizontal elongated hexagonal shape, a channel having a rectangular cross section equivalent thereto may be defined and analyzed. That is, a channel having the rectangular cross section of which the height is H424 and the width W424 is slightly smaller than a maximum width of the pressure chamber 424 may be defined and analyzed.

OTHER APPLICATION EXAMPLES

Although the printer 1 is described as the liquid ejecting apparatus in the above-described embodiments, the invention is not limited to this. For example, the same technique as the present embodiment is applicable to various types of liquid ejecting apparatus using an ink jet technique, such as a color filter manufacturing apparatus, a dyeing apparatus, a microfabricated apparatus, a semiconductor manufacturing apparatus, a surface treatment apparatus, a three-dimensional modeling apparatus, a fluid-vaporizing apparatus, an organic EL manufacturing apparatus (more particularly, a polymer EL manufacturing apparatus), a display manufacturing apparatus, a film forming apparatus, a DNA chip manufacturing apparatus, and so on. In addition, methods or manufacturing methods thereof are included in the application range.

The entire disclosure of Japanese Patent Application No: 2008-058455, filed Mar. 7, 2008 and No: 2008-305334, filed Nov. 28, 2008 are expressly incorporated by reference herein.

What is claimed is:

1. A liquid ejecting method, comprising ejecting a liquid from a liquid ejecting head, wherein:

the viscosity of the liquid is in a range from 6 mPa·s to 15 mPa·s, the liquid ejecting head includes:

nozzles which eject the liquid;

a pressure chamber which applies a pressure variation to the liquid in order to eject the liquid from the nozzles; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit.

2. The liquid ejecting method according to claim 1, wherein the channel resistance of the supply unit is higher than that of the pressure chamber.

3. The liquid ejecting method according to claim 2, wherein the channel resistance of the nozzles is higher than that of the supply unit.

4. The liquid ejecting method according to claim 1, wherein the cross-sectional area of the supply unit is in a range from $3.3\times10^{-15}$ $m^2$ to $10\times10^{-15}$ $m^2$.

5. The liquid ejecting method according to claim 1, wherein the channel length of the pressure chamber is in a range from 500 μm to 1000 μm.

6. The liquid ejecting method according to claim 1, wherein the cross-sectional area of the supply unit is in a range from $3.3\times10^{-15}$ $m^2$ to $10\times10^{-15}$ $m^2$.

7. The liquid ejecting method according to claim 6, wherein the liquid ejecting head includes an element which deforms a partitioning portion by the degree according to a potential variation pattern of an applied ejection pulse.

8. A liquid ejecting head comprising:

nozzles which eject the liquid;

a pressure chamber which applies a pressure variation to the liquid in order to eject the liquid from the nozzles; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit.

9. A liquid ejecting apparatus comprising:

an ejection pulse generation unit which generates an ejection pulse; and a liquid ejection head which ejects a liquid from nozzles and includes:

a pressure chamber which deforms a partitioning portion and applies a pressure variation to the liquid in order to eject the liquid from the nozzles;

an element which deforms the partitioning portion by the degree according to a potential variation pattern of an applied ejection pulse; and a supply unit which communicates with the pressure chamber and supplies the liquid to the pressure chamber, the cross-sectional area of the supply unit is in a range from ⅓ of the cross-sectional area of the pressure chamber to the cross-sectional area of the pressure chamber, and the channel length of the pressure chamber is equal to or more than the channel length of the supply unit and is equal to or less than twice of the channel length of the supply unit.

* * * * *